US007013093B2

(12) United States Patent
Nakazato

(10) Patent No.: US 7,013,093 B2
(45) Date of Patent: Mar. 14, 2006

(54) IMAGE FORMING APPARATUS AND METHOD OF CALCULATING TONER CONSUMPTION AMOUNT

(75) Inventor: Hiroshi Nakazato, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 250 days.

(21) Appl. No.: 10/722,128

(22) Filed: Nov. 26, 2003

(65) Prior Publication Data

US 2004/0156645 A1 Aug. 12, 2004

(30) Foreign Application Priority Data

Dec. 6, 2002 (JP) ..... 2002-354530
Dec. 12, 2002 (JP) ..... 2002-360512
Dec. 12, 2002 (JP) ..... 2002-360513
Dec. 12, 2002 (JP) ..... 2002-360514
Dec. 12, 2002 (JP) ..... 2002-360515

(51) Int. Cl.
*G03G 15/08* (2006.01)

(52) U.S. Cl. ..... 399/27

(58) Field of Classification Search ..... 399/27, 399/30, 29, 58, 61, 62
See application file for complete search history.

(56) References Cited

U.S. PATENT DOCUMENTS 5,635,972 A 6/1997 Maruyama et al.
6,134,396 A * 10/2000 Kaneko
6,374,064 B1 * 4/2002 Budnik et al. ..... 399/27

FOREIGN PATENT DOCUMENTS

JP 6-138769 A 5/1994
JP 2002-174929 A 6/2002

* cited by examiner

*Primary Examiner*—Susan Lee
(74) *Attorney, Agent, or Firm*—Sughrue Mion, PLLC

(57) ABSTRACT

During an ordinary image forming operation, the number of print dots is counted based on an image signal, and a toner consumption amount is calculated from the result. Meanwhile, during an operation under a non-ordinary mode which is different from the ordinary image forming operation, a test pattern offset value Totn is extracted as a toner consumption amount which corresponds to the operation (Step S141). The test pattern offset value Totn and a drive offset value Todn, which corresponds to the amount of toner which is scattered into inside an apparatus, are subtracted from a remaining toner amount Tr which is stored in a memory, whereby a remaining toner amount of toner remaining in the developer 4Y after the operation is calculated (Steps S142 through S146).

43 Claims, 26 Drawing Sheets

FIG. 16

| OFFSET VALUE TABLE DATA | | ONE OF TWO PAGES | OTHERS |
|---|---|---|---|
| HIGH IMAGE-QUALITY MODE | OHP | T11 | T15 |
| | NON-OHP | T12 | T16 |
| TONER SAVE MODE | OHP | T13 | T17 |
| | NON-OHP | T14 | T18 |

IMAGE FORMING APPARATUS AND METHOD OF CALCULATING TONER CONSUMPTION AMOUNT

BACKGROUND OF THE INVENTION

1. Field of the Invention

The present invention relates to an image forming apparatus which forms an image using toner, and a technique for calculating a toner consumption amount in the image forming apparatus.

2. Description of the Related Art

In an image forming apparatus, such as a printer, a copier machine and a facsimile machine, which forms an image using toner, it is necessary to grasp a consumption amount or the remaining amount of toner, for maintenance purposes such as to supply toner. Noting this, in Japanese Patent Application Laid-Open Gazette No. 2002-174929, a method of and an apparatus for detecting a toner consumption amount has been disclosed which permit, by means of a simple structure, to accurately calculate the amount of toner which is consumed as a toner image is formed in a predetermined unit (e.g., in the unit of a page, a job, etc.).

Considering that a relationship between the values of print dots and a toner consumption amount is non-linear and that the non-linear relationship changes also in accordance with the states of dots which are adjacent to this print dots, this detection method and the detecting apparatus demand to classify a string of print dots into three patterns of isolated dots, consecutive double dots and intermediate value dots, count the number of dots forming each pattern and calculate a toner consumption amount based on thus obtained counts.

By the way, although the method and the apparatus described in Japanese Patent Application Laid-Open Gazette No. 2002-174929 allow to calculate a toner consumption amount during an ordinary image forming operation based on print dots, the method and the apparatus give no consideration on an operation under a non-ordinary mode which is different from the ordinary image forming operation. However, an operation which will eventually lead to a consumption of toner could be triggered even during execution of the non-ordinary mode operation. Hence, there is a first problem that it is not possible to accurately calculate a toner consumption amount when no consideration is given on such an operation.

Further, the only route illustrated in FIGS. 2 and 4 of Japanese Patent Application Laid-Open Gazette No. 2002-174929 mentioned above as a route for inputting a signal to a laser driver is a route for inputting pulse signals obtained by modulating print dots by a pulse modulating circuit. Despite this, an image forming apparatus may have such a structure that there are multiple of routes for feeding signals to a laser driver which serves as image forming means. An example is an image forming apparatus having a structure in which there is another route for inputting a signal which is irrelevant to print dots in addition to the above-mentioned route which is relevant to print dots (hereinafter referred to as "the print-dot route"), to thereby form an image which is different from the print dots.

When such an image forming apparatus receives a signal through the print-dot route mentioned above and performs an image forming operation based on print dots, the amount of toner which is consumed in the image forming operation can be calculated according to the method and as in the apparatus described in above-mentioned Japanese Patent Application Laid-Open Gazette No. 2002-174929. However, when an image forming operation which is not based on print dots is executed after reception of a signal through another route mentioned earlier, the method and the apparatus described in Japanese Patent Application Laid-Open Gazette No. 2002-174929 do not allow to calculate the amount of toner which is consumed in the image forming operation. In consequence, there is a second problem that it is impossible to accurately calculate a toner consumption amount in the image forming apparatus as a whole.

In addition, as described above, the method and the apparatus described in Japanese Patent Application Laid-Open Gazette No. 2002-174929 demand to classify a string of print dots into three patterns of isolated dots, consecutive double dots and intermediate value dots, count the number of dots forming each pattern, calculate the consumption amounts of toner in the respective colors recorded on a recording paper based on thus obtained counts, add an offset amount to these, and accordingly calculate the total amount of toner of the respective colors consumed at this stage. As for the offset amount, Japanese Patent Application Laid-Open Gazette No. 2002-174929 describes that "an offset amount is the amount of toner which is consumed independently of an exposure time with laser light, and as such, a unique value to each color image forming apparatus." In other words, the offset amount mentioned above is a constant value. Therefore, the offset amount which is a constant value is added to the toner consumption amounts calculated based on the counts described earlier, whereby the total amount of the consumed toner are calculated.

By the way, in recent image forming apparatuses, in an attempt to improve the convenience of use, an engine section (image forming means) which performs formation of an image is provided with an operation signal containing various information from a host computer or a controller such as a main controller which deciphers a print command signal fed from the host computer. This gives rise to a third problem that in such an image forming apparatus, when an operation sequence, an operating state or the like of the engine section changes in response to the operation signal, if the offset amount is fixed to a constant value as in the case of the method and the apparatus described in Japanese Patent Application Laid-Open Gazette No. 2002-174929, it may not be possible to accurately calculate the amount of consumed toner.

Further, as described above, the method and the apparatus described in Japanese Patent Application Laid-Open Gazette No. 2002-174929 demand to classify a string of print dots into three patterns of isolated dots, consecutive double dots and intermediate value dots, count the number of dots forming each pattern and calculate the total amount of toner which constitutes a toner image (hereinafter referred to as "image constituting toner") based on thus obtained counts.

Still further, considering that there is toner which gets consumed separately from image constituting toner during formation of a toner image, an offset value (unique value) is added to the total amount mentioned above and the resultant value is used as a toner consumption amount. That is, as is already known in the art, even during execution of an image forming operation to form a white image, i.e., to form no print dot at all, so-called fogging occurs and a small amount of toner is consumed. Noting this, the amount of thus consumed toner is added, to thereby improve the accuracy of calculating a toner consumption amount.

In the case of such an image forming apparatus, to stably form a toner image, it is desirable that characteristics of toner to use remain constant. However, it is known that in an actual apparatus, as toner images are formed repeatedly, the image density of a toner image could sometimes gradually change. Characteristics of toner are thus not always constant but could change with time. How this change occurs is different depending on the structure of an apparatus or toner to be used. For instance, this type of image forming apparatus accompanies a phenomenon called "selective development," i.e., a phenomenon that in the case of toner containing particles having various particle diameters, toner having certain particle diameters is selectively consumed during development. Due to this, a particle diameter distribution of remaining toner gradually changes. Changes of toner characteristics with time of course influence the quality of a toner image which is formed, and also brings about changes of an offset value mentioned earlier.

It is also known that in this type of image forming apparatus, the quality of an image such as the density of the image is controlled, as image forming conditions are changed which consist of various factors such as a bias potential which is applied upon each portion of the apparatus. In addition, the image density of a toner image may change owing to a difference between individual apparatuses, a change with time, a change in environment surrounding the apparatus such as a temperature and a humidity level, etc. Therefore, image forming conditions which are influential over image densities among those factors are adjusted, thereby controlling image densities. The amount of fogging also changes as image forming conditions are changed, and an offset value also changes as the image forming conditions are changed.

Once the offset value has changed, in the case of a conventional image forming apparatus in which the offset value is to be fixed, a calculated toner consumption amount becomes different from an actual amount and it could therefore become difficult to supply toner at proper timing. Here arises a fourth problem to provide a technique which permits to calculate a toner consumption amount at a higher accuracy regardless of a change with time of the offset value.

By the way, over the recent years, capabilities of color image forming apparatuses have improved and there now is a risk that unauthorized use could be made of these improved apparatuses. A technique which has been proposed in an effort to prevent unauthorized printing against this background is to add, to an image to be printed with an image forming apparatus, namely, an original image, a special image which identifies this image forming apparatus or specifies a person who has printed. As shown in FIG. 26 for instance, in the event that one wishes to print in colors a map containing a confidential item on a sheet S such as a transfer paper, a copy paper and a sheet for overhead projector (hereinafter referred to as "OHP sheet"), among output color components (which are magenta, cyan, yellow and black for example) available in the image forming apparatus, one which is least noticeable to human eyes (yellow, for instance) may be used to print a special image S1 which expresses a serial production number of the image forming apparatus or the like.

In the case of an image forming apparatus capable of printing a special image S1, a special image S1 is printed over an original image in some instances. As compared to where an original image alone is printed, toner of the output color component which is least noticeable to human eyes is consumed in the amount equivalent to the printing of the special image S1. Hence, there is a fifth problem that a direct application of the toner consumption amount calculation technique implemented in such a conventional apparatus which is supposed to print an original image alone would not make it possible to accurately calculate the consumption amount of toner which constitutes a special image S1.

SUMMARY OF THE INVENTION

The present invention has been made to solve the first problem described above. Accordingly, a first object of the present invention is to provide an image forming apparatus and a toner consumption amount calculating method which, considering a consumption of toner during other operation than an ordinary image forming operation, allow to accurately calculate a toner consumption amount.

The present invention has been made also to solve the second problem described above. Accordingly, a second object of the present invention is to provide an image forming apparatus and a toner consumption amount calculating method which, even when applied to such an image forming apparatus in which there are multiple of routes for feeding signals to image forming means, permit to accurately detect the amount of toner which is consumed when an image is formed in response to a signal received via each route and hence accurately calculate a toner consumption amount.

The present invention has been made also to solve the third problem described above. Accordingly, a third object of the present invention is to accurately calculate the amount of toner consumed during each toner image forming operation in an image forming apparatus in which the toner image forming operations change in accordance with an operation signal which is sent from a controller to image forming means.

The present invention has been made also to solve the fourth problem described above. Accordingly, a fourth object of the present invention is to provide an image forming apparatus and a toner consumption amount calculating method which make it possible to accurately calculate the amount of toner in a predetermined unit which is consumed as a toner image is formed.

The present invention has been made also to solve the fifth problem described above. Accordingly, a fifth object of the present invention is to highly accurately calculate the amount of toner which is consumed in an image forming apparatus which prints a predetermined special image of a color component which is not easily recognizable to a human eye on an original image during color printing of the original image using toner in a plurality of color components.

According to a first aspect of the present invention, there is provided an image forming apparatus which forms a toner image on an image carrier based on image data which are fed, wherein a toner consumption amount is calculated based on a total of a first integrating value which is obtained by integrating a first toner amount which is consumed during an ordinary toner image forming operation, and a second integrating value which is obtained by integrating a second toner amount which is consumed during an operation under a non-ordinary mode which is different from the ordinary toner image forming operation.

According to a second aspect of the present invention, there is provided an image forming apparatus, comprising: image forming means which forms a toner image on an image carrier based on an image signal which is fed; and detecting means which detects a toner amount of toner which is consumed as the image forming means forms a toner image, wherein a toner consumption amount is calculated based on an integrating value which is obtained by integrating the toner amount detected by the detecting means, as routes for feeding the image signal to the image forming means, a first route and a second route which is different from the first route are provided, and the detecting means executes a first toner amount detecting process which is based on the image signal which is fed to the image forming means through the first route, executes a second toner amount detecting process which is based on the image signal which is fed to the image forming means through the second route, and ensures that the first toner amount detecting process is different from the second toner amount detecting process.

According to a third aspect of the present invention, there is provided an image forming apparatus, comprising: image forming means which forms a toner image on an image carrier in a predetermined unit based on an operation signal inputted from a controller; consumption amount calculating means which adds a toner amount of toner which is used in an ordinary toner image formed by the image forming means and a toner amount, as an offset value, of toner which is consumed separately from the toner which is used in the ordinary toner image, to thereby calculate a toner consumption amount of toner consumed through a toner image forming operation which is performed by the image forming means; and offset value setting means which changes the offset value in accordance with an operation signal inputted from the controller.

According to a fourth aspect of the present invention, there is provided an image forming apparatus which forms a toner image in a predetermined unit, comprising: consumption amount calculating means which adds a total amount of image constituting toner which constitutes the toner image and a toner amount, as an offset value, of toner which is consumed in forming the toner image separately from the image constituting toner, thereby calculating, in the predetermined unit, a toner consumption amount of toner which is consumed as the toner image is formed; and offset value setting means which changes the offset value in accordance with an operating state of the apparatus.

According to a fifth aspect of the present invention, there is provided an image forming apparatus which forms a toner image in a predetermined unit, comprising: consumption amount calculating means which adds a total amount of image constituting toner which constitutes the toner image and a toner amount, as an offset value, of toner which is consumed in forming the toner image separately from the image constituting toner, thereby calculating, in the predetermined unit, a toner consumption amount of toner which is consumed as the toner image is formed; and offset value setting means which changes the offset value in accordance with a history of use of toner.

According to a sixth aspect of the present invention, there is provided an image forming apparatus which forms a toner image in a predetermined unit, comprising: consumption amount calculating means which adds a total amount of image constituting toner which constitutes the toner image and a toner amount, as an offset value, of toner which is consumed in forming the toner image separately from the image constituting toner, thereby calculating, in the predetermined unit, a toner consumption amount of toner which is consumed as the toner image is formed; and offset value setting means which changes the offset value in accordance with an image forming condition which is used in forming the toner image.

According to a seventh aspect of the present invention, there is provided an image forming apparatus in which at the time of color printing of an original image using toner in a plurality of color components, a predetermined special image formed using toner in a color component which is hard for human eyes to recognize is superimposed on the original image, the apparatus comprising: consumption amount calculating means which adds a total amount of image constituting toner which constitutes the toner image and a toner amount, as an offset value, of toner which is consumed during the color printing separately from the image constituting toner, thereby calculating a toner consumption amount in a predetermined unit, for each color component; and storage means which stores a plurality of offset values corresponding to the plurality of color components respectively, wherein the offset value corresponding to the color component used in forming the special image is set to be larger than the offset values corresponding to the other color components.

The above and further objects and novel features of the invention will more fully appear from the following detailed description when the same is read in connection with the accompanying drawings. It is to be expressly understood, however, that the drawings are for purpose of illustration only and are not intended as a definition of the limits of the invention.

BRIEF DESCRIPTION OF THE DRAWINGS

FIG. 16 is a drawing which shows an example of offset value table data stored in a memory;

DETAILED DESCRIPTION OF THE PREFERRED EMBODIMENTS

<First Preferred Embodiment>

Figure 1:
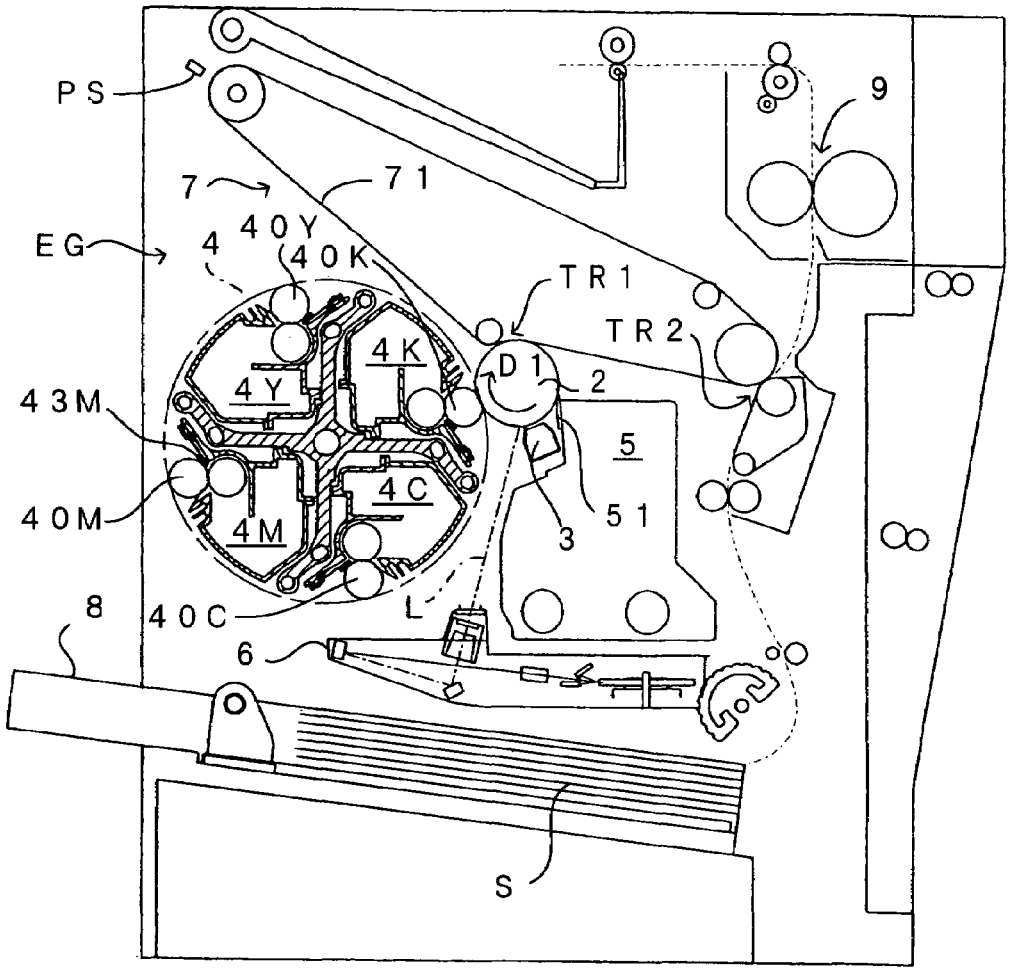
FIG. 1 is a drawing which shows a first preferred embodiment of an image forming apparatus according to the present invention.
Figure 2:
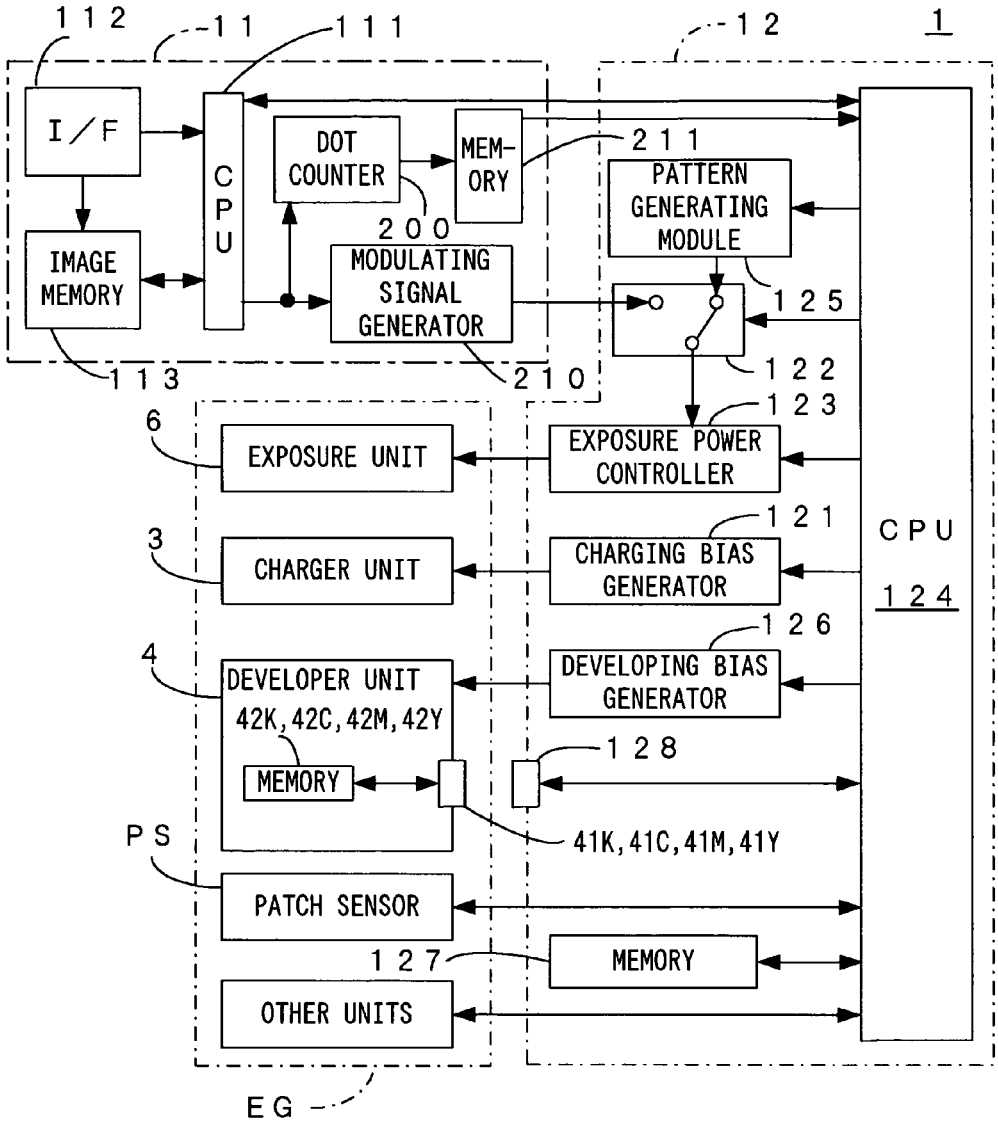
FIG. 2 is a block diagram which shows an electric structure of the image forming apparatus shown in FIG. 1.

FIG. 1 is a drawing which shows a first preferred embodiment of an image forming apparatus according to the present invention. FIG. 2 is a block diagram which shows an electric structure of the image forming apparatus shown in FIG. 1. This apparatus is an image forming apparatus which superimposes toner in four color components of yellow (Y), magenta (M), cyan (C) and black (K) to thereby form a full color image or forms a monochrome image using black (K) toner alone.

In this image forming apparatus, as a print command and image data are fed to a main controller 11 of a control unit 1 from an external apparatus such as a host computer, the main controller 11 outputs control commands to the respective portions of the apparatus, and based on the image data thus supplied, an image signal expressing an image to be formed as a multi-gradation print dot string is generated for each toner color component and outputted to an engine controller 12. In accordance with a command from the main controller 11, the engine controller 12 controls the respective portions of an engine EG and an image corresponding to the image signal is formed on a sheet S.

In the engine EG, a photosensitive member 2 is disposed in such a manner that the photosensitive member 2 can freely rotate in the arrow direction D1 shown in FIG. 1. Disposed around the photosensitive member 2 are a charger unit 3 which charges a surface of the photosensitive member 2 to a predetermined surface potential, a rotary developer unit 4 and a cleaning unit 5 along the rotation direction D1 of the photosensitive member 2. The charger unit 3 is provided with a charging bias from a charging bias generator 121, and uniformly charges an outer circumferential surface of the photosensitive member 2.

An exposure unit 6 irradiates a light beam L upon the outer circumferential surface of the photosensitive member 2 which is charged by the charger unit 3. As shown in FIG. 2, the exposure unit 6 is electrically connected with an exposure power controller 123. Based on a modulating signal corresponding to the image signal fed via an image signal switcher 122, the exposure power controller 123 controls the respective portions of the exposure unit 6, whereby the photosensitive member 2 is exposed with the light beam L and an electrostatic latent image corresponding to the image signal is formed on the photosensitive member 2.

For instance, in accordance with a command from a CPU 124 of the engine controller 12, when the image signal switcher 122 makes contact to a pattern generating module 125 (an operation under a non-ordinary mode which will be described later), the modulating signal corresponding to an image pattern outputted from the pattern generating module 125 is fed to the exposure power controller 123, whereby an electrostatic latent image is formed.

On the other hand, when the image signal switcher 122 makes contact to a CPU 111 of the main controller 11 (an operation under an ordinary mode which will be described later), a modulating signal generator 210 modulates the image signal fed through an interface 112 from an external apparatus such as a host computer, and supplies the modulating signal to the exposure power controller 123. The light beam L based on the modulating signal exposes the photosensitive member 2, and an electrostatic latent image corresponding to the image signal is formed on the photosensitive member 2. As a modulation method, various pulse modulation such as pulse width modulation (PWM) and pulse amplitude modulation (PAM) can be used.

The rotary developer unit 4 visualizes thus formed electrostatic latent image. In other words, as the rotary developer unit 4, a black developer 4K, a cyan developer 4C, a magenta developer 4M and a yellow developer 4Y are axially disposed for free rotations according to this embodiment. These developers 4K, 4C, 4M and 4Y rotate to certain positions, thereby selectively positioning developer rollers 40K, 40C, 40M and 40Y of the developers 4K, 4C, 4M and 4Y facing against the photosensitive member 2. A developing bias generator 126 applies a developing bias, and the developer roller supplies the toner of the selected color to the surface of the photosensitive member 2. As a result, the electrostatic latent image on the photosensitive member 2 is visualized in the color of the selected toner. In this embodiment, the photosensitive member 2 thus functions as an "image carrier" of the present invention.

The toner image developed by the rotary developer unit 4 in the manner described above is primarily transferred onto an intermediate transfer belt 71 of a transfer unit 7, within a primary transfer area TR1. Further, a cleaning section 5 is disposed at a position ahead of the primary transfer area TR1 in the circumferential direction (the rotation direction D1 shown in FIG. 1). A cleaning blade S1 scrapes off toner which remains on the outer circumferential surface of the photosensitive member 2 after the primary transfer. In addition, a static eraser (not shown) resets the surface potential of the photosensitive member 2 when the need arises.

The transfer unit 7 comprises the intermediate transfer belt 71 which runs across a plurality of rollers and a driver (not shown) which drives the intermediate transfer belt 71 into rotations. For transfer of a color image onto a sheet S, toner images in the respective colors formed on the photosensitive member 2 are superimposed one atop the other on the intermediate transfer belt 71, whereby a color image is formed. In a predetermined secondary transfer area TR2, the color image is secondarily transferred onto a sheet S which has been fed out from a cassette 8. The sheet S on which the color image has been thus formed is transported to a discharge tray part, which is disposed to a top surface portion of an apparatus body, via a fixing unit 9. After the secondary transfer, a cleaner (not shown) removes toner which is left remaining on the intermediate transfer belt 71.

A patch sensor PS is disposed facing against the surface of the intermediate transfer belt 71. During execution of an image forming condition adjusting operation which will be described later, the patch sensor PS detects optically image density of a patch image formed on the outer circumferential surface of the intermediate transfer belt 71.

As shown in FIG. 2, unit-side communicating sections 41K, 41C, 41M and 41Y are disposed respectively to the developers 4K, 4C, 4M and 4Y, and the unit-side communicating sections 41K, 41C, 41M and 41Y are electrically connected respectively with memories 42K, 42C, 42M and 42Y The memories 42K, 42C, 42M and 42Y store various types of data, such as production batches, histories of use, characteristics of toner which is held and the amounts of the remaining toner, related to the respective developers 4K, 4C, 4M and 4Y A body-side communicating section 128 electrically connected with the CPU 124 is disposed to the apparatus body.

When one of the developer rollers 40K, 40C, 40M and 40Y of the respective developers 4K, 4C, 4M and 4Y is selected and positioned facing against the photosensitive member 2, the unit-side communicating section of this developer comes positioned facing the body-side communicating section 128 at or within a predetermined distance which is 10 mm for instance, thereby realizing non-contact transmission of data between the communicating sections by means of a wireless communication such as one using an infrared ray. In this manner, the CPU 124 manages various information such as whether this developer remains attached, whether the developer is brand new and the lifetime of the developer.

This embodiment requires to use electromagnetic means such as a wireless communication for the purpose of attaining non-contact data transmission. An alternative however is to dispose connectors one each to the apparatus body and the developers 4K, 4C, 4M and 4Y and to mechanically engage the connector of the apparatus body with the developer's connector for mutual data transmission when one of the developers 4K, 4C, 4M and 4Y is selected and positioned facing against the photosensitive member 2. The memories 42K, 42C, 42M and 42Y are preferably non-volatile memories which can save data regarding the developers 4K, 4C, 4M and 4Y even when a power source is off or the developers 4K, 4C, 4M and 4Y are off the apparatus body. EEPROMs such as flash memories, ferroelectric memories (ferroelectric RAMs), or the like may be used as such non-volatile memories.

In FIG. 2, an image memory 113 disposed to the main controller 11 is for storing image data which are fed through the interface 112 from an external apparatus such as a host computer. Meanwhile, a memory 127 disposed to the engine controller 12 is formed by a ROM which stores a control program to be executed by the CPU 124, a RAM which temporarily stores the result of a calculation performed by the CPU 124, control data for controlling the engine EG etc. The main controller 11 of this image forming apparatus further comprises a dot counter 200.

Figure 3:
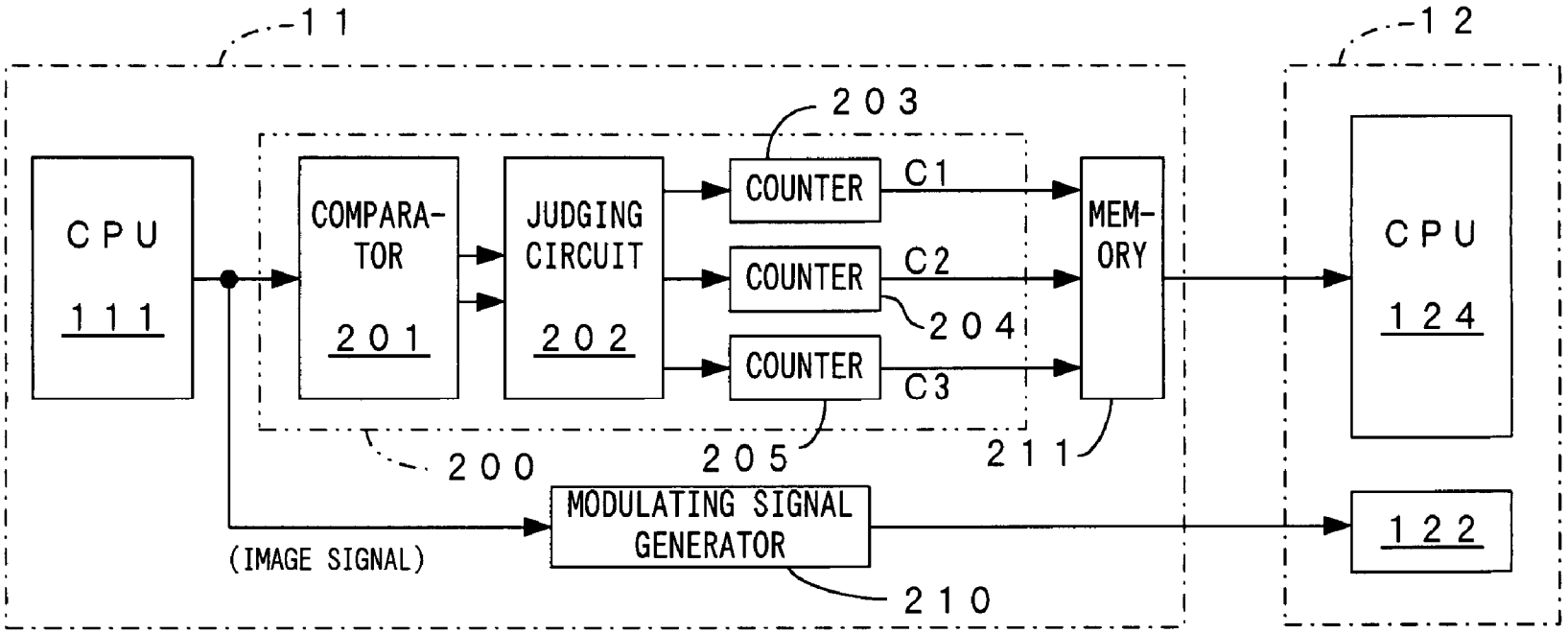
FIG. 3 is a block diagram which shows the structure of a dot counter.
Figure 4:
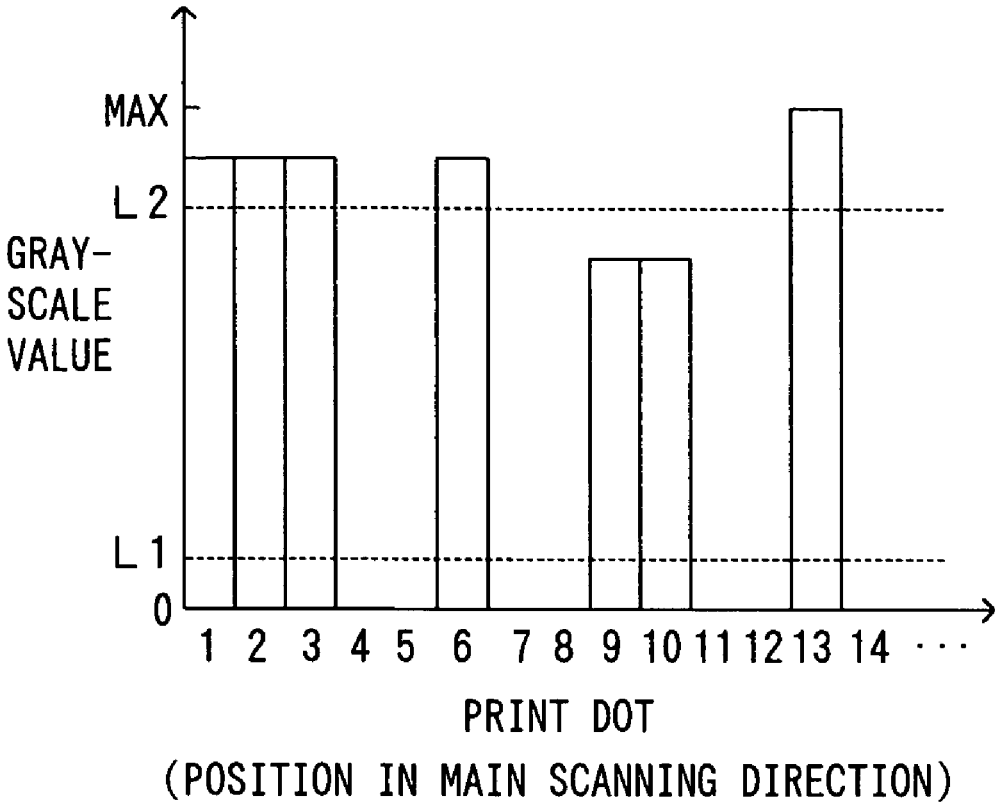
FIG. 4 is an explanatory drawing for describing a dot counting sequence.

FIG. 3 is a block diagram which shows the structure of the dot counter. FIG. 4 is a drawing which shows an example of the gradation levels of print dots and which is for describing the sequence of counting executed by the dot counter. Based on the image signal outputted from the main controller 11 to the engine controller 12, the dot counter 200 judges the types of print dots formed on the photosensitive member 2, and counts the number of the print dots. To be more specific, the dot counter 200 comprises a comparator 201, a judging circuit 202 and three counters 203 through 205.

As shown in FIG. 3, the comparator 201 receives the image signal which has been fed to the engine controller 12 from the CPU 111 of the main controller 11. The comparator 201 compares the gradation level of the image signal corresponding to each print dot with predetermined threshold values L1 and L2. The threshold value L1 is set to a value (e.g., 1/63 of the highest level MAX) which is close to a gradation level 0 (namely, a white image), and the threshold value L2 is set to a value (e.g., 48/63 of MAX) which is close to the highest gradation level MAX (namely, a solid image). The comparator 201 outputs a value "11" to the judging circuit 202 when the gradation level is equal to or larger than the threshold value L2, but a value "00" to the judging circuit 202 when the gradation level is smaller than the threshold value L1. In response, the judging circuit 202 judges whether the print dots are lined up in succession, i.e., whether there are neighboring dots next to a target print dot, and outputs a signal indicative of the result to the subsequent counters 203 through 205.

The operation of the judging circuit 202 will now be described in more detail. Every time the comparator 201 outputs the signal "11" which represents detection of a print dot whose gradation level is the same as or higher than the threshold value L2, the judging circuit 202 outputs a signal "1" to the counter 203. Hence, the counter 203 integrates a count C1 of print dots whose gradation levels are the same as or higher than the threshold value L2. In FIG. 4, the print dots 1, 2, 3, 6 and 13 are such print dots, and therefore, C1=5.

When there are three or more successive print dots whose gradation levels are the same as or higher than the threshold value L2, the judging circuit 202 outputs the signal "1" to the counter 204. Hence, the counter 204 integrates a count C2 of the three or more successive dots. In FIG. 4, the print dots 1 through 3 are such print dots, and therefore, C2=1.

Further, when the target print dot has no neighboring dot whose gradation level is equal to or higher than the threshold value L1, that is, when this print dot is an isolated dot, the judging circuit 202 outputs the signal "1" to the counter 205. The counter 205 therefore integrates a count C3 of isolated dots. In FIG. 4, the print dots 6 and 13 are such print dots, and therefore, C3=2.

In this fashion, the counters 203 through 205 respectively integrate the count C1 of high-gradation-level print dots, the count C2 of three or more successive dots among the high-gradation-level print dots and the isolated dot count C3, and these values are stored in a memory 211 every time one toner image of one color is formed for instance. At predetermined timing (e.g., when toner images of the four colors have been formed, upon a data request from the CPU 124, or the like), the memory 211 sends these values to the CPU 124 of the engine controller 12. The values are stored in the memory 127 when needed, and used for calculation of a remaining toner amount which will be described later.

In the image forming apparatus having such a structure described above, as a print command is fed from an external apparatus such as a host computer, an ordinary image forming operation to form an image corresponding to the print command is carried out. To be more specific, the print command which is an image forming request from the external apparatus and image data which correspond to the content of an image to be formed are supplied to the main controller 11 through the interface 112. The CPU 111 of the main controller 11 decomposes the received image data into each toner color, develops the image data into a multi-gradation-level image signal, and outputs the image signal to the engine controller 12 via the modulating signal generator 210. In response, the CPU 124 of the engine controller 12 executes the image forming operation described above while controlling the respective portions of the engine EC, whereby a desired image is formed on a sheet S. At this stage, the image signal switcher 122 is connected in such a manner that the image signal from the main controller 11 will be sent to the exposure power controller 123 in accordance with a command from the CPU 124.

Figure 5:
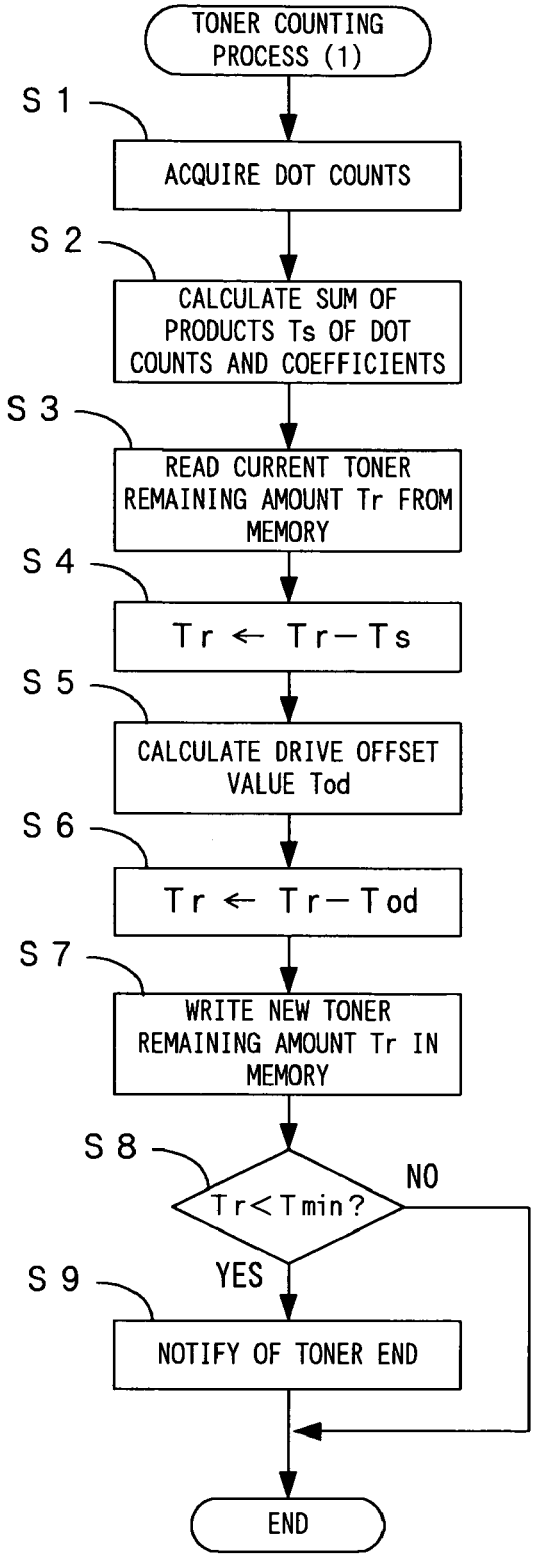
FIG. 5 is a flow chart which shows a toner counting process (1)

FIG. 5 is a flow chart which shows a toner counting process during execution of the ordinary image forming operation. In this image forming apparatus, for the convenience of management of consumables, the CPU 124 of the engine controller 12 executes the toner counting process (1) shown in FIG. 5 every time one image is formed, and calculates the amounts of the toner remaining in the developers 4Y, . . . for the respective toner colors. While a method of calculating the amount of toner remaining in the developer 4Y will now be described in relation to the yellow color, the operation is the same also for the other toner colors.

In the toner counting process (1) shown in FIG. 5, first, the counts C1, C2 and C3 of the print dots counted by the dot counter 200 are acquired (Step S1). These values are multiplied by predetermined coefficients respectively and added to each other, thereby-calculating a value Ts (Step S2). That is:

$$Ts=Kx\cdot(K1\cdot C1+K2\cdot C2+K3\cdot C3)$$

The symbols Kx, K1, K2 and K3 are weighting coefficients which have been determined in advance one each for each toner color. As the successive print dots are counted as one group and the respective counts are multiplied by the coefficients, the amount of toner which adheres on the photosensitive member 2 which serves as the image carrier and accordingly constitutes a toner image is accurately calculated. Such a method of calculating a toner amount is described in detail in above-mentioned Japanese Patent Application Laid-Open Gazette No. 2002-174929 and will not be described here.

Next, the amount Tr of toner remaining in the developer 4Y stored in the memory 127 of the engine controller 12 is read out (Step S3). A value obtained by subtracting the value Ts calculated as described above from this value Tr is then defined as anew toner remaining amount Tr (Step S4).

This kind of image forming apparatus is known to consume a very small amount of toner even when a white image is formed, i.e., even during execution of the image forming operation for printing no print dot at all. This occurs as a part of incompletely charged toner or inversely charged toner moves onto the photosensitive member 2 from the developer 4Y or a part of toner is scattered into inside the apparatus during execution of the image forming operation. Adhesion of such toner to an image is recognized as fogging.

Noting a loss of toner owing to this phenomenon, this embodiment requires to set a drive offset value Tod corresponding to the driving time of this developer. The drive offset value Tod is calculated by multiplying the driving time of the developer 4Y by a value which has been obtained through an experiment or the like as a toner scattering amount per u nit time in the developer 4Y (Step S5). The driving time of the developer 4Y may be a time during which the developing bias is applied upon the developer 4Y, the driving time of the developer roller 40Y which transports the toner housed within the developer 4Y to the opposed position facing the photosensitive member 2, or the like. Further, since the developer driving time per sheet is usually approximately constant when a sheet size is constant, the drive offset value Tod may be determined for each sheet size in advance and stored in the memory 127. In this case, at the step S5, the drive offset value Tod corresponding to the size of an image to be formed may be extracted from the memory 127.

Thus calculated drive offset value Tod is subtracted from the toner remaining amount Tr calculated at the step S4 (Step S6), thereby calculating anew toner remaining a mount Tr of toner remaining in the developer 4Y after an image has been formed. The memory 127 is updated with this value Tr (Step S7).

As described above, the total (Ts+Tod) of the sum of products Ts, which is obtained from the respective dot counts C1, . . . and the weighting coefficients K1, . . . , and the drive offset value Tod is the amount of toner which is consumed when one image is formed. A toner consumption amount is calculated every time one image is formed, and subtracted from the immediately precedent toner remaining amount, whereby the amount Tr of the toner remaining in the developer 4Y at present (at the end of the forming of the images) is calculated.

Although this embodiment requires that a toner consumption amount per image is subtracted from the initial amount of the toner housed in each developer and the amount of toner remaining in the developer upon forming of every image is consequently calculated, it is needless to mention that this is theoretically equivalent to calculation of the total toner consumption amount by means of integration of a toner consumption amount per image. In this preferred embodiment, the amount of toner which is consumed when one image is formed corresponds to a "first toner amount" of the present invention and the value calculated by integrating a toner amount corresponds to a "first integrating value" of the present invention.

It is preferable that in the developers 4Y, . . . which are structured to be attachable to and detachable from the apparatus body, prior to removal of the respective developers from the apparatus body, the toner remaining amounts Tr in the respective developers calculated as described above are stored in the memories 42Y, . . . Upon attaching of the respective developers to the apparatus body, the toner remaining amounts in the respective developers stored in the memories 42Y, . . . are read out and used as initial toner remaining amounts Tr which are required by the toner counting process (1) described above, which makes management of the lifetime of the developers easy. Of course, in the case of a brand new developer, the amount of toner filled in the developer at the time of shipment may be stored.

In addition, in this embodiment, the end of toner in the developer 4Y is judged based on the toner remaining amount Tr of toner remaining after an image has been formed. That is, thus calculated toner remaining amount Tr is compared with a minimum toner amount Tmin which h as been set in advance for the developer 4Y (Step S8), and when the toner remaining amount Tr is smaller than the minimum toner amount Tmin, the toner end is acknowledged and the main controller 11 is informed of the toner end (Step S9). On the other hand, when the toner remaining amount Tr is equal to or larger than the minimum toner amount Tmin, the toner counting process is ended without informing the toner end.

The minimum toner amount Tmin is the minimum necessary toner amount for the developer 4Y which the developer 4Y demands in order to form an excellent image. In other words, when an image is formed while the toner amount within the developer is smaller than the value Tmin, a serious deterioration of an image quality such as an insufficient image density and a blur becomes likely. Noting this, the toner end is acknowledged when the toner remaining amount Tr becomes smaller than the minimum toner amount Tmin as described above, whereby the timing of exchanging the developer 4Y is accurately grasped.

An operation of the main controller 11 upon notification of the toner end from the engine controller 12 may be determined freely. For instance, a toner end message for a user may appear on a display which is not shown in the drawing, to thereby encourage the user to exchange the developer. At this stage, continuation of the image forming operation may be allowed, or alternatively, the image forming operation may be prohibited. Further alternatively, when the toner-end developer is other than the black developer 4K, a monochrome image alone may be formed using black toner continuously at this stage.

By the way, this image forming apparatus is capable of executing more than one operation as a non-ordinary mode operation which is not the ordinary image forming operation described above. A toner consumption amount upon execution of each such operation is calculated in advance and stored in the memory 127 as a test pattern offset value Totn (where n is 1, 2 and 3 in this embodiment) or a steady offset value Tn (where n is 1, 2, 3 and 4 in this embodiment) as described later in detail. These operations will now be described.

(Image Forming Condition Adjusting Operation)

Figure 6:
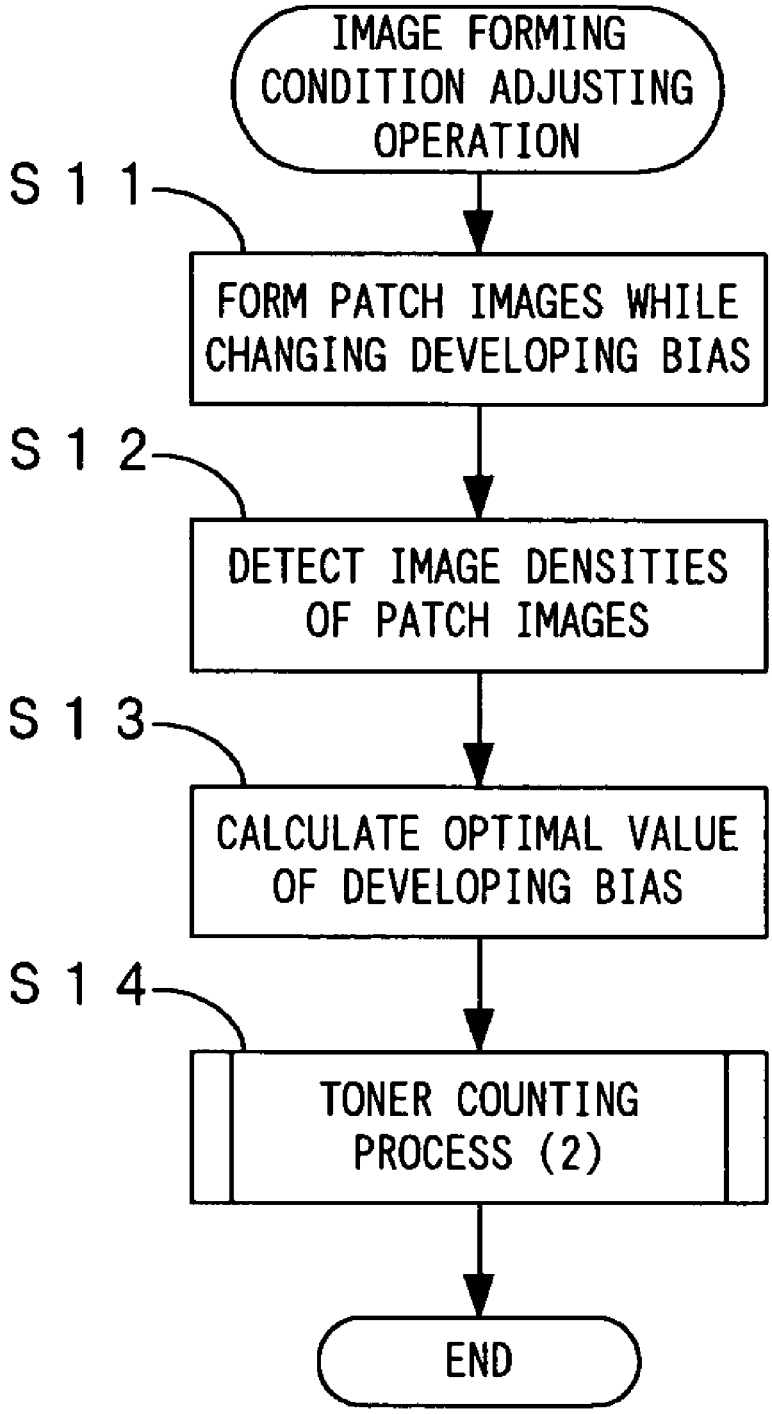
FIG. 6 is a flowchart which shows an image forming condition adjusting operation.

FIG. 6 is a flow chart which shows the image forming condition adjusting operation. The image forming condition adjusting operation aims at control of an image density to a target density by adjusting an image forming condition at predetermined timing such as immediately after turning on of the apparatus, when a predetermined number of images have been formed, or the like. During the image forming condition adjusting operation, patch images having a predetermined pattern are formed while changing the developing bias, which serves as a density controlling factor influencing an image density, over multiple levels (Step S11). Next, at the timing that the patch images which have been transferred onto the intermediate transfer belt 71 arrive at an opposed position facing the patch sensor PS, the patch sensor PS detects the image densities of the patch images (Step S12), and a relationship between the image densities and the developing bias is calculated. The value of the developing bias which makes the image densities coincide with the target density is calculated based on thus identified relationship, and the value calculated in this manner is used as an optimal value of the developing bias (Step S13).

Upon calculation of the optimal value of the developing bias, images will then be formed while setting the developing bias to this optimal value. The images are consequently formed at the target image density. A number of techniques have been proposed as such a density controlling technique. Any desired technique such as these known techniques can be applied to the image forming condition adjusting operation according to this embodiment. Hence, density controlling techniques will not be described in detail.

A plurality of patch images are formed during the image forming condition adjusting operation as described above. Each patch image may be large enough just to the extent allowing detection of the density of the patch image by the patch sensor PS (a few centimeters times a few centimeters, for example). The pattern of each patch image may be relatively simple, such as a solid image and an image in which dots are-arranged orderly. Hence, supplying of an image signal representing such patch images from the main controller 11 is not necessary, and the pattern of the patch images may be formed independently within the engine controller 12. In this embodiment, the pattern generating module 125 (FIG. 2) disposed in the engine controller 12 serves to generate a pattern which serves as a patch image. That is, during the image forming condition adjusting operation, the CPU 124 outputs a control command to the pattern generating module 125 so as to output an image signal corresponding to a patch image, and controls the image signal switcher 122 so that an output from the pattern generating module 125 will be fed to the exposure power controller 123. In consequence, an electrostatic latent image corresponding to the patch image pattern is formed on the photosensitive member 2.

The image forming condition adjusting operation also aims at adjustment of an operating condition of the engine EG so as to obtain a desired image density, and as such, can be executed independently of the operation of the main controller 11. Therefore, with the patch image pattern generated within the engine controller 12, the main controller 11 does not need to be involved in this operation. This improves the processing efficiency of the main controller 11, since the main controller 11 is able to carry out the processing for forming the next image for instance while the engine controller 12 performs its operation.

Execution of the image forming condition adjusting operation also leads to a consumption of toner which is held within the developer. It is not possible to calculate the toner consumption amount at this stage based on an image signal from the main controller 11. In this embodiment therefore, as shown in FIG. 6, after optimization of the developing bias, in order to calculate the amount of toner consumed during the image forming condition adjusting operation, a toner counting process (2) which is different from the toner counting process (1) described earlier is executed (Step S14).

During the image forming condition adjusting operation, since the pattern of a patch image to be formed is already known, it is possible to estimate the amount of toner which will adhere on the photosensitive member 2 as a patch image. Therefore, this toner amount is calculated in advance through an experiment and stored as a test pattern offset value Tot1 in the memory 127. During the toner counting process (2), the offset value Tot1 is subtracted from the immediately precedent toner remaining amount every time a patch image is formed, and the amount of toner remaining in the developer is calculated. This is a major difference from the toner counting process (1) during which a print dot count is calculated from an image signal. The specific sequence of the toner counting process (2) will be described later while referring to FIG. 7.

(Test Pattern Forming Operation)

Further, as an operation under the non-ordinary mode described above, this apparatus executes an operation of forming on a sheet S a toner image which will serve as a test pattern which a user uses to visually confirm an image quality. This test pattern is also outputted from the pattern generating module 125. Hence, the toner consumption amount at the time of execution of this operation is calculated as a test pattern offset value Tot2 which corresponds to this test pattern and stored in the memory 127 in advance, and through execution of the toner counting process (2) shown in FIG. 7 which will be described later, the toner remaining amount Tr at the end of this operation is calculated.

(Refreshing Operation)

This apparatus also executes a refreshing operation, as an operation under the non-ordinary mode described above. The developers 4K, 4C, 4M and 4Y have such a structure that toner holders disposed inside the developers supply toner to the developer rollers 40K, 40C, 40M and 40Y and restricting blades make the thickness of toner layers formed on the developer rollers 40K, 40C, 40M and 40Y constant. In FIG. 1, for the convenience of illustration, only the restricting blade 43M for the developer 4M is denoted at a reference symbol. When images having a low image occupation ratio (which is a ratio of print dot count to a total pixel count of a toner image) are formed continuously, filming becomes likely which is a phenomenon that toner staying at the same positions within the developers 4K, 4C, 4M and 4Y increases and an external additive contained in the toner or the toner itself gets fixed on the surfaces of the developer rollers, the restricting blades and the like.

To deal with this phenomenon, this apparatus executes the refreshing operation, i.e., an operation that at predetermined timing (which may be for instance prior to execution of the image forming condition adjusting operation), an image having a pattern which has been determined in advance is formed on the photosensitive member 2 and the developers 4K, 4C, 4M and 4Y accordingly recover from fatigued states. The forced consumption of the toner owing to the refreshing operation eliminates the toner stagnating inside the developers 4K, 4C, 4M and 4Y, and hence, prevents a filming-induced deterioration of an image quality.

It is preferable that an image pattern which is formed during the refreshing operation is equal to a maximum image range over which it is possible to form an image along a main scanning direction (which is the direction of a rotation axis of the photosensitive member 2) on the photosensitive member 2, that the image occupation ratio is relatively large and that print dots are distributed approximately uniformly along the main scanning direction.

The image pattern formed on the photosensitive member 2 for the refreshing operation is also outputted from the pattern generating module 125. Hence, the toner consumption amount at the time of execution of this operation is calculated as a test pattern offset value Tot3 which corresponds to this test pattern and stored in the memory 127 in advance, and through execution of the toner counting process (2) shown in FIG. 7 which will now be described, the toner remaining amount Tr at the end of this operation is calculated.

Figure 7:
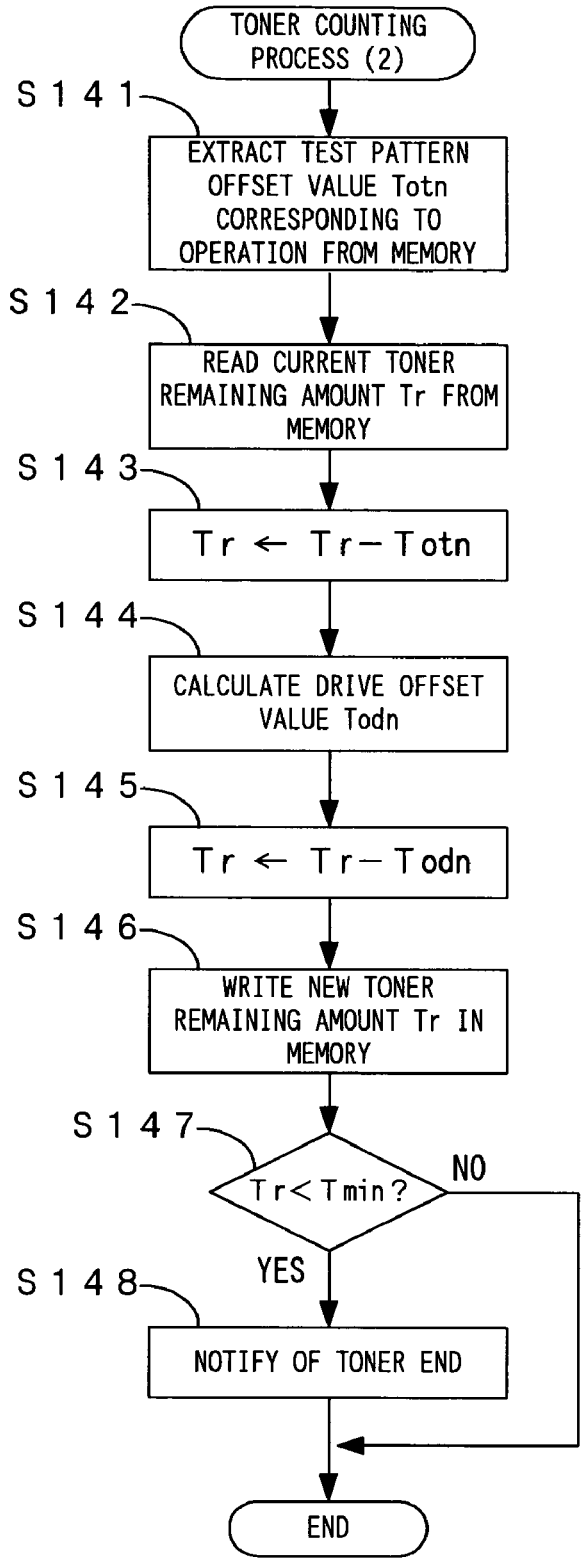
FIG. 7 is a flow chart which shows a toner counting process (2)

FIG. 7 is a flow chart which shows the toner counting process (2). During the toner counting process (2), first, the test pattern offset value Totn which corresponds to the operation is extracted from the memory 127 (Step S141). In short, the test pattern offset value Tot1 is extracted when the current operation is the image forming condition adjusting operation, the test pattern offset value Tot2 is extracted when the current operation is the test pattern forming operation, but the test pattern offset value Tot3 is extracted when the current operation is the refreshing operation. In this manner, during the toner counting process (2), the amount of toner adhering on the photosensitive member 2 as a toner image is not calculated but given merely as an offset value which corresponds to the image pattern.

Once the amount of the toner adhering on the photosensitive member 2 as the toner image has become thus known, the same operation as the toner counting process (1) shown in FIG. 5 will be performed. Namely, the current toner remaining amount Tr is read out from the memory 127, the offset value Totn and the drive offset value Todn are subtracted from this toner remaining amount Tr, and a toner remaining amount Tr of toner remaining in the developer 4Y after execution of the operation is calculated (Step S142 to Step S146). When the value Tr is smaller than the minimum toner amount Tmin, the toner end is acknowledged (Step S147, Step S148). In the manner above, the toner remaining amount Tr of toner remaining in the developer 4Y after execution of the image forming condition adjusting operation, the test pattern forming operation or the refreshing operation is calculated.

Since the fixed image patterns are to be formed during the image forming condition adjusting operation, the test pattern forming operation and the refreshing operation, the drive offset values Todn are also considered to be constant. Hence, offset values Ton which are (Totn+Todn) obtained by adding the test pattern offset values Totn to the drive offset values Todn may be stored in the memory 127 as values for the respective patterns. During the toner counting process (2), the offset value Ton corresponding to the pattern which has been formed may be extracted from the memory 127 and used to calculate the toner remaining amount.

(Toner Covering Operation)

This apparatus also executes a toner covering operation, as an operation under the non-ordinary mode described above. The cleaning blade 51 (FIG. 1) is made of hard rubber or the like in general, and has a relatively high frictional resistance. For this reason, when a user starts using the cleaning blade as it still is brand new, the blade could curl up owing to frictions against the rotating photosensitive member 2. Noting this, the toner covering operation is executed so that toner adhering to the cleaning blade 51 will reduce the frictional resistance. The toner covering operation is executed when the apparatus is brand new, upon exchanging of the cleaning blade 51, etc.

Figure 8:
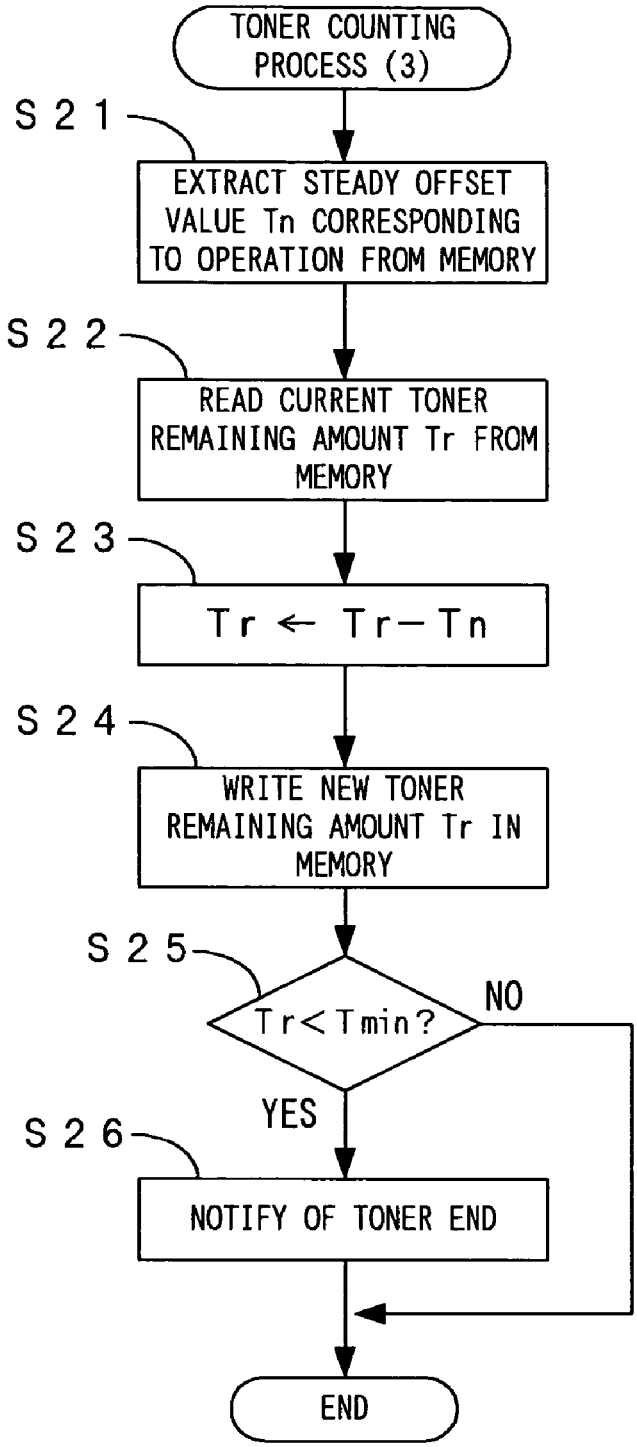
FIG. 8 is a flow chart which shows a toner counting process (3)

During the toner covering operation, the rotary developer unit 4 supplies toner onto the surface of the photosensitive member 2 which has been charged by the charger unit 3. In short, no electrostatic latent image is formed on the photosensitive member 2. Therefore, the toner consumption amount at the time of execution of this operation is calculated in advance as a steady offset value T1 through an experiment and stored in the memory 127. Toner counting during the toner covering operation is realized in accordance with toner counting process (3) which is shown in FIG. 8 which will be described later.

(Preliminary Covering Operation)

This apparatus also executes a preliminary covering operation which is similar to the toner covering operation described above as an operation under the non-ordinary mode, prior to execution of the ordinary image forming operation described earlier. The preliminary covering operation is an operation of making a very small amount of toner adhere to the surface of the photosensitive member 2 for the purpose of preventing frictions between the photosensitive member 2 and the cleaning blade 51 (FIG. 1). The toner consumption amount at the time of execution of this operation is calculated in advance as a steady offset value T2 and stored in the memory 127. Toner counting during the preliminary covering operation, too, is realized in accordance with toner counting process (3) which is shown in FIG. 8 which will be described later. While toner of only one color may be used during the preliminary covering operation, the yellow color is preferred as this color is unnoticeable and will not smirch an image which is to be formed later. Further, in an attempt to rotate the rotary developer unit 4 less for exchanging of the developer, it is desirable that this color is the first toner color (first color) to be used first in the ordinary image forming operation. For these reasons, it is rational to use the yellow color as the first color when an image is to be formed in the ordinary manner.

(Idling Operation)

This apparatus also executes an idling operation under the non-ordinary mode described above. While an image is being formed, the toner holders disposed inside the developers 4K, 4C, 4M and 4Y supply toner to the developer rollers 40K, 40C, 40M and 40Y, the developer rollers 40K, 40C, 40M and 40Y supply toner to the photosensitive member 2, electrostatic latent images are visualized, and toner images are formed. At this stage, if toner is held uneven within the developers 4K, 4C, 4M and 4Y or deteriorated owing to insufficient charging, toner fails to be supplied to the photosensitive member 2 in a desirable manner or toner images fail to be formed in a preferable manner, which leads to a deterioration of an image quality. Noting this, this apparatus executes an idling operation of the developers 4K, 4C, 4M and 4Y and of the developer rollers 40K, 40C, 40M and 40Y at predetermined timing (e.g., for every predetermined driving time of the developers, or every time a predetermined number of images are printed), to thereby agitate housed toner and hence prevent unevenness and deterioration of the toner. In this embodiment, the developers 4K, 4C, 4M and 4Y and the developer rollers 40K, 40C, 40M and 40Y thus correspond to "toner supplying means" of the present invention.

The idling operation of the developers 4K, 4C, 4M and 4Y and of the developer rollers 40K, 40C, 40M and 40Y inevitably causes leakage of toner out of the developers 4K, 4C, 4M and 4Y, although in a very small amount corresponding to the idling rotation time. The toner consumption amount at the time of the idling operation of the developers 4K, 4C, 4M and 4Y is calculated in advance as a steady offset value T3 and the toner consumption amount at the time of the idling operation of the developer rollers 40K, 40C, 40M and 40Y is calculated in advance as a steady offset value T4 through an experiment, and these values are stored in the memory 127. Toner counting during the idling operation is realized in accordance with toner counting process (3) which is shown in FIG. 8 and will now be described.

FIG. 8 is a flow chart which shows the toner counting process (3). During the toner counting process (3), a steady offset value Tn which corresponds to the operation is extracted from the memory 127, the extracted steady offset value Tn is subtracted from the immediately precedent toner remaining amount, the amount of toner remaining in the developer is calculated. That is, during the toner counting process (3), first, the steady offset value Tn which corresponds to the operation is extracted from the memory 127 (Step S21). In other words, the offset value T1 is extracted during the toner covering operation, the offset value T2 is extracted during the preliminary covering operation, the offset value T3 is extracted during the idling operation of the developers 4K, 4C, 4M and 4Y, and the offset value T4 is extracted during the idling operation of the developer rollers 40K, 40C, 40M and 40Y Except for the absence of the drive offset values, the subsequent steps are the same as the toner counting process (2) shown in FIG. 7. To be more specific, the current toner remaining amount Tr is read out from the memory 127, the extracted steady offset value Tn described above is subtracted from this value, and the toner remaining amount Tr of toner remaining in the developer 4Y after execution of each operation is calculated (Step S22 to Step S24). The toner end is acknowledged when the value Tr is smaller than the minimum toner amount Tmin (Step S25, Step S26). In the manner above, the toner remaining amount Tr of toner remaining in the developer 4Y after execution of the toner covering operation, the preliminary' covering operation or the idling operation are calculated.

In this embodiment, memory 127 thus corresponds to "storage means" of the present invention. The sum (Totn+Todn) of the test pattern offset value Totn and the drive offset value Todn is the amount of toner which is consumed each by the image forming condition adjusting operation, the test pattern forming operation and the refreshing operation, and corresponds to a "second toner amount" of the present invention. The steady offset values T1, T2, T3 and T4 are the amounts of toner which is consumed during the toner covering operation, the preliminary covering operation, the idling operation of the developers and the idling operation of the developer rollers, and correspond to the "second toner amount" of the present invention. The value calculated by integrating these toner amounts corresponds to a "second integrating value" of the present invention. A difference (Tr0−Tr) between an initial value Tr0 of the toner remaining amount Tr (i.e., the amount of toner filled inside the developer at the time of shipment) and the current toner remaining amount Tr is the amount of toner consumed so far, and corresponds to "the total of the first integrating value and the second integrating value" of the present invention.

As described above, in this embodiment, when the ordinary image forming operation based on an image signal from the main controller 11 is carried out, the number of print dots is counted based on the image signal, the count is integrated by a predetermined coefficient, and the toner consumption amount is calculated (the toner counting process (1); FIG. 5). On the other hand, when an operation under the non-ordinary mode which is different from the ordinary image forming operation is executed, the offset value obtained in advance as the toner consumption amount commanded by the operation is used as the toner consumption amount upon execution of the operation (the toner counting process (2); FIG. 7, the toner counting process (3); FIG. 8). This permits to calculate the toner consumption amount by the appropriate method which corresponds to the executed operation and accurately identify the toner consumption amount in each developer. In addition, since the toner consumption amount under each operation mode can be found only by a calculation, the processing is simple.

Since the offset values corresponding to the plurality of operations under the non-ordinary mode are stored in the memory 127 and the offset value corresponding to the executed operation is extracted from the memory 127, it is possible to accurately calculate the toner consumption amount during each operation in a simple fashion.

As the toner consumption amount thus calculated for each operation is subtracted from the immediately precedent toner remaining amount every time each operation is executed, the toner remaining amount within each developer at the time of each operation is grasped.

By the way, it is desirable that the nature of toner used in such an image forming apparatus remains constant in order to stably form a toner image. However, it is known that in an actual apparatus, the image density of a toner image sometimes gradually changes as toner images are formed repeatedly. The nature of toner is thus not always constant but may change with time in some cases.

Figure 9A:
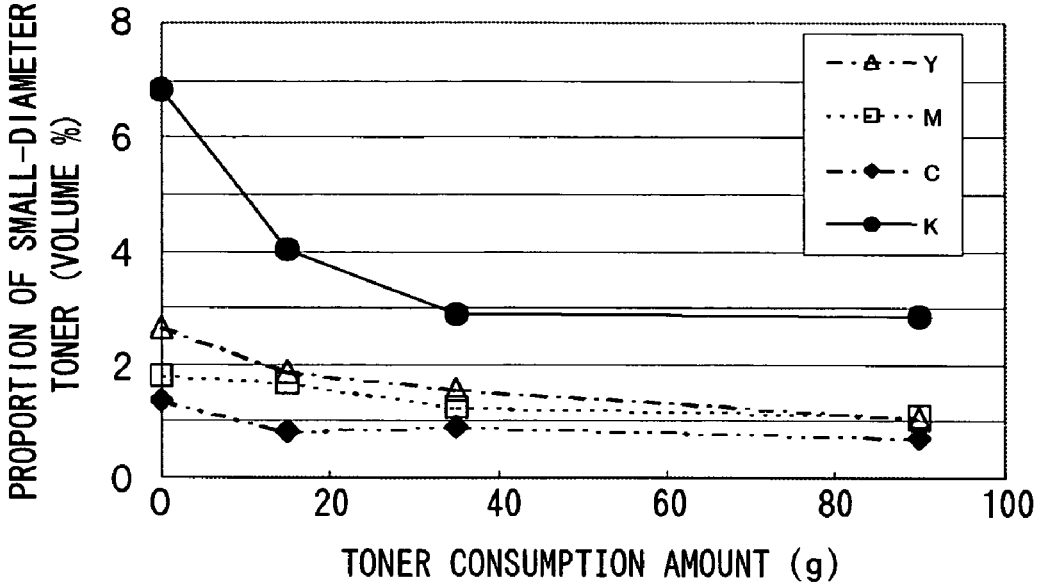
FIGS. 9A and 9B are drawings which show an example of changes of a toner particle diameter distribution.
Figure 9B:
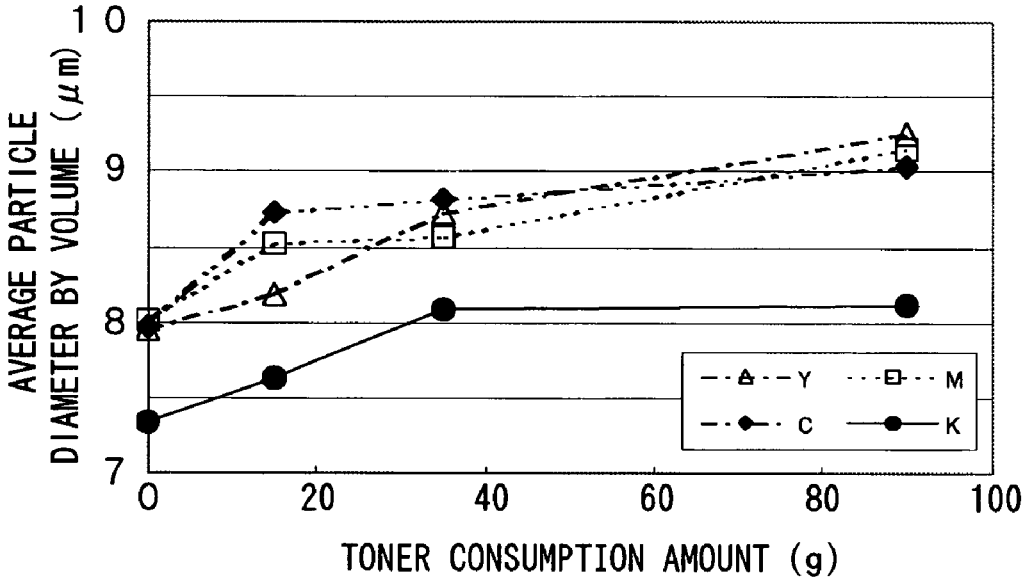

FIGS. 9A and 9B are drawings which show an example of changes of a toner particle diameter distribution. Toner which is used in this type of image forming apparatus contains toner particles having various different particle diameters, and therefore, a particle diameter distribution spreads in a certain manner. A phenomenon called "selective development," i.e., a phenomenon that the probability of consumption becomes different owing to a difference in toner particle diameter, is known to occur as an image is formed using toner having such a particle diameter distribution.

This phenomenon has been confirmed also through experiments. FIG. 9A shows an example of actual measurement to identify how a proportion (volume %) of toner having small particle diameters of 5 $\mu$m or less to all toner within a developer changes as images are formed repeatedly. FIG. 9B shows changes of the average particle diameter by volume of toner which remains within the developer. As shown in FIG. 9A, as images are formed over a long period of time and the toner consumption amount increases, the proportion of toner having small particle diameters decreases gradually, and in accordance with this, the average particle diameter by volume shown in FIG. 9B increases gradually. From this, it is seen that as images are formed, a uniform consumption of toner having various different particle diameters does not occur but a consumption of the toner having small particle diameters occurs first. As images are formed repeatedly and the toner consumption amount accordingly increases, the extent of the unevenness of the toner particle diameters within the developer, namely, the particle diameter distribution of the toner changes gradually.

Further, while image forming conditions which are influential in an image quality are adjusted as described earlier to thereby control an image density in this type of image forming apparatus, the offset values may change when the image forming conditions are changed.

Due to this, in the event that the offset values Todn, Totn and Tn have been fixed in advance, the toner consumption amount obtained by a calculation could become different from the actual amount and it therefore could become difficult to replenish toner at proper timing in some cases. A technique is hence desired which makes it possible to more accurately calculate the toner consumption amount regardless of changes of the offset values with time.

To solve this problem and further improve the accuracy of calculating the toner consumption amount, the CPU 124 may appropriately change the offset values in accordance with a change with time of the nature of the toner, the image forming conditions, etc. To be more specific, it is possible to calculate the toner consumption amount at a high accuracy by (1) changing the offset values in accordance with the operating state of the apparatus, by (2) changing the offset values in accordance with the history of use of the toner, or by (3) changing the offset values in accordance with the image forming conditions for forming toner images. In short, although the nature of the toner changes with time as described above, the changes can be calculated by studying the operating state of the apparatus, the history of use of the toner, etc. Hence, when changes of the nature of the toner with time are correlated with the operating state of the apparatus, the history of use of the toner and the like and the offset values are changed appropriately, it is possible to accurately calculate the toner consumption amount. In addition, since the offset values are changed also when the image forming conditions are changed, it is always possible to set suitable offset values in accordance with the image forming conditions, and hence, accurately calculate the toner consumption amount. In this embodiment, the CPU 124 thus corresponds to "offset value setting means" of the present invention.

The present invention is not limited to the preferred embodiments above, but may be modified in various manners in addition to the preferred embodiments above, to the extent not deviating from the object of the invention.

For instance, although the first preferred embodiment described above requires that the CPU 124 of the engine controller 12 calculates the toner consumption amount based on counts registered by the dot counter 200 which is disposed to the main controller 11 and the offset value which corresponds to each operation under the non-ordinary mode, this is not limiting. The CPU 111 of the main controller 11 may calculate the toner consumption amount after receiving the offset value from the engine controller 12, or alternatively, the dot counter 200 may be disposed to the engine controller 12 for example.

In addition, although the first preferred embodiment described above requires to calculate the toner remaining amount every time one image is formed during the ordinary image forming operation, the timing of calculating the toner remaining amount is not limited to this but may be freely determined. For example, upon reception of an image forming request which demands a plurality of images to be formed, the toner: remaining amount may be calculated after all these images are formed or every time a predetermined number of images are formed.

<Second Preferred Embodiment>

Figure 10:
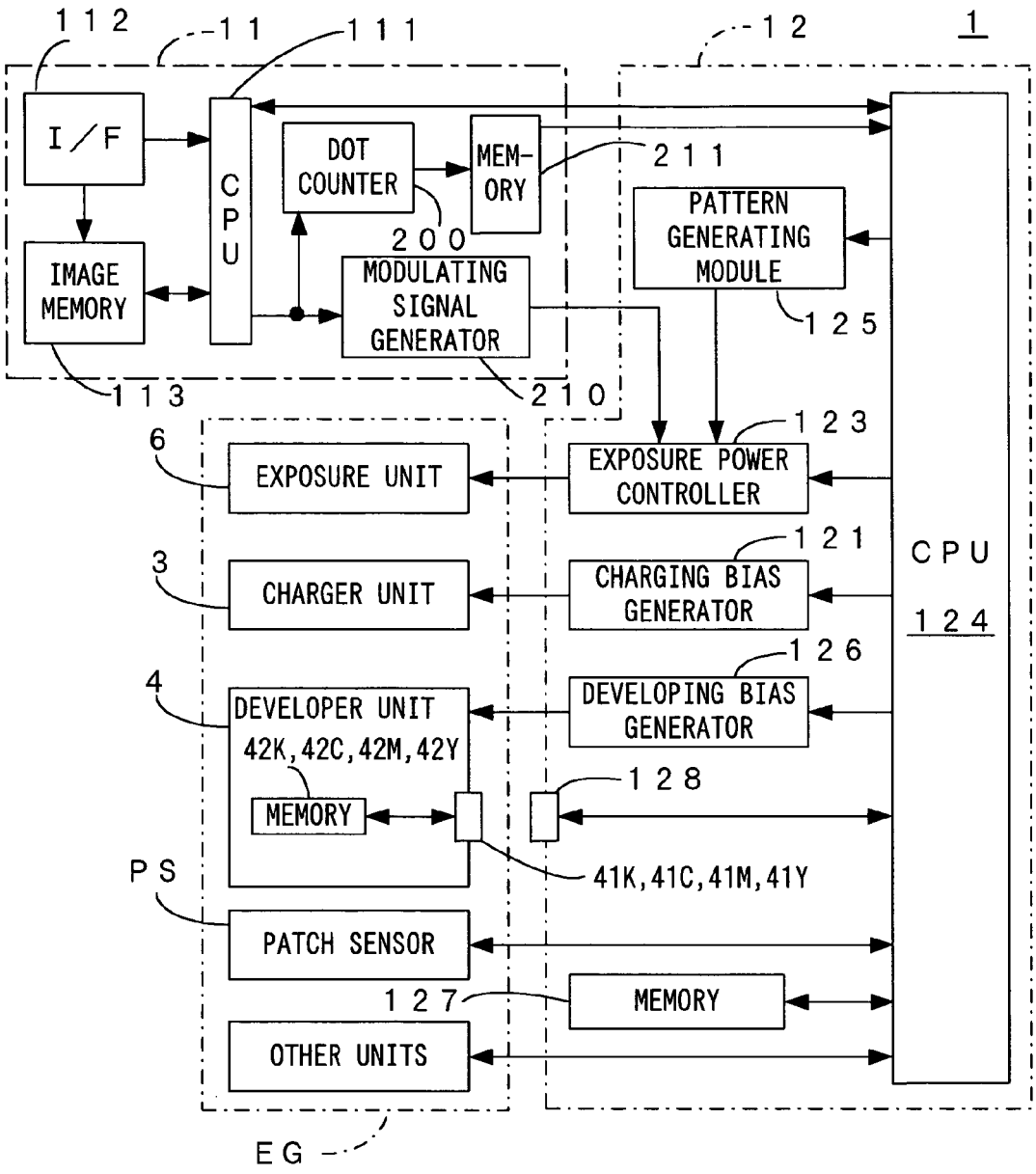
FIG. 10 is a block diagram which shows an electric structure of an image forming apparatus according to a second preferred embodiment.

FIG. 10 is a block diagram which shows an electric structure of an image forming apparatus according to a second preferred embodiment. In FIG. 10, the portions having the same functions as those used in the first preferred embodiment are denoted at the same reference symbols. Further, an internal structure of the image forming apparatus according to the second preferred embodiment is the same as that according to the first preferred embodiment shown in FIG. 1, and therefore, will not be described.

The second preferred embodiment, as shown in FIG. 10, does not use the image signal switcher 122 used in the first preferred embodiment (FIG. 2). The exposure power controller 123 has the same function as the exposure power controller 123 according to the first preferred embodiment except for that this exposure power controller 123 is capable of directly receiving a signal from the pattern generating module 125 and a signal from the modulating signal generator 210. The structure and the counting sequence of the dot counter 200 shown in FIG. 10 are the same as those according to the first preferred embodiment described earlier with reference to FIGS. 3 and 4, and therefore, will not be described.

In this image forming apparatus, as a print command and image data are fed to the main controller 11 of the control unit 1 from an external apparatus such as a host computer, the main controller 11 outputs control commands to the respective portions of the apparatus, and based on the image data thus supplied, an image signal expressing an image to be formed in each toner color as a multi-gradation print dot string is generated and outputted to the engine controller 12. In accordance with a command from the main controller 11, the engine controller 12 controls respective portions of the engine EG, and an image corresponding to the image signal is formed on a sheet S.

For instance, after the CPU 111 has generated print dot data based on the image data supplied via the interface 112 from an external apparatus such as a host computer, when the modulating signal generator 210 modulates the print dot data and the modulating signal is fed to the exposure power controller 123, the exposure power controller 123 controls the respective portions of the exposure unit 6, the light beam L based on the modulating signal exposes the photosensitive member 2, and an electrostatic latent image corresponding to the image data is formed on the photosensitive member 2.

Meanwhile, as described later, when the image forming operation for forming a predetermined image pattern is executed, the pattern generating module 125 feeds the exposure power controller 123 with a modulating signal corresponding to the image pattern, the exposure power controller 123 controls the respective portions of the exposure unit 6 in the manner described above, and an electrostatic latent image corresponding to the image pattern is formed. As a modulation method for the modulating signal generator 210, various pulse modulation such as pulse width modulation (PWM) and pulse amplitude modulation (PAM) can be used.

There is the patch sensor PS disposed facing against the surface of the intermediate transfer belt 71. For execution of an image forming condition adjusting operation which will be described later, the patch sensor PS measures optically image densities of patch images which are formed on the outer circumferential surface of the intermediate transfer belt 71.

In this embodiment, the photosensitive member 2 corresponds to an "image carrier" of the present invention, the exposure unit 6 corresponds to "exposure means" of the present invention, the rotary developer unit 4 corresponds to "developer means" of the present invention, and the exposure unit 6 and the rotary developer unit 4 correspond to "image forming means" of the present invention.

Figure 11:
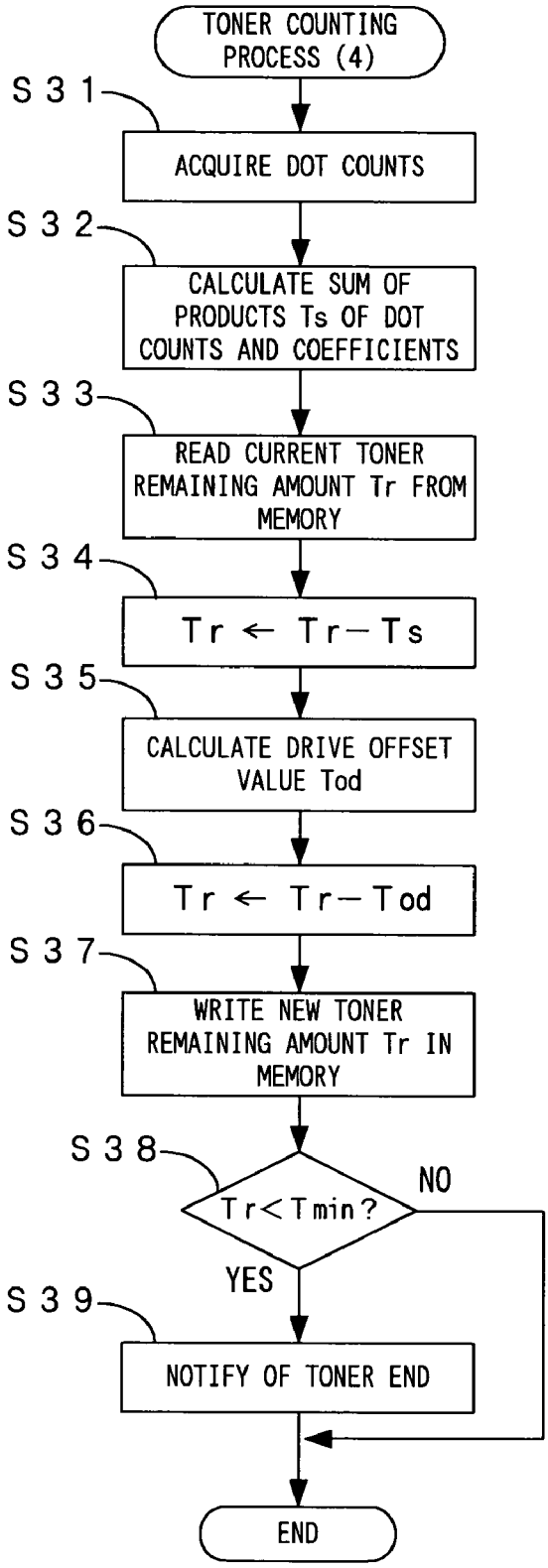
FIG. 11 is a flow chart which shows a toner counting process (4)

FIG. 11 is a flow chart which shows a toner counting process (4) at the time of execution of the ordinary image forming operation. In this image forming apparatus, for the convenience of management of consumables, the CPU 124 of the engine controller 12 executes the toner counting process (4) shown in FIG. 11 every time one image is formed, and calculates the amounts of the toner remaining in the developers 4Y, . . . for the respective toner colors. While a method of calculating the amount of the toner remaining in the developer 4Y will now be described in relation to the yellow color, the operation is the same also for the other toner colors.

Steps S31 to S39 of the toner counting process (4) shown in FIG. 11 are the same as the toner counting process (1) described earlier with reference to FIG. 5, and therefore, will not be described.

A toner consumption amount per image is subtracted from the amount of toner initially held in each developer to thereby calculate the amount of toner remaining in the developer upon forming of each image in the second preferred embodiment, which of course is theoretically equivalent to calculation of the total toner consumption amount by means of integration of a toner consumption amount per image. Thus, in this preferred embodiment, the CPU 111, the interface 112 and the modulating signal generator 210 correspond to "first controlling means" of the present invention, the CPU 124 corresponds to "detecting means" of the present invention, and the toner counting process (4) corresponds to a "first toner amount detecting process" of the present invention. Further, a route from the modulating signal generator 210 leading to the exposure unit 6 via the exposure power controller 123 corresponds to a "first route" of the present invention.

In the developers 4Y, . . . which can be attached to and detached from the apparatus body, it is preferable that before each developer is detached from the apparatus body, the toner remaining amounts Tr in the respective developers calculated in the manner described above are stored in the memories 42Y, . . . With the respective developers attached to the apparatus body, the toner remaining amounts of the respective developers stored in the memories 42Y, . . . are read out and used as initial toner remaining amount values Tr during the toner counting process (4) described above, thereby easily managing the lifetime of each developer. Of course, in the case of anew developer, the amount of toner filled inside the developer at the time of shipment may be stored.

By the way, this image forming apparatus is capable of executing a few operations as an operation of forming a predetermined image pattern, in addition to the ordinary image forming operation for forming an image which corresponds to image data fed from outside described earlier. The amount of toner consumed during each operation is calculated in advance and stored in the memory 127 as a test pattern offset value Totm (where m is 11, 12, 13 and 14 in this embodiment) as described later. These operations will now be described in turn.

(Image Forming Condition Adjusting Operation)

Figure 12:
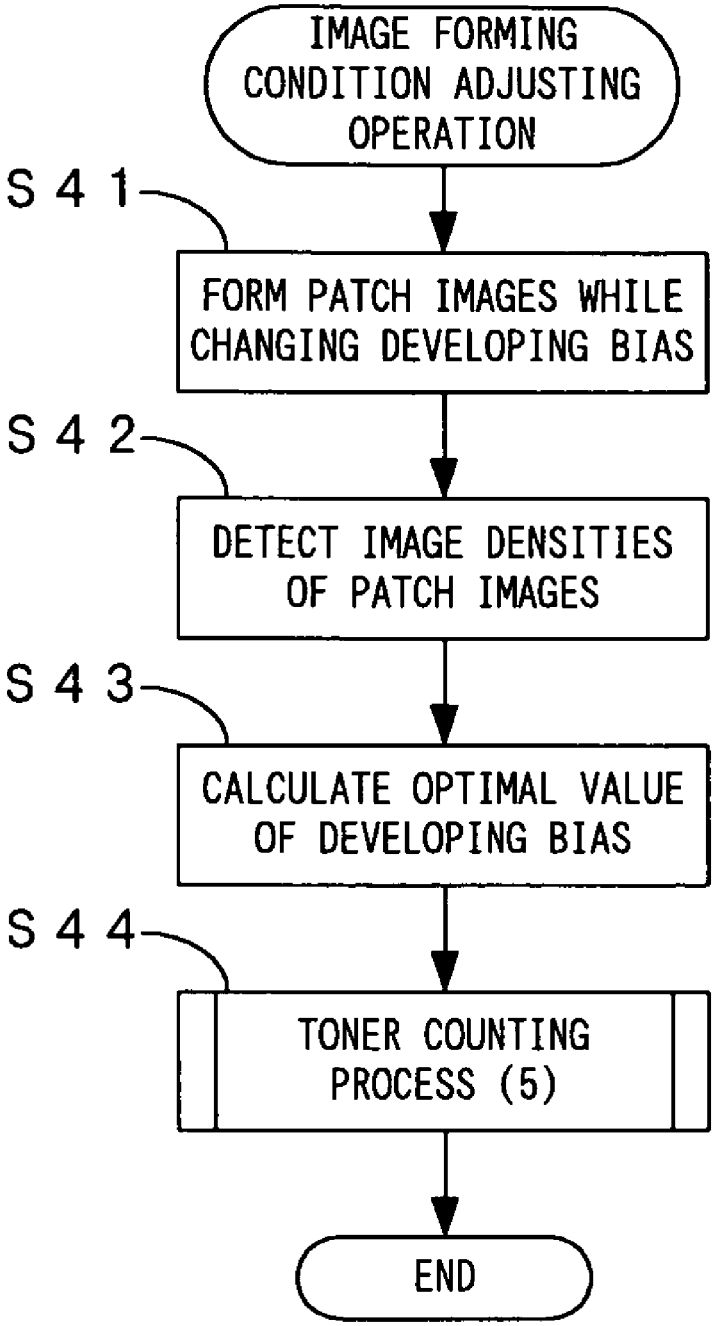
FIG. 12 is a flow chart which shows an image forming condition adjusting operation in the second preferred embodiment.

FIG. 12 is a flow chart which shows an image forming condition adjusting operation. The image forming condition adjusting operation aims at control of an image density to a target density by adjusting an image forming condition at predetermined timing such as immediately after turning on of the apparatus, when a predetermined number of images have been formed, or the like. During this image forming condition adjusting operation, patch images having a predetermined pattern are formed while changing the developing bias, which serves as a density controlling factor influencing an image density, over multiple levels (Step S41). Next, at the timing that patch images which have been transferred onto the intermediate transfer belt 71 arrive at an opposed position facing the patch sensor PS, the patch sensor PS detects the image densities of the patch images (Step S42), and a relationship between the image densities and the developing bias is calculated. The value of the developing bias which makes the image densities coincide with the target density is calculated based on thus identified relationship, and the value calculated in this manner is used as an optimal value of the developing bias (Step S43).

Once the optimal value of the developing bias has been thus calculated, images will then be formed while setting the developing bias to this optimal value. The images are consequently formed at the target image density. A number of techniques have been proposed as such a density controlling technique. Any desired technique such as these known techniques can be applied to the image forming condition adjusting operation according to this embodiment. Hence, density controlling techniques will not be described in detail.

A plurality of patch images are formed during the image forming condition adjusting operation as described above. Each patch image may be large enough just to the extent allowing detection of the density of the patch image by the patch sensor PS (a few centimeters times a few centimeters, for example). The pattern of each patch image may be relatively simple, such as a solid image and an image in which dots are arranged orderly. Hence, supplying of an image signal regarding such patch images from the main controller 11 is not necessary, and the pattern of the patch images may be formed independently within the engine controller 12. In this embodiment, the pattern generating module 125 (FIG. 10) disposed in the engine controller 12 serves to generate a pattern which will be used as a patch image. That is, during the image forming condition adjusting operation, the CPU 124 outputs a control command to the pattern generating module 125 so as to output an image signal corresponding to patch images. In consequence, an output from the pattern generating module 125 is fed to the exposure power controller 123 and an electrostatic latent image corresponding to the patch image pattern is formed on the photosensitive member 2.

The image forming condition adjusting operation also aims at adjustment of an operating condition of the engine EG so as to obtain a desired image density, and as such, can be executed independently of the operation of the main controller 11. Therefore, with the patch image pattern formed within the engine controller 12, the main controller 11 does not need to be involved in this operation. This improves the processing efficiency of the main controller 11, since the main controller 11 is able to carry out the processing for forming the next image for instance while the engine controller 12 performs its operation.

Execution of the image forming condition adjusting operation also leads to a consumption of toner which is held within the developer. It is not possible to calculate the toner consumption amount at this stage based on an image signal from the main controller 11. In this embodiment therefore, as shown in FIG. 12, after optimization of the developing bias, in order to calculate the amount of toner consumed during the image forming condition adjusting operation, a toner counting process (5) which is different from the toner counting process (4) described earlier is executed (Step S44).

During the image forming condition adjusting operation, since the pattern of a patch image to be formed is already known, it is possible to estimate the amount of toner which will adhere on the photosensitive member 2 as a patch image. Therefore, this toner amount is calculated in advance through an experiment and stored as a test pattern offset value Tot11 in the memory 127. During the toner counting process (5), the offset value Tot11 is subtracted from the immediately precedent toner remaining amount every time a patch image is formed, and the amount of toner remaining in the developer is calculated. This is a major difference from the toner counting process (4) during which a print dot count is calculated from an image signal. The specific sequence of the toner counting process (5) will be described later while referring to FIG. 13.

(Test Pattern Forming Operation)

Further, this apparatus executes an operation of forming on a sheet a toner image which will serve as a test pattern which a user uses to visually confirm an image quality. This test pattern is also outputted from the pattern generating module 125. Hence, the toner consumption amount at the time of execution of this operation is calculated as a test pattern offset value Tot12 which corresponds to this test pattern and stored in the memory 127, and through execution of the toner counting process (5) shown in FIG. 13 which will be described later, the toner remaining amount Tr at the end of this operation is calculated.

(Refreshing Operation)

This apparatus also executes a refreshing operation. The developers 4K, 4C, 4M and 4Y have such a structure that toner holders disposed inside the developers supply toner to the developer rollers 40K, 40C, 40M and 40Y and restricting blades make the thickness of toner layers formed on the developer rollers 40K, 40C, 40M and 40Y constant. As described earlier in relation to the first preferred embodiment, in FIG. 1, for the convenience of illustration, only the restricting blade 43M for the developer 4M is denoted at a reference symbol. When images having a low image occupation ratio (which is a ratio of print dot count to a total pixel count of a toner image) are formed continuously, filming becomes likely which is a phenomenon that toner staying at the same positions within the developers 4K, 4C, 4M and 4Y increases and an external additive contained in the toner or the toner itself gets fixed on the surfaces of the developer rollers, the restricting blades and the like.

To deal with this phenomenon, this apparatus executes the refreshing operation, i.e., an operation that at predetermined timing (which may be for instance prior to execution of the image forming condition adjusting operation), an image having a pattern which has been determined in advance is formed on the photosensitive member 2 and the developers 4K, 4C, 4M and 4Y accordingly recover from fatigued states. The forced consumption of the toner owing to the refreshing operation eliminates the toner stagnating inside the developers 4K, 4C, 4M and 4Y, and hence, prevents a filming-induced deterioration of an image quality.

It is preferable that an image pattern which is formed during the refreshing operation is equal to a maximum image range over which it is possible to form an image along a main scanning direction (which is the direction of a rotation axis of the photosensitive member 2) on the photosensitive member 2, that the image occupation ratio is relatively large and that print dots are distributed approximately uniformly along the main scanning direction.

The image pattern formed on the photosensitive member 2 for the refreshing operation is also outputted from the pattern generating module 125. Hence, the toner consumption amount at the time of execution of this operation is calculated as a test pattern offset value Tot13 which corresponds to this test pattern and stored in the memory 127, and through execution of the toner counting process (5) shown in FIG. 13 which will be described later, the toner remaining amount Tr at the end of this operation is calculated.

(Special Image Forming Operation)

This apparatus also executes a special image forming operation. Over the recent years, capabilities of color image forming apparatuses have improved and there now is a risk that unauthorized use could be made of these improved apparatuses. To prevent such unauthorized printing, a special image which permits to identify the image forming apparatus is printed on top of an image which corresponds to image data fed from outside described earlier. A special image expresses a serial production number of the image forming apparatus or the like using the least noticeable color component (such as yellow) to human eyes among the color components which are used in the image forming apparatus (magenta, cyan, yellow and black in this embodiment). The special image is set in advance. Hence, the amount of toner consumed in forming the special image is also calculated in advance, and stored in the memory 127 as a test pattern offset value Tot14 which corresponds to the special image.

The special image formed on the photosensitive member 2 for the purpose of the special image forming operation, too, is outputted from the pattern generating module 125. Meanwhile, a modulating signal corresponding to image data received from outside is available from the modulating signal generator 210. The exposure power controller 123 superimposes the two one atop the other and sends them to the exposure unit 6. Hence, as for the toner consumption amount at the time of execution of this operation, the toner counting process (5) shown in FIG. 13 which will now be described is executed after execution of the toner counting process (4) shown in FIG. 11 described earlier, whereby the toner remaining amount Tr at the end of this operation is calculated.

Figure 13:
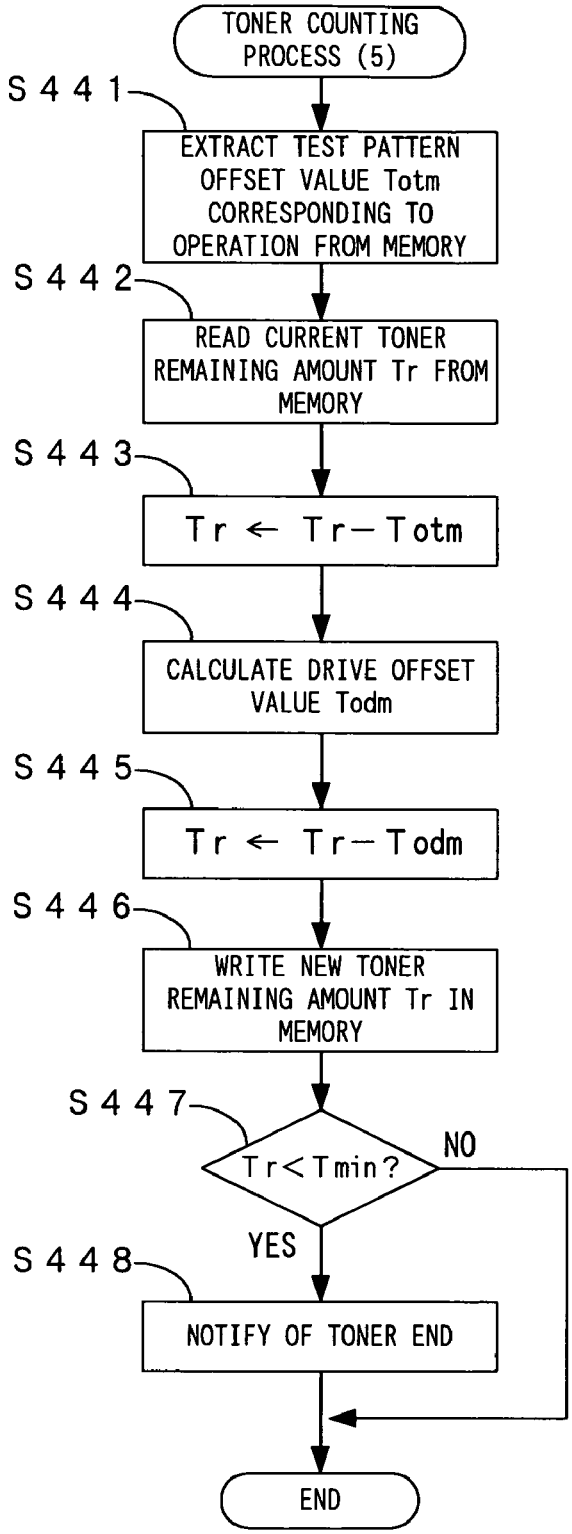
FIG. 13 is a flow chart which shows a toner counting process (5)

FIG. 13 is a flow chart which shows the toner counting process (5). During the toner counting process (5), first, a test pattern offset value Totm corresponding to the operation is extracted from the memory 127 (Step S441). In other words, the test pattern offset value Tot11 is extracted when the current operation is the image forming condition adjusting operation, the test pattern offset value Tot12 is extracted when the current operation is the test pattern forming operation, the test pattern offset value Tot13 is extracted when the current operation is the refreshing operation, but the test pattern offset value Tot14 is extracted when the current operation is the special image forming operation. In this manner, during the toner counting process (5), the amount of toner adhering on the photosensitive member 2 as a toner image is not calculated but given merely as an offset value which corresponds to an image pattern.

Once the amount of the toner adhering on the photosensitive member 2 as the toner image has become thus known, the same operation as the toner counting process (4) shown in FIG. 11 will be performed. In other words, the current toner remaining amount Tr is read out from the memory 127, the offset value Totm and a drive offset value Todm are subtracted from the toner remaining amount Tr, and a toner remaining amount Tr of toner remaining in the developer 4Y after execution of the operation is calculated (Step S442 to Step S446). When this value Tr is smaller than the minimum toner amount Tmin, the toner end is acknowledged (Step S447, Step S448). In the manner above, the toner remaining amount Tr of toner remaining in the developer 4Y after execution of the image forming condition adjusting operation, the test pattern forming operation, the refreshing operation or the special image forming operation are identified.

Since the fixed image patterns are to be formed during the image forming condition adjusting operation, the test pattern forming operation, the refreshing operation and the special image forming operation, the drive offset values Todm are also considered to be constant. Hence, values Tom corresponding to (Totm+Todm) obtained by adding test pattern offset values Totm to the drive offset values Todm may be stored in the memory 127 as the offset values for the respective patterns. In this case, in the toner counting process (5), the offset value Tom corresponding to the pattern may be extracted from the memory 127 and used to calculate the toner remaining amount.

In this embodiment, memory 127 thus corresponds to "storage means" of the present invention. The sum (Totm+Todm) of the test pattern offset value Totm and the drive offset value Todm is the amount of toner which is consumed each by the image forming condition adjusting operation, the test pattern forming operation, the refreshing operation and the special image forming operation. The CPU 124, the pattern generating module 125 and the memory 127 correspond to "second controlling means" of the present invention. The CPU 124 corresponds to the "detecting means" of the present invention, and the toner counting process (5) corresponds to a "second toner amount detecting process" of the present invention. Further, a route from the pattern generating module 125 leading to the exposure unit 6 via the exposure power controller 123 corresponds to a "second route" of the present invention.

As described above, in this embodiment, when the image forming operation based on an image signal fed from the CPU 111 via the modulating signal generator 210 and the exposure power controller 123 is executed, the number of print dots is counted based on the image signal, the count is multiplied by a predetermined coefficient, and the toner consumption amount is calculated (the toner counting process (4); FIG. 11). On the other hand, when the image forming operation based on an image signal fed from the pattern generating module 125 via the exposure power controller 123 is executed, the offset value obtained in advance as the toner consumption a mount commanded by the operation is used as the toner consumption amount upon execution of the operation (the toner counting process (5); FIG. 13). Since the different toner detecting processes are used, it is possible to calculate the toner consumption amount by a method which is suitable to the executed operation, and hence, accurately calculate the toner consumption amount in each developer. Further, since the toner consumption amount under each operation mode is found merely through a calculation, the processing is simple.

Since the offset values corresponding to the plurality of operations to form the predetermined image patterns are stored in the memory 127 and the offset value corresponding to the executed operation is extracted from the memory 127, it is possible to accurately calculate the toner consumption amounts for the various operations in a simple fashion.

As the toner consumption amount thus calculated for each operation is subtracted from the immediately precedent toner remaining amount every time each operation is executed, the toner remaining amount within each developer at the time of each operation is grasped.

The present invention is not limited to the preferred embodiments above, but may be modified in various manners in addition to the preferred embodiments above, to the extent not deviating from the object of the invention.

For instance, although the second preferred embodiment described above requires that the CPU 124 of the engine controller 12 calculates the toner consumption amount based on counts registered by the dot counter 200 which is disposed to the main controller 11 and the offset value which corresponds to the predetermined image pattern forming operation, this is not limiting. The CPU 111 of the main controller 11 may calculate the toner consumption amount after receiving the offset value from the engine controller 12, or alternatively, the dot counter 200 may be disposed to the engine controller 12 for example.

In addition, although the second preferred embodiment described above requires to calculate the toner remaining a mount every time one image is formed during the ordinary image forming operation, the timing of calculating the toner remaining amount is not limited to this but may be freely determined. For example, upon reception of an image forming request which demands a plurality of images to be formed, the toner remaining amount may be calculated after all these images are formed or every time a predetermined number of images are formed.

<Third Preferred Embodiment>

Figure 14:
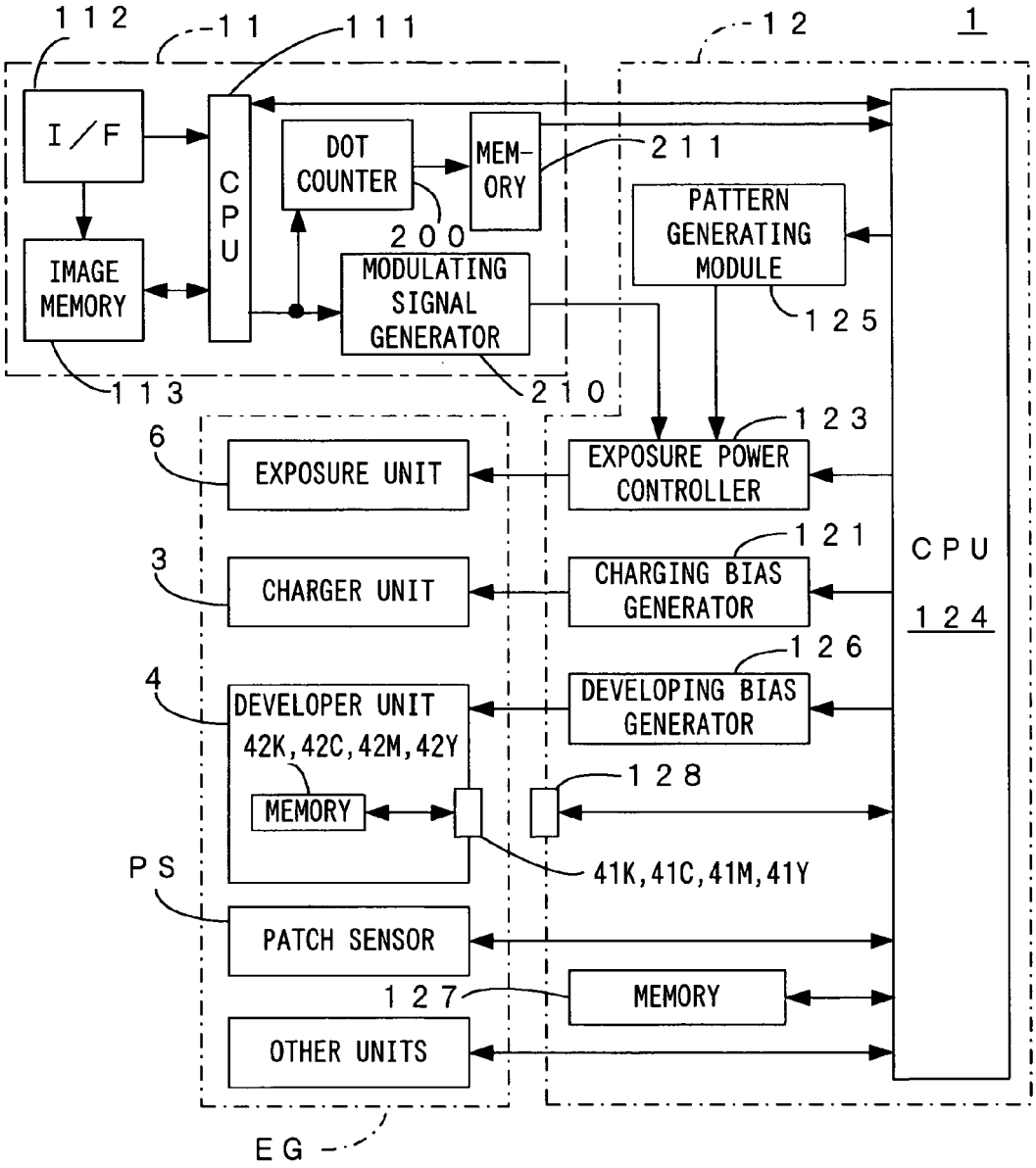
FIG. 14 is a block diagram which shows an electric structure of an image forming apparatus according to a third preferred embodiment.
Figure 15A:
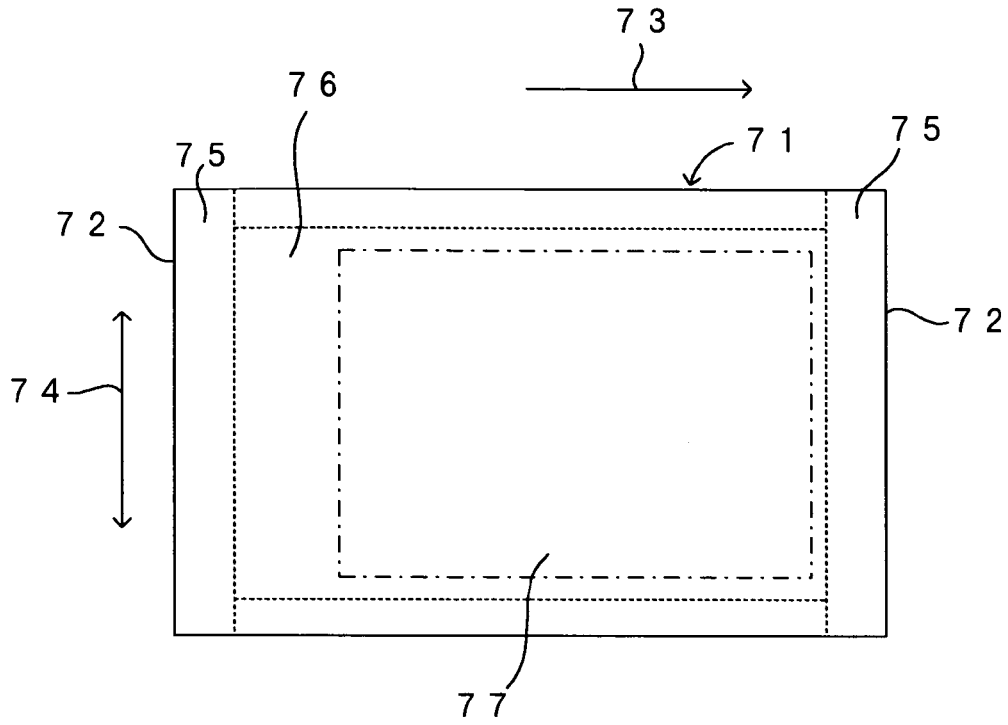
FIGS. 15A and 15B are development views of an intermediate transfer belt.
Figure 15B:
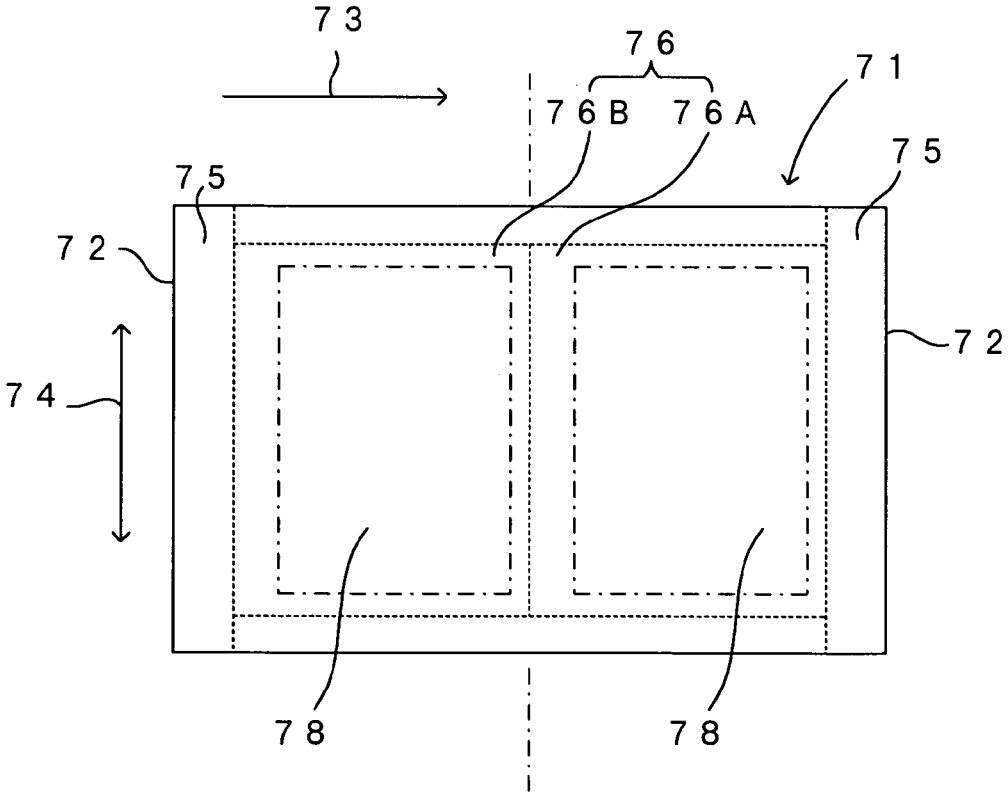

FIG. 14 is a block diagram which shows an electric structure of an image forming apparatus according to a third preferred embodiment, and FIGS. 15A and 15B are development views of an intermediate transfer belt. In FIG. 14, the portions having the same functions as those used in the first preferred embodiment are denoted at the same reference symbols. Further, an internal structure of the image forming apparatus according to the third preferred embodiment is the same as that according to the first preferred embodiment shown in FIG. 1, and therefore, will not be described. The structure and the counting sequence of the dot counter 200 shown in FIG. 14 are the same as those according to the first preferred embodiment described earlier with reference to FIGS. 3 and 4, and therefore, will not be described. The exposure power controller 123 has the same function as the exposure power controller 123 according to the first preferred embodiment, except for that this exposure power controller 123 is capable of directly receiving a signal from the pattern generating module 125 and a signal from the modulating signal generator 210, as in the second preferred embodiment (FIG. 10).

In this image forming apparatus, as a print command and image data are fed to the main controller 11 of the control unit 1 from an external apparatus such as a host computer, the main controller 11 outputs a print command signal to the respective portions of the apparatus, and based on the image data thus supplied, an image signal expressing an image to be formed as a multi-gradation print dot string is generated for each toner color component, and thus obtained image signals are outputted to the engine controller 12 as job data. In accordance with a command from the main controller 11, the engine controller 12 controls the respective portions of the engine EG, an image corresponding to the image signal is formed on a sheet (recording medium) S in the unit of a job.

As the CPU 111 generates multi-gradation print dot data based on image data fed via the interface 112 from an external apparatus such as a host computer, the modulating signal generator 210 modulates the print dot data. When the modulating signal is fed to the exposure power controller 123, the exposure power controller 123 controls the respective portions of the exposure unit 6, the light beam L based on the modulating signal exposes the photosensitive member 2, and an electrostatic latent image corresponding to the image data is formed on the photosensitive member 2.

Meanwhile, as described later, during execution of the special image forming operation for superimposing a special image having a predetermined image pattern on top of the image which is based on the image data mentioned above, the pattern generating module 125 provides the exposure power controller 123 with a modulating signal which corresponds to this image pattern, the exposure power controller 123 superimposes the modulating signal based on the image data mentioned above on the modulating signal which corresponds to the image pattern, the respective portions of the exposure unit 6 are controlled in accordance with the signal resulting from the superimposition, and an electrostatic latent image is formed which corresponds to the image which is obtained by superimposing the special image on the image which is based on the image data mentioned above. As a modulation method for the modulating signal generator 210, various pulse modulation such as pulse width modulation (PWM) and pulse amplitude modulation (PAM) can be used.

The intermediate transfer belt 71 is an endless belt which is obtained by joining an approximately rectangular sheet at a splice 72, as shown in FIGS. 15A and 15B. In FIGS. 15A and 15B, the arrow 73 denotes a rotation direction of the belt, while the arrow 74 denotes a rotation axis direction. The intermediate transfer belt 71 contains a transfer protection area 75 and a transfer area 76. The transfer protection area 75 is defined across one edge and the other edge along the rotation axis direction 74 and within a predetermined range which stretches on the both sides to the splice 72. The transfer area 76 is an area other than the transfer protection area 75, and is defined in a rectangular area except for a one edge portion and other edge portion along the rotation axis direction 74. A toner image is primarily transferred onto the transfer area 76.

As shown in FIG. 15A, a toner image 77 whose size is that of an A3 paper as it is placed with the longer sides aligned along the rotation direction 73 can be transferred onto the transfer area 76. Further, as shown in FIG. 15B, as the transfer area 76 is split into two sub areas 76A and 76B, as the intermediate transfer belt 71 rotates one round, it is possible to transfer two images having the size of an A4 paper with the shorter sides aligned along the rotation direction 73 or a smaller size, e.g., the A4, A5 and B5 sizes. Shown in FIG. 15B are toner images 78 having the A4 size.

In this embodiment, the photosensitive member 2 thus corresponds to the "image carrier" of the present invention. The charger unit 3, the exposure unit 6 and the rotary developer unit 4 correspond to the "image forming means" of the present invention. The transfer unit 7 corresponds to "transfer means" of the present invention. Further, the intermediate transfer belt 71 corresponds to a "transfer medium" of the present invention, and the two sub areas 76A and 76B into which the transfer area 76 is split each correspond to a "toner image transfer area" of the present invention.

The patch sensor PS is disposed facing against the surface of the intermediate transfer belt 71. During execution of an operation for adjusting image forming conditions, the patch sensor PS detects-optically image densities of the patch images which are formed in the transfer protection area 75 of the intermediate transfer belt 71.

An offset value stored in the memory 127 will now be described. This type of image forming apparatus is known to consume a very small amount of toner even when a white image is formed, i.e., even during execution of the image forming operation for printing no print dot at all. This occurs as incompletely charged toner or inversely charged toner locally moves onto the photosensitive member 2 from the developers 4Y, . . . , or the toner is partially transferred back into inside the apparatus during execution of the image forming operation. Adhesion of such toner to an image is visually recognized as fogging. Noting that there is a loss of toner separately from toner which is used as a toner image on the photosensitive member 2, this embodiment requires that an offset value corresponding to the amount of fogging toner is stored in the memory 127.

The amount of fogging toner is calculated by multiplying the driving time of the developer 4Y by a value which has been obtained in advance through an experiment as a toner scattering amount per unit time. As the driving time of the developer 4Y, a period of time during which the developing bias is applied upon the developer 4Y, the driving time of the developer roller 40Y which transports toner housed in the developer 4Y to the opposed position facing the photosensitive member 2, or the like may be used. Since the driving time of the developer per image is approximately constant in general when the sheet size remains unchanged, a fogging toner amount is determined in advance for each sheet size and stored as an offset value in the memory 127 in this embodiment. The offset value corresponding to the sheet size is extracted from the memory 127.

By the way, a fogging toner amount is considered to vary depending upon an image forming style. In other words, in this apparatus, the engine controller 12 and the engine EG carry out the image forming operation in accordance with information regarding the image forming style which is contained in a print command signal (operation signal) sent to the engine controller 12 through the main controller 11 from an external apparatus such as a host computer.

For instance, in the event that the print command signal contains an instruction which demands to form an image under a high-quality mode as the image forming style information, the main controller 11 generates an image signal in which print dots are finely controlled, the engine controller 12 and the engine EG operate based on this image signal, and a high-quality image is formed.

Meanwhile, when the print command signal contains an instruction which demands to form an image under a toner save mode, which is for suppressing the amount of consumed toner, as the image forming style information, such control is executed which reduces the gradation values of print dots for example to thereby reduce the amount of consumed toner and then form an image.

A fogging toner amount is different between these image forming styles. Fogging toner a mounts for the respective image forming styles calculated in advance are stored as offset values in the memory 127 in this embodiment. The offset value corresponding to the image forming style information contained in the print command signal mentioned above is extracted from the memory 127.

This apparatus also executes a special image forming operation. Over the recent years, capabilities of color image forming apparatuses have improved and there now is a risk that unauthorized use could be made of these improved apparatuses. To prevent such unauthorized printing, a special image which permits to identify the image forming apparatus is printed on top of an image which corresponds to image data received by the main controller 11 from outside, which is the special image forming operation.

A special image expresses a serial production number of the image forming apparatus or the like using the least noticeable color component (such as yellow) to human eyes among the color components which are used in the image forming apparatus (magenta, cyan, yellow and black in this embodiment). The image pattern of the special image is set in advance. Hence, it is possible to calculate the amount of toner used in forming the special image in advance.

When a sheet (recording medium) S is an OHP sheet however, considering the objective to project an image using an overhead projector, it is not preferable to print and superimpose a special image. Further, a risk of someone using an OHP sheet for unauthorized printing is believed to be low.

Noting this, the memory 127 stores an ordinary offset value which corresponds only to a fogging toner amount which does not contain the amount of toner used in forming the special image, and a special offset value which corresponds to an amount containing the amount of toner used in forming the special image and a fogging toner amount. In the event that the print command signal mentioned above contains information indicating that the sheet S is an OHP sheet as the image forming style information, the ordinary offset value is extracted from the memory 127. On the other hand, when the print command signal contains information expressing that the sheet S is a non-OHP sheet (such as a plain paper), the special offset value is extracted from the memory 127.

Further, in this apparatus, two toner images (two pages of toner image) can be transferred onto the intermediate transfer belt 71 as the intermediate transfer belt 71 rotates one round, as described earlier. According to this embodiment, the CPU 124 of the engine controller 12 executes a toner counting process (6) shown in FIG. 17 every time one toner image (one page of toner image) is formed as described later. Hence, when two toner images are transferred onto both the sub areas 76A and 76B respectively, fogging toner amounts corresponding to the respective areas are added as offset values.

In contrast, in the event that one toner image is transferred onto only one of the sub areas 76A and 76B (e.g., the last rotation of the intermediate transfer belt 71 to print an odd number of pages in transfer control of two A4-size toner images onto the intermediate transfer belt 71 in one rotation), although a fogging toner amount corresponding to the area onto which the toner image is transferred (e.g., the sub area 76A) is added as an offset value, a fogging toner amount corresponding to the area onto which the toner image is not transferred (e.g., the sub area 76B) fails to be added because of the absence of the toner counting process. However, toner contributing to fogging is believed to be present on the photosensitive member 2 which corresponds to the area onto which the toner image is not transferred although no toner image is formed on the photosensitive member 2, and this must be considered separately.

Noting this, according to this embodiment, different offset values are stored in the memory 127 between an instance where toner image is transferred onto only one of the sub areas 76A and 76B and other instances which are an instance that one toner image (one page of toner image) is transferred onto the transfer area 76 of the intermediate transfer belt 71 and an instance that two toner images (two pages of toner image) are transferred onto both the sub areas 76A and 76B respectively.

FIG. 16 shows an example of offset value table data stored in the memory 127. As shown in FIG. 16, in this embodiment, an offset value Tk (where k is 11 through 18 in this embodiment) is set in advance and stored in the memory 127' for each combination regarding whether the mode is the high-quality mode or the toner save mode, whether a sheet S is an OHP sheet or a non-OHP sheet and whether one of two pages of toner image is to be transferred (i.e., transfer of toner image onto only one of the sub areas 76A and 76B) or other instances (i.e., transfer of one page of toner image onto the transfer area 76 or transfer of two pages of toner image onto both the sub areas 76A and 76B). As described above, since the fogging toner amounts are determined one each for each sheet size, offset value table data set for each sheet size are stored in the memory 127 for each toner color component. Shown in FIG. 16 as an example is data for the A4 size and yellow toner.

In FIG. 16, an offset value T11 for instance is a value obtained by adding to an offset value T15 a fogging toner amount which corresponds to the sub area to which no toner image is to be transferred. Meanwhile, an offset value T12 for instance is a value obtained by adding to the offset value T11 the amount of toner used in forming the special image. Further, the offset value T11 and an offset value T13 are different from each other by a difference between a fogging toner amount in the high-quality mode and that in the toner save mode. In this embodiment, the memory 127 thus corresponds to "storage means" of the present invention.

Figure 17:
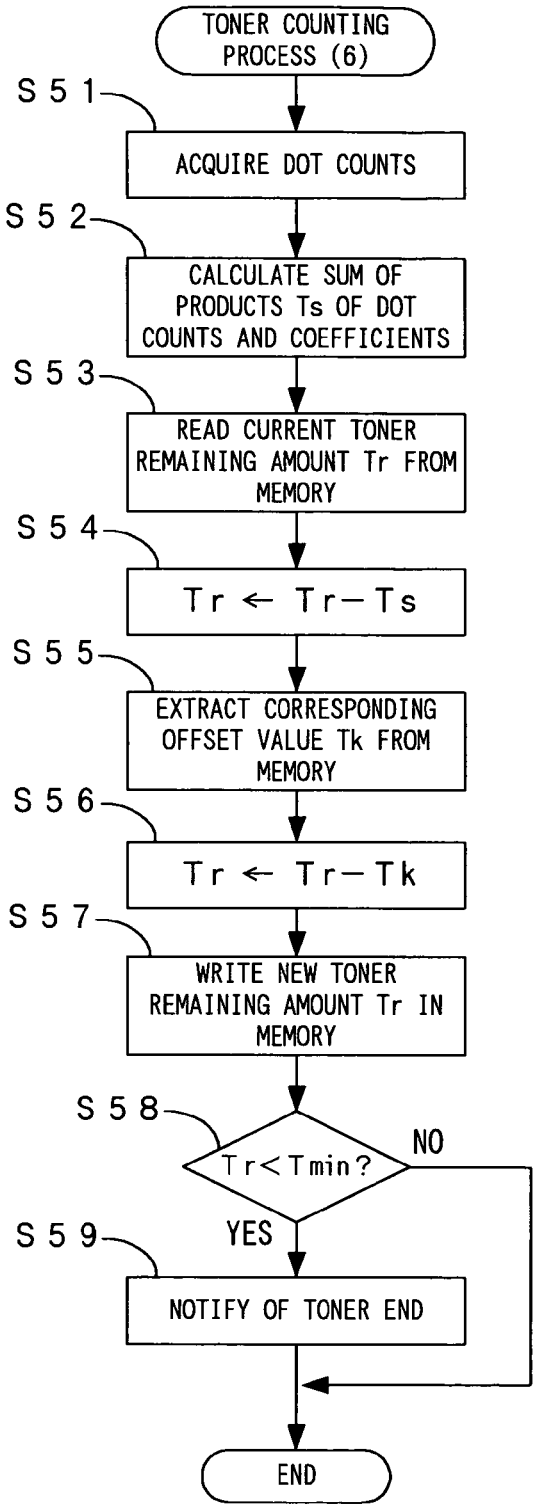
FIG. 17 is a flow chart which shows a toner counting process (6)

FIG. 17 is a flow chart which shows the toner counting process (6) during execution of a toner image forming operation. In this image forming apparatus, for the convenience of management of consumables, the CPU 124 of the engine controller 12 executes the toner counting process (6) shown in FIG. 17 every time one page of toner image is formed, and calculates the toner remaining amounts in the developers 4Y, . . . for the respective toner colors. In short, one page is used as a "predetermined unit" of the present invention and the CPU 124 functions as "consumption amount calculating means" of the present invention. While a method of calculating the amount of the toner remaining in the developer 4Y will now be described in relation to the yellow color, the operation is the same also for the other toner colors.

Steps S51 through S54 of the toner counting process (6) shown in FIG. 17 are the same as the steps S1 through S4 of the toner counting process (1) described earlier with reference to FIG. 5, and therefore, will not be described.

Following the step S54, a signal regarding an image forming style contained in the print command signal from the main controller 11 is judged, and the corresponding offset value Tk is extracted from the memory 127 (Step S55). For instance, in the event that two pages of toner image are to be transferred onto both the sub areas 76A and 76B using an A4-size plain paper under the high-quality mode, an offset value T16 is extracted. Meanwhile, in the event that one page of toner image is to be transferred onto only one of the sub areas 76A and 76B using an A4-size OHP sheet under the toner save mode, an offset value T13 is extracted.

With thus extracted offset value Tk subtracted from the toner remaining amount Tr calculated at the step S54 (Step S56), anew toner remaining a mount Tr of toner remaining in the developer 4Y after one page of toner image is formed is calculated. The memory 127 is updated with this value Tr (Step S57). Steps S58 and S59 which follow are the same as the steps S8 and S9 of the toner counting process (1) described earlier with reference to FIG. 5, and therefore, will not be described.

In FIG. 17, the sum of products Ts, which is obtained from the respective dot counts C1, . . . and the weighting coefficients K1, . . . is subtracted from the immediately precedent toner remaining amount Tr, and from the resultant value, the offset value Tk is further subtracted. This is of course theoretically equivalent to calculation of (Ts+Tk) from the sum of products Ts and the offset value Tk and subtraction of this from the immediately precedent toner remaining amount Tr. The sum (Ts+Tk) obtained by adding the sum of products Ts to the offset value Tk serves as the amount of toner which is consumed when one page of toner image is formed. The amount of consumed toner is calculated every time one page of toner image is formed and subtracted from the immediately precedent toner remaining amount, thereby calculating the amount of toner remaining within the developer 4Y at present (i.e., at the end of the formation of the images). In this embodiment, the CPU 124 thus corresponds to "offset value setting means" of the present invention.

In the developers 4Y, . . . which can be attached to and detached from the apparatus body, it is preferable that before each developer is detached from the apparatus body, the toner remaining amounts Tr in the respective developers calculated in the manner described above are stored in the memories 42Y. With the respective developers attached to the apparatus body, the toner remaining amounts of the respective developers stored in the memories 42Y, . . . are read out and used as initial toner remaining amount values Tr during the toner counting process (6) described above, thereby easily managing the lifetime of each developer. Of course, in the case of a brand new developer, the amount of toner filled inside the developer at the time of shipment may be stored.

As described above, according to this embodiment, a fogging toner amount, the amount of toner used in forming a special image or the like is calculated in advance and stored in the memory 127 for each image forming style information which is contained in a print command signal (operation signal) inputted from the main controller 11, and the CPU 124 extracts from the memory 127 the offset value Tk which corresponds to the image forming style information. Hence, it is possible to appropriately change the fogging toner amount or the like in accordance with various image forming styles. Further, since the only requirement is to extract from the memory 127 the offset value Tk corresponding to the image forming style information, the processing is simple.

In addition, since the number of print dots is counted based on an image signal fed from the CPU 111 via the modulating signal generator 210 and the exposure power controller 123 and counts are multiplied by predetermined coefficients, it is possible to identify the amount of toner which is used for an ordinary toner image merely through calculation in a simple manner.

As the toner consumption amount thus calculated for each operation is subtracted from the immediately precedent toner remaining amount every time each operation is executed, the toner remaining amount within each developer at the time of each operation is grasped.

The present invention is not limited to the preferred embodiments above, but may be modified in various manners in addition to the preferred embodiments above, to the extent not deviating from the object of the invention.

For instance, although the third preferred embodiment described above requires that the CPU 124 of the engine controller 12 calculates the toner consumption amount based on counts registered by the dot counter 200 which is disposed to the main controller 11 and the offset value which corresponds to the image forming style information, this is not limiting. For example, the CPU 111 of the main controller 11 may calculate the toner consumption amount after receiving the offset value changed by the engine controller 12, or alternatively, the dot counter 200 may be disposed to the engine controller 12.

Further, although formation of one page of toner image is treated as the "predetermined unit" of the present invention in the third preferred embodiment described above, the predetermined unit is not limited to this but may be freely determined. For instance, when there is an image forming request which demands a plurality of pages of images to be formed, formation of all images or a predetermined number of pages may be regarded as the "predetermined unit." Alternatively, formation of images while the intermediate transfer belt 71 rotates one round may be the "predetermined unit."

In addition, although the third preferred embodiment described above requires to store the offset values corresponding to the high-quality mode and the toner save mode in the memory 127, this is not limiting. When the print command signal described above contains, as image forming style information, a high-speed mode in which a printing speed precedes an image quality, a line image mode for forming a line image such as a letter in high quality, a photograph mode for forming a photograph image in high quality, etc., offset values corresponding to these modes may be stored in the memory 127. With the offset value corresponding to each mode extracted from the memory 127, the amount of toner consumed under each mode is accurately calculated.

Still further, while the third preferred embodiment described above is related to an application of the present invention to an image forming apparatus which comprises the intermediate transfer belt 71 as a transfer medium, the present invention is applicable also to an image forming apparatus which comprises an intermediate transfer drum, an intermediate transfer sheet or the like as a transfer medium.

<Fourth Preferred Embodiment>

Figure 18:
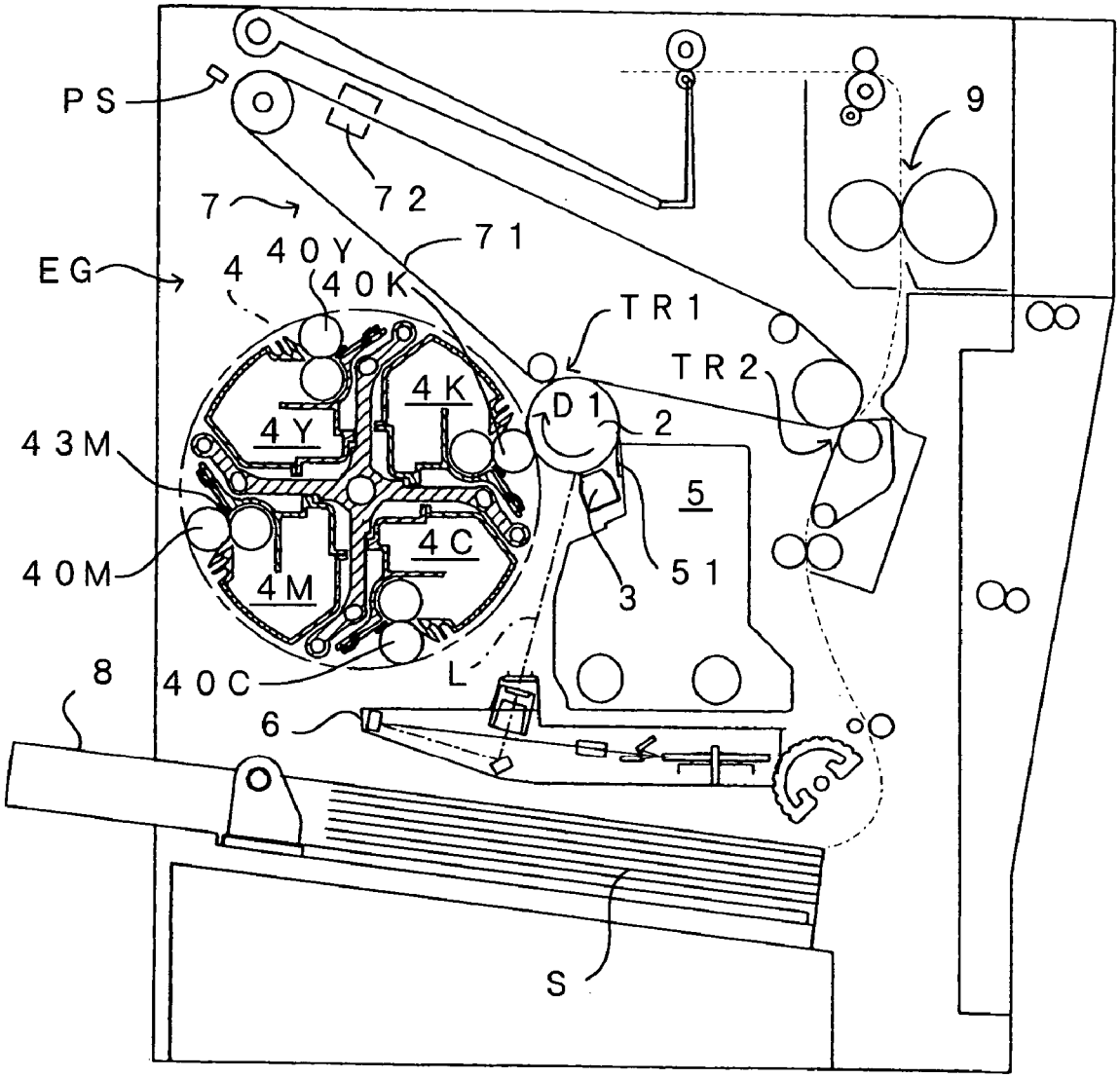
FIG. 18 is a drawing which shows a fourth preferred embodiment of the image forming apparatus according to the present invention.
Figure 19:
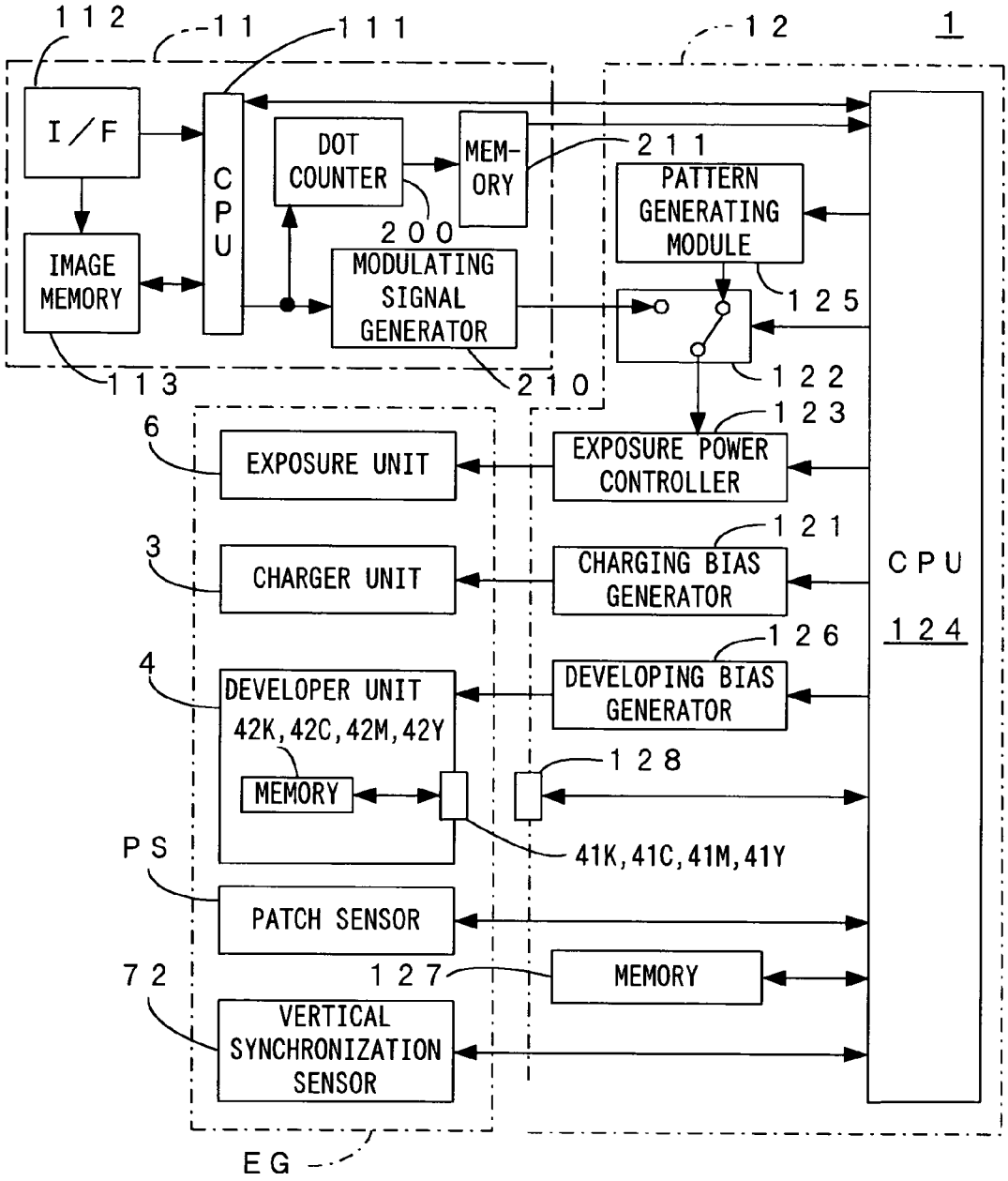
FIG. 19 is a block diagram which shows an electric structure of the image forming apparatus shown in FIG. 18.

FIG. 18 is a drawing which shows a fourth preferred embodiment of the image forming apparatus according to the present invention, and FIG. 19 is a block diagram which shows an electric structure of the image forming apparatus shown in FIG. 18. In FIGS. 18 and 19, the portions having the same functions as those used in the first preferred embodiment are denoted at the same reference symbols. The structure and the counting sequence of the dot counter 200 according to the fourth preferred embodiment shown in FIG. 19 are the same as those according to the first preferred embodiment described earlier with reference to FIGS. 3 and 4, and therefore, will not be described.

In this image forming apparatus, as a print command is fed to the main controller 11 from an external apparatus such as a host computer, the CPU 111 of the main controller 11 converts the print command into job data which are in a suitable format to instruct the engine EG to operate. The engine controller 12 controls the respective portions of the engine EG in response to the job data inputted from the main controller 11, whereby images corresponding to the print command are formed on a sheet (recording medium) S such as a transfer paper, a copy paper and an OHP sheet in the unit of a job.

For instance, in accordance with a command from a CPU 124 of the engine controller 12, when the image signal switcher 122 makes contact to a pattern generating module 125 (an image forming condition adjusting operation which will be described later), a modulating signal corresponding to an image pattern outputted from the pattern generating module 125 is fed to the exposure power controller 123, whereby an electrostatic latent image is formed. On the other hand, when the image signal switcher 122 makes contact to the CPU 111 of the main controller 11 (an ordinary image forming operation which will be described later), a modulating signal generated by the modulating signal generator 210 is fed to the exposure power controller 123 based on image data contained in a print command received via the interface 112 from an external apparatus such as a host computer. The light beam L based on the modulating signal exposes the photosensitive member 2, and an electrostatic latent image corresponding to the image signal is formed on the photosensitive member 2. As a modulation method, various pulse modulation such as pulse width modulation (PWM) and pulse amplitude modulation (PAM) can be used.

The patch sensor PS is disposed facing against the surface of the intermediate transfer belt 71. During execution of the image forming condition adjusting operation which will be described later, the patch sensor PS detects optically image densities of the patch images which are formed on the outer circumferential surface of the intermediate transfer belt 71. In addition to the patch sensor PS, there is a vertical synchronization sensor 72. The vertical synchronization sensor 72 is a sensor for detecting a reference position for the intermediate transfer belt 71, and functions as a vertical synchronization sensor which obtains a synchronizing signal which is outputted in association with rotations of the intermediate transfer belt 71, namely, a vertical synchronizing signal Vsync. In this apparatus, for the purpose of aligning the operation timing of the respective portions of the apparatus and accurately superimposing toner images of the respective colors one atop the other, the operations of the respective portions of the apparatus are controlled based on the vertical synchronizing signal Vsync. As the vertical synchronizing signal Vsync is counted, the cumulative number of revolutions of the intermediate transfer belt 71 is found.

In this embodiment, the photosensitive member 2 thus functions as the "image carrier" of the present invention, developer rollers 40K, 40C, 40M and 40Y thus correspond respectively to a "toner carrier" of the present invention, and the transfer unit 7 corresponds to the "transfer means" of the present invention.

Figure 20:
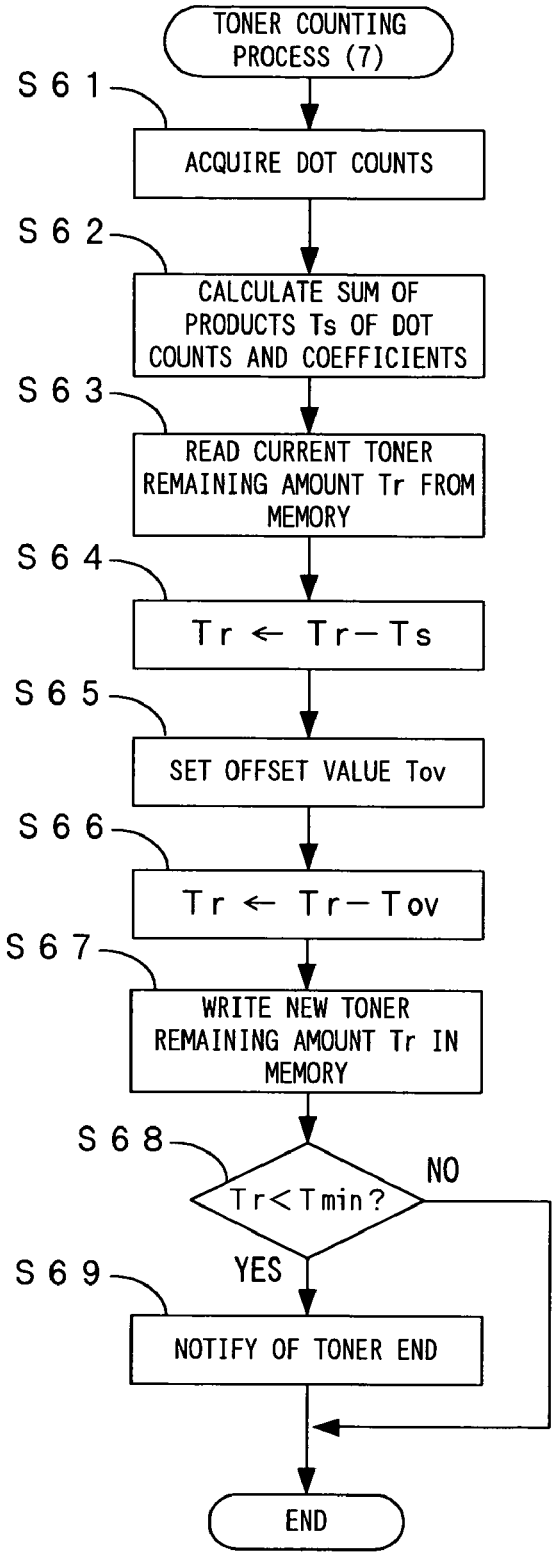
FIG. 20 is a flow chart which shows a toner counting process (7) during execution of an image forming operation.

FIG. 20 is a flow chart which shows a toner counting process (7) during execution of the image forming operation. In this image forming apparatus, for the convenience of management of consumables, the CPU 124 of the engine controller 12 executes the toner counting process (7) shown in FIG. 20 and calculates the toner remaining amounts in the developers 4Y, . . . for the respective toner colors. In short, one page is used as the "predetermined unit" of the present invention and the CPU 124 functions as the "consumption amount calculating means" and "toner remaining amount calculating means" of the present invention. While a method of calculating the amount of the toner remaining in the developer 4Y will now be described in relation to the yellow color, the operation is the same also for the other toner colors.

In the toner counting process (7) shown in FIG. 20, first, the counts C1, C2 and C3 of the print dots counted by the dot counter 200 are acquired (Step S61). These values are multiplied by predetermined coefficients respectively and added to each other, thereby calculating a value Ts (Step S62). That is:

$$Ts=Kx\cdot(K1\cdot C1+K2\cdot C2+K3\cdot C3)$$

The symbols Kx, K1, K2 and K3 are weighting coefficients which have been determined in advance one each for each toner color. As the successive print dots are counted as one group and the respective counts are multiplied by the coefficients, the total amount of toner adhering on the photosensitive member 2 which serves as the image carrier and constituting a toner image, namely, the total amount of "image constituting toner" of the present invention is accurately calculated. Such a method of calculating a toner amount is described in detail in above-mentioned Japanese Patent Application Laid-Open Gazette No. 2002-174929 and will not be described here.

Next, the amount Tr of the toner remaining in the developer 4Y stored in the memory 127 of the engine controller 12 is read out (Step S63). A value obtained by subtracting the value Ts calculated as described above from this value Tr is then defined as anew toner remaining amount Tr (Step S64).

Further, this image forming apparatus is known to consume a very small amount of toner even when a white image is formed, i.e., even during execution of an image forming operation for printing no print dot at all. This occurs as a part of incompletely charged toner or inversely charged toner moves onto the photosensitive member 2 from the developer 4Y or a part of the toner is scattered into inside the apparatus during execution of the image forming operation. Adhesion of such toner to an image is recognized as fogging.

Noting that there is a loss of toner separately from the image constituting toner mentioned above, an offset value Tov corresponding to the driving time of the developer is set (Step S65). With respect to the offset value Tov, since the driving time of the developer per image is approximately constant in general when the sheet size remains unchanged, the offset value Tov is determined in advance for each sheet size and stored in the memory 127. In this embodiment, the offset value Tov is appropriately changed as needed, considering an operating state of the apparatus, a history of use of the toner, or the like (an offset value changing operation which will be described later).

As thus calculated offset value Tov is subtracted from the toner remaining amount Tr calculated at the step S64 (Step S66), anew toner remaining amount Tr of toner remaining in the developer 4Y after one image is formed is identified. The memory 127 is updated with this value Tr (Step S67). Steps S68 and S69 which follow are the same as the steps S8 and S9 of the toner counting process (1) described earlier with reference to FIG. 5, and therefore, will not be described.

As described above, the total (Ts+Tov) of the sum of products Ts, which is obtained from the respective dot counts C1, . . . and the weighting coefficients K1, . . . , and the offset value Tov is the amount of toner which is consumed when one image is formed. The toner consumption amount is calculated every time one image is formed, and subtracted from the immediately precedent toner remaining amount, whereby the amount Tr of the toner remaining in the developer 4Y at present (at the end of the formation of the images) is calculated.

The fourth preferred embodiment requires to subtract a toner consumption amount per image from the amount of toner initially held in each developer to thereby calculate the amount of toner remaining in the developer upon forming each image. This of course is theoretically equivalent to calculation of the total toner consumption amount by means of integration of a toner consumption amount per image. Thus, in this preferred embodiment, the amount of toner which is consumed when one image is formed corresponds to a "toner consumption amount" of the present invention, and a value obtained by integrating this amount of toner corresponds to an "integrating value" of the present invention.

It is preferable that in the developers 4Y, . . . which are structured to be attachable to and detachable from the apparatus body, prior to removal of the respective developers from the apparatus body, the toner remaining amounts Tr in the respective developers calculated as described above are stored in the memories 42Y, . . . Upon attaching of the respective developers to the apparatus body, the toner remaining amounts in the respective developers stored in the memories 42Y, . . . are read out and used as initial toner remaining amounts Tr which are required by the toner counting process (7) described above, which makes management of the lifetime of the developers easy. Of course, in the case of a brand new developer, the amount of toner filled in the developer at the time of shipment may be stored.

The reason and an operation of appropriately changing the offset value Tov will now be described in detail with reference to FIGS. 21A, 21B and 22 (the offset value changing operation).

Figure 21A:
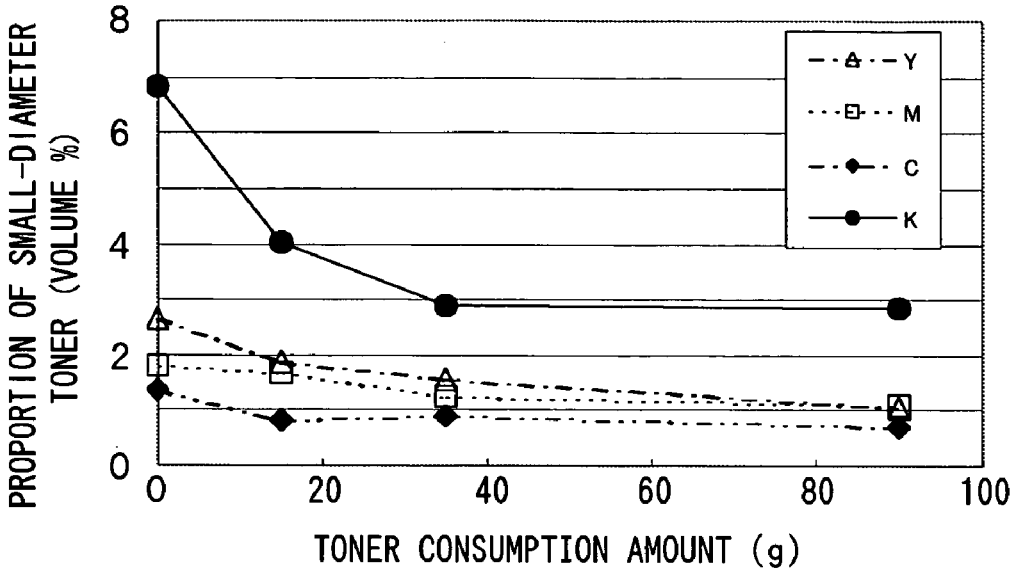
FIGS. 21A and 21B are drawings which show an example of changes of a toner particle diameter distribution.
Figure 21B:
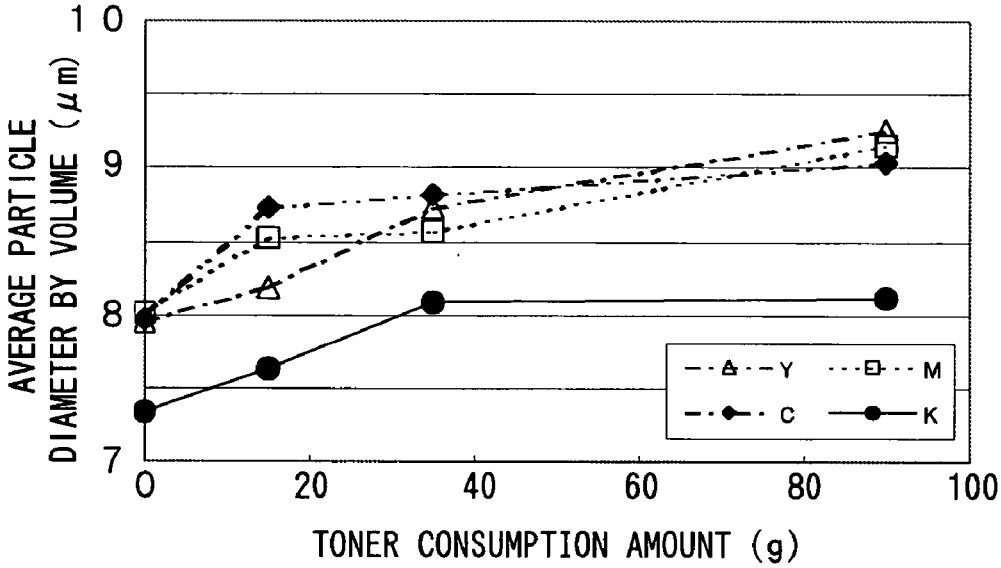

FIGS. 21A and 21B are drawings which show an example of changes of a toner particle diameter distribution. Toner which is used in this type of image forming apparatus contains toner particles having various different particle diameters, and therefore, a particle diameter distribution spreads in a certain manner. A phenomenon called "selective development," i.e., a phenomenon that the probability of consumption becomes different owing to a difference in toner particle diameter, is known to occur as an image is formed using toner having such a particle diameter distribution.

This phenomenon has been confirmed also through experiments. FIG. 21A shows an example of actual measurement to identify how a proportion (volume %) of toner having small particle diameters of 5 $\mu$m or less to all toner within a developer changes as images are formed repeatedly. FIG. 21B shows changes of an average particle diameter by volume of toner which remains within the developer. As shown in FIG. 21A, as images are formed over a long period of time and the toner consumption amount increases, the proportion of toner having small particle diameters decreases gradually, and in accordance with this, the average particle diameter by volume increases gradually as shown in FIG. 21B. From this, it is seen that as images are formed, uniform consumption of toner having various different particle diameters does not occur but consumption of the toner having small particle diameters occurs first. As images are formed repeatedly and the toner consumption amount accordingly increases, the extent of the unevenness of the toner particle diameters within the developer, namely, the particle diameter distribution of the toner changes gradually.

Hence, as for how a fogging amount relates to an actual toner consumption amount, a simple linear relationship never holds true between the two. Rather, a relationship between the two is non-linear in general. This is because a fogging-induced toner consumption amount, that is, the offset value Tov constantly changes as the particle diameter distribution of toner changes as described above. For this reason, if the offset value Tov is fixed, it is difficult to accurately calculate a toner consumption amount.

Once there occurs a discrepancy between a calculated toner consumption amount and the actual amount, there is the following inconvenience. For example, when one tries to identify the toner end based on a calculated toner consumption amount, if there is such a discrepancy, one could make a mistake as for the timing of exchanging a developer. That is, a user could discard a developer even though there actually still is a sufficient amount of toner in the developer, or fails to notice that remaining toner is only in a small amount and makes a delayed arrangement to fetch anew developer. In addition, in the event that the adjustment of an image forming condition is executed in accordance with a toner consumption amount as described later in the modifications, it is not possible to adjust at proper timing, thereby arising a problem such as an increase of image density variation. Noting this, in this embodiment, the offset value Tov is appropriately changed as needed, considering an operating state of the apparatus, a history of use of the toner, or the like.

Figure 22:
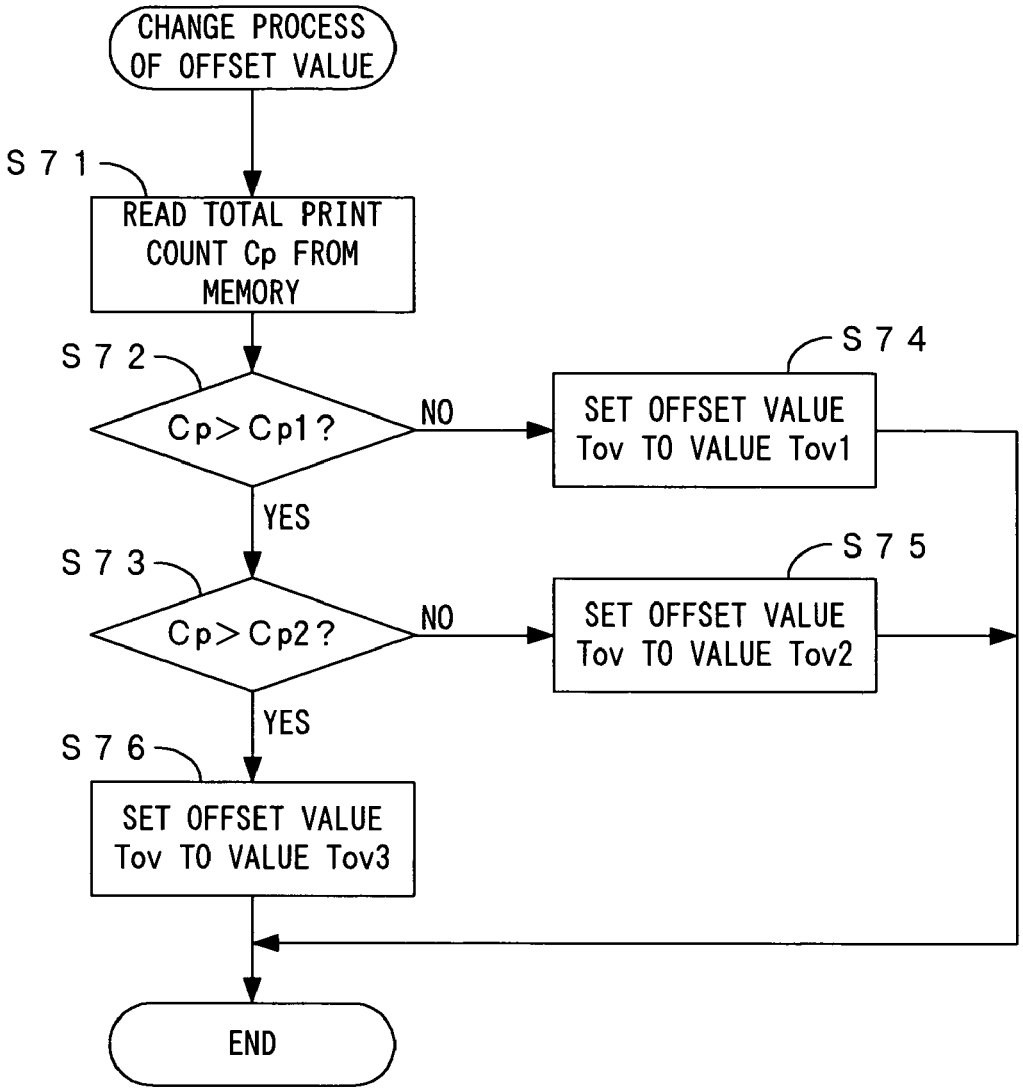
FIG. 22 is a flow chart which shows an offset value changing process in the fourth preferred embodiment of the present invention.

FIG. 22 is a flow chart which shows the offset value changing operation. In the image forming apparatus according to this embodiment, at appropriate timing, e.g., for every execution of the toner counting process (7) shown in FIG. 20, the CPU 124 executes the calculation described below in accordance with a changing operation program stored in the memory 127 in advance, whereby the offset value Tov is changed in accordance with the operating state of the apparatus, the history of use of the toner, or the like. The CPU 124 thus functions as the "offset value setting means" of the present invention.

First, in attempt to learn about the operating state of the image forming apparatus, the history of use of the toner, etc., a total print count Cp is read out from the memory 127 (Step S71). Steps S72 and S73 are then carried out, thereby determining which category the total print count Cp belongs to. In this example, the following three categories are provided with reference to two criteria Cp1 and Cp2 (where Cp1<Cp2):

$$0 \leqq Cp \leqq Cp1$$

$$Cp1 < Cp \leqq Cp2$$

$$Cp2 < Cp$$

When it is determined that the total print count Cp belong to the first category ($0 \leqq Cp \leqq Cp1$)("NO" at Step S72), the offset value Tov is set to an offset value Tov1 which corresponds to the first category (Step S74). Meanwhile, when it is determined that the total print count Cp belong to the second category ($Cp1 < Cp \leqq Cp2$) ("NO" at Step S73), the offset value Tov is set to an offset value Tov2 which corresponds to the second category (Step S75). Further, when it is determined that the total print count Cp belong to the third category (Cp2<Cp) ("YES" at Step S73), the offset value Tov is set to an offset value Tov3 which corresponds to the third category (Step S76). These three types of candidate values Tov1 through Tov3 of the offset value may be identified in advance through an experiment, simulation or the like and stored in the memory 127. A relationship between the total print count Cp and the offset value Tov may be expressed as a function, the function may be stored in the memory 127, and the offset value Tov corresponding to the total print count Cp may be identified from the function.

As described above, according to this embodiment, changes of the nature of toner with time a recorrelated with the operating state of the apparatus, the history of use of the toner or the like, and the offset value Tov is appropriately changed as needed. Hence, even when the nature of toner changes, the corresponding offset value Tov can be set. As a result, it is possible to accurately calculate a toner consumption amount.

While the fourth preferred embodiment uses the total print count Cp as a value which directly or indirectly expresses the operating state of the apparatus, the history of use of the toner, etc., the value expressing the operating state of the apparatus or the like may be the cumulative number of revolutions of the photosensitive member 2, that of the developer rollers 40K, 40C, 40M and 40Y of the developers 4K, 4C, 4M and 4Y, that of the intermediate transfer belt 71 (i.e., a count representing the vertical synchronizing signal Vsync), an integrating value obtained by integrating toner consumption amounts calculated in the predetermined unit (i.e., the total toner consumption amount), the amounts Tr of toner remaining within the developers 4K, 4C, 4M and 4Y, or the like.

Further, although the offset value Tov is changed based only on the total print count Cp in the fourth preferred embodiment described above, the offset value Tov may be changed based on the total print count Cp in combination with such a cumulative value described earlier, the cumulative number of revolutions, etc. In short, the total print count Cp and the cumulative number of revolutions of the photosensitive member 2 or the like, i.e., two or more of multiple values which express the operating state of the apparatus, the history of use of the toner and the like may be combined, and the offset value Tov may be changed based on the combination of the values. For example, the cumulative number of revolutions of the photosensitive member 2 may be combined with the cumulative number of revolutions of the developer rollers, or the integrating value of a toner consumption amount may be combined with a toner remaining amount. Using a combination of multiple of values, the offset value Tov which better represents the operating state of the apparatus, the history of use of the toner or the like is calculated, which in turn allows to calculate a toner consumption amount at a high accuracy.

<Fifth Preferred Embodiment>

Figure 23:
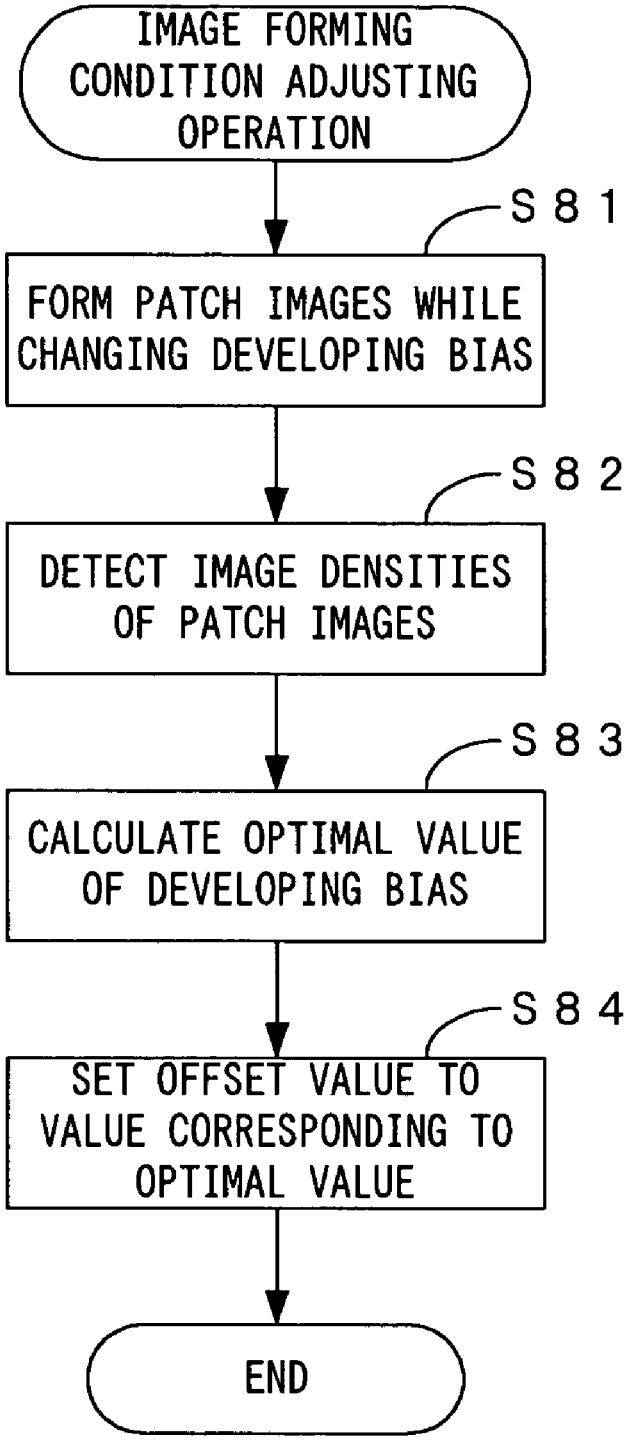
FIG. 23 is a flow chart which shows a fifth preferred embodiment of the image forming apparatus according to the present invention.

FIG. 23 is a flow chart which shows a fifth preferred embodiment of the image forming apparatus according to the present invention. A major difference of the fifth preferred embodiment from the fourth preferred embodiment described above is that the offset value Tov is changed in accordance with an optimal value of an image forming condition upon adjustment of the image forming condition. Other structures are basically similar to those according to the fourth preferred embodiment described above. This difference therefore will now be described in detail with reference to FIG. 23.

The purpose of the image forming condition adjusting operation is to adjust an image forming condition at predetermined timing, such as immediately after turning on of the apparatus or when a predetermined number of images have been formed, to thereby control an image density to a target density. According to this embodiment, patch images having a predetermined pattern are formed while changing the developing bias, which serves as a density controlling factor influencing an image density, over multiple levels (Step S81). Next, at the timing that patch images which have been transferred onto the intermediate transfer belt 71 arrive at an opposed position facing the patch sensor PS, the patch sensor PS detects the image densities of the patch images (Step S82), and a relationship between the image densities and the developing bias is calculated. The value of the developing bias which makes the image densities coincide with the target density is calculated based on thus identified relationship, and this value is used as an optimal value of the developing bias (Step S83).

Once the optimal value of the developing bias has been thus calculated, images will then be formed while setting this developing bias to this optimal value. The images are consequently formed at the target image density. A number of techniques have been proposed as such a density controlling technique. Any desired technique such as these known techniques can be applied to the present invention. Hence, density controlling techniques will not be described in detail.

By the way, a fogging toner amount may sometimes vary in response to a change made to an image forming condition through the image forming condition adjusting operation. According to this embodiment therefore, after optimization of the developing bias, a value corresponding to the optimal value of the developing bias is set as the offset value Tov (Step S84). Offset values corresponding to various developing biases may be identified in advance through an experiment, simulation or the like and stored in the memory 127. A relationship between the developing bias and the offset value Tov may be expressed as a function, the function may be stored in the memory 127, and the offset value Tov corresponding to the optimal value of the developing bias may be identified from the function.

As described above, according to this embodiment, since the offset value is changed to a value which corresponds to the image forming condition for every optimization of the image forming condition, even when the image forming condition changes, the offset value corresponding to the image forming condition is always set and a toner consumption amount is accurately calculated.

Although this embodiment requires to use the developing bias as the image forming condition, applications of the present invention are not limited to this. For instance, the present invention is applicable also to an image forming apparatus in which image forming conditions such as the charging bias and/or the exposure energy are optimized. Since a fogging amount in particular is largely influenced by a difference between the surface potential of the photosensitive member 2 and the developing bias, i.e., a so-called reverse contrast potential, it is most preferable to apply the present invention to an apparatus in which the developing bias serving as the image forming condition is optimized, an apparatus in which the charging bias serving as the image forming condition is optimized, or an apparatus in which both the developing bias and the charging bias serving as the image forming conditions are optimized.

The present invention is not limited to the preferred embodiments above, but may be modified in various manners in addition to the preferred embodiments above, to the extent not deviating from the object of the invention.

For instance, although the fourth and the fifth preferred embodiments described above require to calculate a toner consumption amount every time one image is formed during the ordinary image forming operation, the "predetermined unit" of the present invention is not limited to this but may be freely determined. Upon reception of an image forming request which demands a plurality of images to be formed for example, a toner consumption amount may be calculated after all these images are formed or every time a predetermined number of images are formed.

In addition, although the fourth and the fifth preferred embodiments described above are directed to an application of the present invention to an image forming apparatus which comprises the intermediate transfer belt 71 as an intermediate transfer medium, the present invention is applicable also to an image forming apparatus which comprises an intermediate transfer drum, an intermediate transfer sheet or the like as an intermediate transfer medium.

<Sixth Preferred Embodiment>

Figure 24:
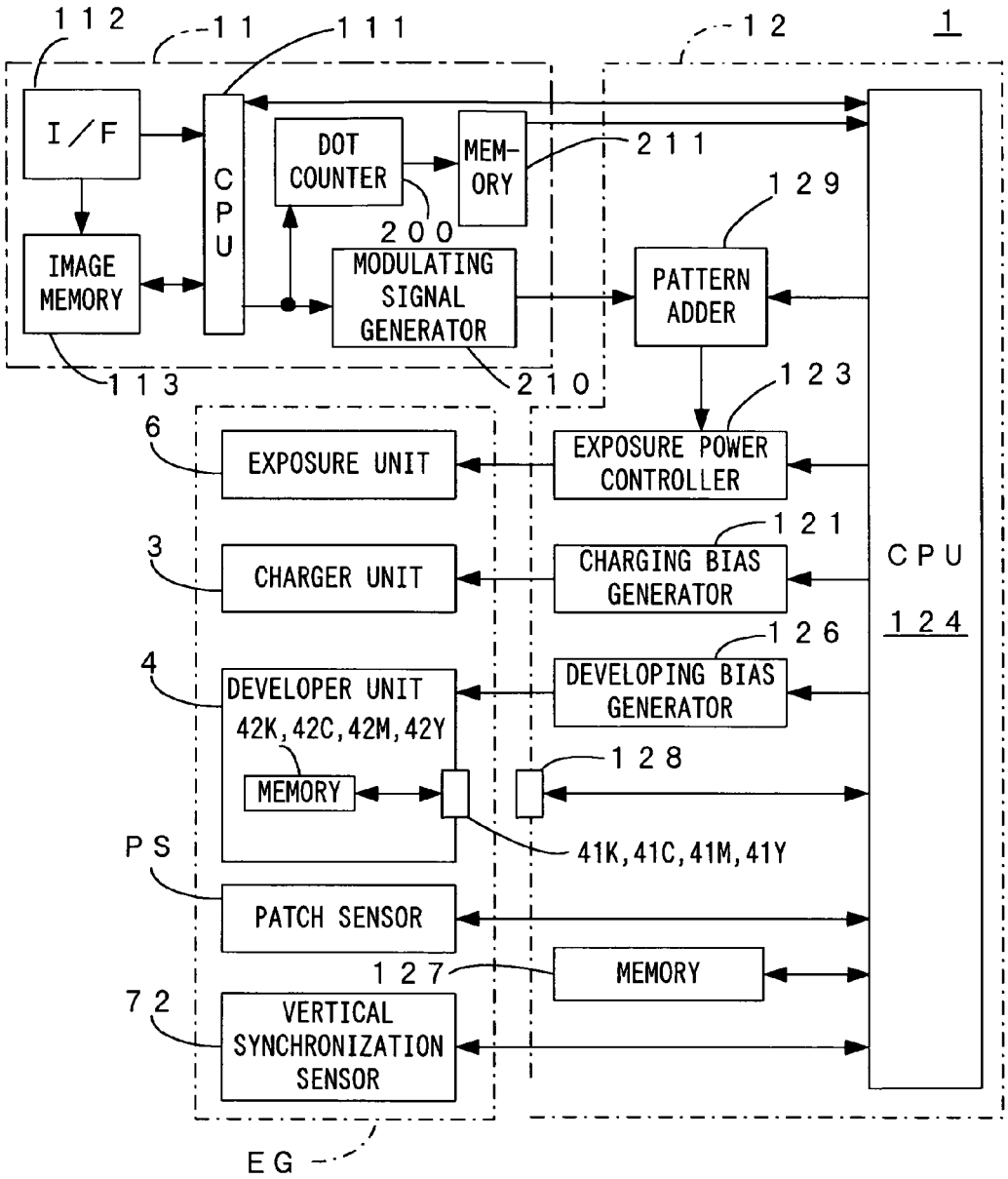
FIG. 24 is a block diagram which shows an electric structure of the image forming apparatus according to a sixth preferred embodiment.

FIG. 24 is a block diagram which shows an electric structure of the image forming apparatus according to a sixth preferred embodiment. An internal structure of the image forming apparatus according to the sixth preferred embodiment is the same as that according to the fourth preferred embodiment shown in FIG. 18, and therefore, will not be described. Further, in FIG. 24, the portions having the same functions as those used in the first and the fourth preferred embodiments are denoted at the same reference symbols.

The sixth preferred embodiment does not comprise the image signal switcher 122 (FIG. 19) and the pattern generating module 125 (FIG. 19) which are used in the fourth referred embodiment, but instead comprises a pattern adder 129. The exposure power controller 123 has the same function as the exposure power controller 123 according to the first preferred embodiment, except for that this exposure power controller 123 is capable of directly receiving a signal from the pattern adder 129 and a signal from the modulating signal generator 210. The structure and the counting sequence of the dot counter 200 shown in FIG. 24 are the same as those according to the first preferred embodiment described earlier with reference to FIGS. 3 and 4, and therefore, will not be described.

In this image forming apparatus, as a print command is fed to the main controller 11 from an external apparatus such as a host computer, the CPU 111 of the main controller 11 converts the print command into job data which are in a suitable format to instruct the engine EG to operate. The engine controller 12 controls the respective portions of the engine EG in response to the job data inputted from the main controller 11, whereby images corresponding to the print command, namely original images, are formed on a sheet (recording medium) S such as a transfer paper, a copy paper and an OHP sheet in the unit of a job.

The exposure unit 6 irradiates the light beam L upon the outer circumferential surface of the photosensitive member 2 which is charged by the charger unit 3. As shown in FIG. 24, the exposure unit 6 is electrically connected with the exposure power controller 123. Based on a modulating signal fed via the pattern adder 129, the exposure power controller 123 controls the respective portions of the exposure unit 6, whereby the photosensitive member 2 is exposed with the light beam L and an electrostatic latent image corresponding to the image signal is formed on the photosensitive member 2.

Figure 26:
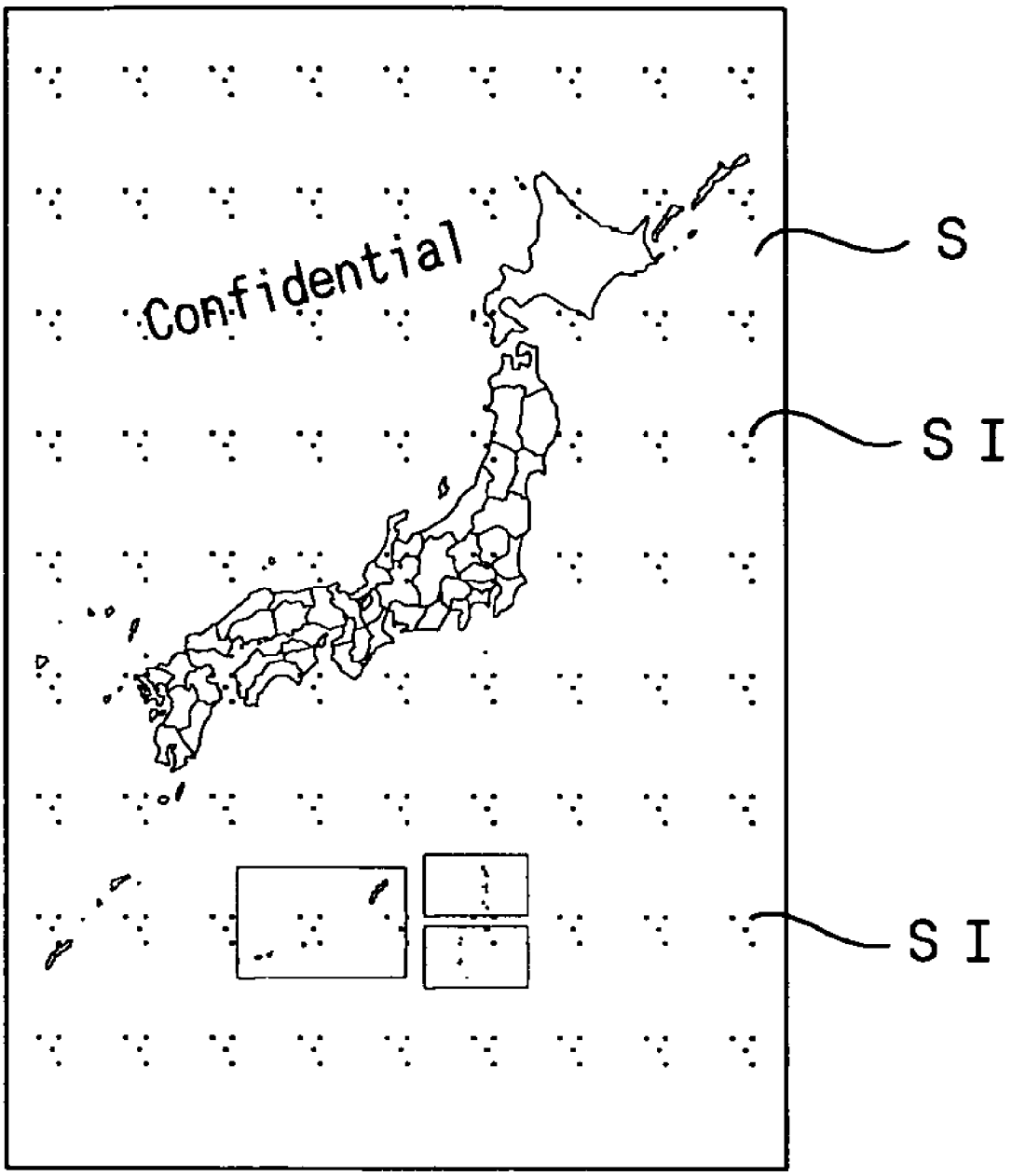
FIG. 26 is a drawing of an image which is obtained by superimposing a special image over an original image.

For instance, as a print command is fed via the interface 112 from an external apparatus such as a host computer, the modulating signal generator 210 generates a modulating signal corresponding to image data of an original image contained in the print command for each toner color component, and supplies the modulating signals to the pattern adder 129 of the engine controller 12. The pattern adder 129 comprises a memory (not shown) which stores the image pattern of the special image S1 shown in FIG. 26 mentioned earlier. As for a color component which is hard for human eyes to recognize (the yellow color in this embodiment), the pattern adder 129 adds the image pattern of the special image S1 to the modulating signal corresponding to the original image, and the resultant composite signal is fed to the exposure power controller 123. As for each of the remaining color components, the exposure power controller 123 receives the modulating signal corresponding to the original image as it is. Provided with the composite signal thus generated, the exposure power controller 123 controls turning on and off of a semiconductor laser of the exposure unit 6, whereby electrostatic latent images of the respective color components are formed on the photosensitive member 2. As a modulation method, various pulse modulation such as pulse width modulation (PWM) and pulse amplitude modulation (PAM) can be used.

Figure 25:
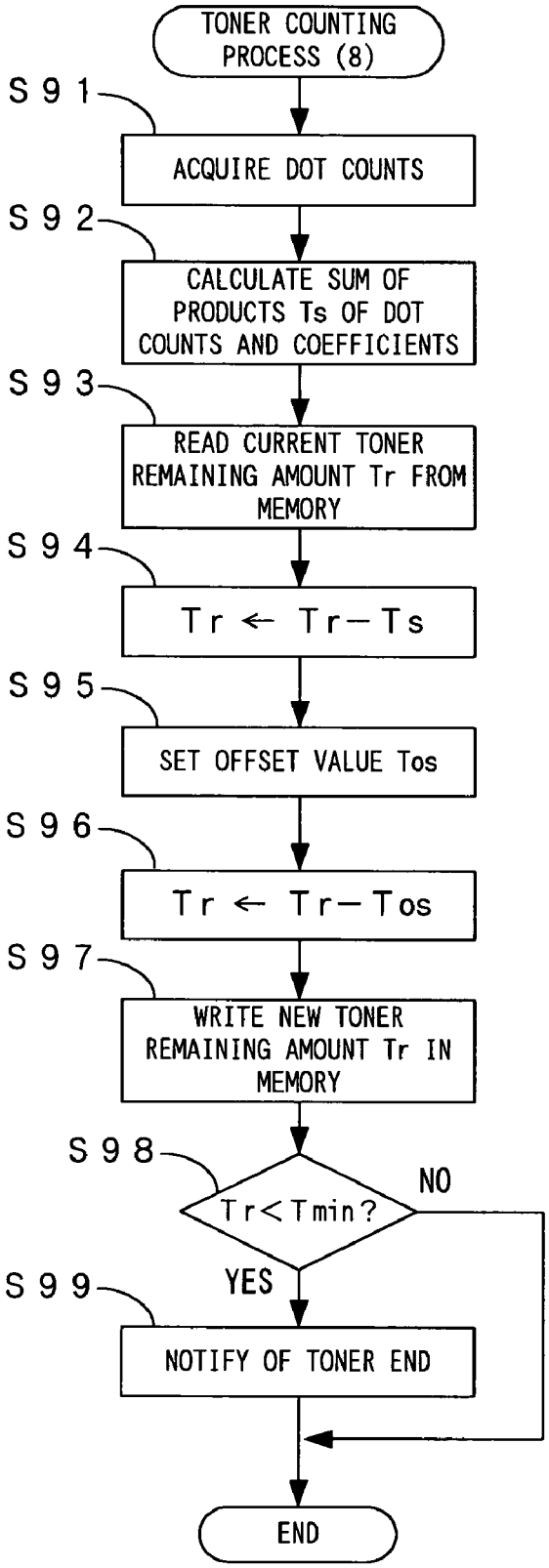
FIG. 25 is a flow chart which shows a toner counting process (8) during execution of an image forming operation.

FIG. 25 is a flow chart which shows a toner counting process (8) during execution of the image forming operation. In this image forming apparatus, for the convenience of management of consumables, the CPU 124 of the engine controller 12 executes the toner counting process (8) shown in FIG. 25 every time one image is formed, and calculates the toner remaining amounts in the developers 4Y, . . . for the respective toner colors. In short, in this embodiment, one page is used as the "predetermined unit" of the present invention and the CPU 124 functions as the "consumption amount calculating means" of the present invention. While a method of calculating a toner consumption amount and a method of calculating the amount of the toner remaining in the developer 4Y will now be described in relation to the yellow color, the operation is the same also for the other toner colors except for an offset value.

In the toner counting process (8) shown in FIG. 25, first, the counts C1, C2 and C3 of the print dots counted by the dot counter 200 are acquired (Step S91). These values are multiplied by predetermined coefficients respectively and added to each other, thereby calculating a value Ts (Step S92). That is:

$$Ts=Kx\cdot(K1\cdot C1+K2\cdot C2+K3\cdot C3)$$

The symbols Kx, K1, K2 and K3 are weighting coefficients which have been determined in advance one each for each toner color component. As the successive print dots are counted as one group and the respective counts are multiplied by the coefficients, the total amount of the toner adhering on the photosensitive member 2 which serves as the image carrier and constituting toner image of the original image namely, the total amount of "image constituting toner" of the present invention is accurately calculated. Such a method of calculating a toner amount is described in detail in Japanese Patent Application Laid-Open Gazette No. 2002-174929 mentioned earlier and will not be described here.

Next, the amount Tr of the toner remaining in the developer 4Y stored in the memory 127 of the engine controller 12 is read out (Step S93). A value obtained by subtracting the value Ts calculated as described above from this value Tr is then defined as anew toner remaining amount Tr (Step S94).

Further, this type of image forming apparatus is known to consume a very small amount of toner even when a white image is formed, i.e., even during execution of an image forming operation for printing no print dot at all. This occurs as a part of incompletely charged toner or inversely charged toner moves onto the photosensitive member 2 from the developer 4Y or a part of toner is scattered into inside the apparatus during execution of the image forming operation. Adhesion of such toner to an image is recognized as fogging. In addition, since the yellow (Y) color is the color component used in forming the special image S1 which is superimposed on the original image. This results in an additional consumption of yellow toner for the special image S1 on top of the image constituting toner.

Noting that there is a loss of toner separately from the above-mentioned image constituting toner owing to such a phenomenon, an offset value Tos corresponding to the driving time of the developer is set (Step S95). With respect to the offset value Tos, since the driving time of the developer per image is approximately constant in general when the sheet size remains unchanged, an offset value Tos is determined in advance for each sheet size and stored in the memory 127 which corresponds to "storage means" of the present invention.

Since the toner color of the special images S1 is yellow in this embodiment, a yellow color offset value Tos is set to be larger than the offset values Tos for the other toner colors. In other words, while it is necessary to consider all toner colors as for fogging as customarily practiced, with respect to the special image S1, only the yellow color needs be considered. For this reason, the yellow color offset value Tos is set to a larger value than the offset values Tos for the other toner colors.

Thus set offset value Tos is subtracted from the toner remaining amount Tr calculated at the step S94 (Step S96), anew toner remaining amount Tr of toner remaining in the developer 4Y after one image is formed is calculated. The memory 127 is updated with this value Tr (Step S97). Steps S98 and S99 which follow are the same as the steps S8 and S9 of the toner counting process (1) described earlier with reference to FIG. 5, and therefore, will not be described.

As described above, the total (Ts+Tos) of the sum of products Ts, which is obtained from the respective dot counts C1, . . . and the weighting coefficients K1, . . . , and the offset value Tos is the amount of the toner which is consumed when one image is formed. The toner consumption amount is calculated every time one image is formed, and subtracted from the immediately precedent toner remaining amount, whereby the amount Tr of the toner remaining in the developer 4Y at present (at the end of the forming of the images) is calculated.

This embodiment requires to subtract a toner consumption amount per image from the amount of toner initially held in each developer to thereby calculate the amount of toner remaining in the developer upon forming of each image. This of course is theoretically equivalent to calculation of the total toner consumption amount by means of integration of a toner consumption amount per image. Thus, in this preferred embodiment, the amount of toner which is consumed when one image is formed corresponds to the "toner consumption amount" of the present invention.

It is preferable that in the developers 4Y, . . . which are structured to be attachable to and detachable from the apparatus body, prior to removal of the respective developers from the apparatus body, the toner remaining amounts Tr in the respective developers calculated as described above are stored in the memories 42Y, . . . Upon attaching of the respective developers to the apparatus body, the toner remaining amounts in the respective developers stored in the memories 42Y, . . . are read out and used as initial toner remaining amounts Tr which are required by the toner counting process (8) described above, which makes management of the lifetime of the developers easy. Of course, in the case of a brand new developer, the amount of toner filled in the developer at the time of shipment may be stored.

As described above, according to this embodiment, the offset value Tos of yellow toner is set high, considering that yellow toner, which corresponds to the color component of the special image S1, is excessively consumed compared to toner of the other colors when the special images S1 is superimposed on the original image. Hence, it is possible to accurately calculate the toner consumption amount of yellow toner. Of course, it is possible to accurately calculate the toner consumption amounts of toner of the other colors, too, as the offset values Tos corresponding to the respective other toner colors are set.

The present invention is not limited to the preferred embodiments above, but may be modified in various manners in addition to the preferred embodiments above, to the extent not deviating from the object of the invention.

For instance, although the sixth preferred embodiment described above requires to calculate a toner consumption amount every time one image is formed during the ordinary image forming operation, the "predetermined unit" of the present invention is not limited to this but may be freely determined. Upon reception of an image forming request which demands a plurality of images to be formed for example, a toner consumption amount may be calculated after all these images are formed or every time a predetermined number of images are formed.

Further, although the sixth preferred embodiment described above is directed to an application of the present invention to an image forming apparatus which comprises the intermediate transfer belt 71 as an intermediate transfer medium, the present invention is applicable also to an image forming apparatus which comprises an intermediate transfer drum, an intermediate transfer sheet or the like as an intermediate transfer medium.

In addition, although the sixth preferred embodiment described above requires to form the special image S1 using yellow toner among toner in the four colors of yellow, cyan, magenta and black, in the event that the toner which corresponds to the color component of the special image S1 is other than yellow, the offset value corresponding to this toner may be set higher than those for the other toner.

Still further, the pattern adder 129 which adds the special image S1 to the original image is disposed to the engine controller 12 in the sixth preferred embodiment described above, it is needless to mention that the special image S1 may be added by the main controller 11.

The present invention is not limited to the preferred embodiments above, but may be modified in various manners in addition to the preferred embodiments above, to the extent not deviating from the object of the invention.

<Modification Common to First, Second, and Fourth through Sixth Preferred Embodiments>

For instance, although the first, the second, and the fourth through the sixth preferred embodiments described above use such a structure that the toner end is acknowledged when the remaining toner amount T r is smaller than the minimum toner amount Tmin, other control may be executed based on a calculated toner consumption amount or a calculated remaining toner amount. The timing of executing the image forming condition adjusting operation described above may be determined based on the remaining toner amount, for example. That is, the image forming condition adjusting operation may be executed when the remaining toner amount has reached a predetermined value. Characteristics of toner within a developer gradually change and an image density also changes in accordance with this in some cases, and hence, to determine the timing of executing the image forming condition adjusting operation in accordance with whether the remaining toner amount is large or small is effective in an effort to stabilize image densities. An alternative is to assume, from the total toner consumption amount, the amount of toner removed from the photosensitive member 2 by the cleaning blade 51 of the cleaning section 5 and thereafter collected into a disposed toner tank (not shown) of the cleaning section 5, and to estimate a remaining free capacity of the disposed toner tank based on this value.

<Modification Common to First through Fifth Preferred Embodiments>

In addition, for instance, although the first through the fifth preferred embodiments described above are directed to an image forming apparatus which is capable of forming a full-color image using toner in the four colors of yellow, cyan, magenta and black, the colors of toner and the number of the colors are not limited to this but may be freely determined. The present invention is applicable also to an apparatus which forms a monochrome image using black toner alone for example.

<Modification Common to First through Sixth Preferred Embodiments>

In addition, for instance, although the dot counter 200 is formed as an independent functional block in the first through the sixth preferred embodiments described above, the dot counter may be realized, by means of software, using a program which is executed by the CPU of either the main controller 11 or the engine controller 12.

Further, although the first through the sixth preferred embodiments described above are directed to an application of the present invention to a printer which receives image data from outside the apparatus and performs the image forming operation which is based on an image signal corresponding to the image data, it is needless to mention that the present invention may be applied to a copier machine which internally generates an image signal in accordance with pressing of a copy button for example and executes the image forming operation based on this image signal, a facsimile machine which receives image data fed on a telecommunications line and carries out the image forming operation, etc.

Although the invention has been described with reference to specific embodiments, this description is not meant to be construed in a limiting sense. Various modifications of the disclosed embodiments, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus which forms a toner image on an image carrier based on image data which are fed, wherein a toner consumption amount is calculated based on a total of a first integrating value which is obtained by integrating a first toner amount which is consumed during an ordinary toner image forming operation, and a second integrating value which is obtained by integrating a second toner amount which is consumed during an operation under a non-ordinary mode which is different from the ordinary toner image forming operation.

2. The image forming apparatus of claim 1, further comprising storage means which stores an offset value which is set in advance corresponding to the operation under the non-ordinary mode, wherein the offset value is used as the second toner amount.

3. The image forming apparatus of claim 2, wherein said storage means stores a plurality of offset values set in advance corresponding to a plurality of operations under the non-ordinary mode respectively, and when an operation under the non-ordinary mode is executed, the offset value which corresponds to the operation is extracted from said storage means, and thus extracted offset value is used as the second toner amount.

4. The image forming apparatus of claim 3, wherein the plurality of operations under the non-ordinary mode include at least two operations out of an image forming condition adjusting operation, a toner covering operation, a refreshing operation and an idling operation of toner supplying means.

5. The image forming apparatus of claim 2, further comprising offset value setting means which changes the offset value in accordance with an operating state of said apparatus.

6. The image forming apparatus of claim 2, further comprising offset value setting means which changes the offset value in accordance with a history of use of toner.

7. The image forming apparatus of claim 2, further comprising offset value setting means which changes the offset value in accordance with an image forming condition which is used in forming the toner image.

8. The image forming apparatus of claim 1, wherein the number of print dots which constitute the toner image is counted based on the image data, and the first toner amount is calculated based on thus counted number of print dots.

9. The image forming apparatus of claim 1, further comprising a judging means which judges a toner end when the toner consumption amount thus calculated exceeds a predetermined value.

10. A method of calculating a toner consumption amount for use in an image forming apparatus which forms a toner image on an image carrier based on image data which a refed, said method comprising the steps of:

calculating a first toner amount which is consumed during an ordinary toner image forming operation; and calculating a second toner amount which is consumed during an operation under a non-ordinary mode which is different from the ordinary toner image forming operation, wherein a total toner consumption amount is calculated based on a sum of a first integrating value which is obtained by integrating the first toner amount and a second integrating value which is obtained by integrating the second toner amount.

11. An image forming apparatus, comprising:

image forming means which forms a toner image on an image carrier based on an image signal which is fed; and detecting means which detects a toner amount of toner which is consumed as said image forming means forms a toner image, wherein a toner consumption amount is calculated based on an integrating value which is obtained by integrating the toner amount detected by said detecting means, as routes for feeding the image signal to said image forming means, a first route and a second route which is different from said first route are provided, and said detecting means executes a first toner amount detecting process which is based on the image signal which is fed to said image forming means through said first route, executes a second toner amount detecting process which is based on the image signal which is fed to said image forming means through said second route, and ensures that the first toner amount detecting process is different from the second toner amount detecting process.

12. The image forming apparatus of claim 11, further comprising:

first controlling means which receives image data, generates an image signal corresponding to the image data, and sends the image signal to said image forming means through said first route; and second controlling means which sends to said image forming means an image signal corresponding to an image pattern set in advance through said second route, wherein said image forming means forms a toner image corresponding to the image data based on an image signal fed from said first controlling means through said first route, and forms a toner image corresponding to the image pattern based on an image signal fed from said second controlling means through said second route, and said detecting means detects the toner amount based on the image data as the first toner amount detecting process, and detects the toner amount based on the image pattern as the second toner amount detecting process.

13. The image forming apparatus of claim 12, further comprising storage means which stores, as an offset value, a toner amount of toner which is consumed when a toner image corresponding to the image pattern is formed, wherein when an image signal is fed to said image forming means from said second controlling means through said second route, said detecting means determines that the toner amount is the offset value in the second toner amount detecting process.

14. The image forming apparatus of claim 13, wherein said second controlling means is structured to send out a plurality of image signals corresponding respectively to a plurality of image patterns set in advance to said image forming means, said storage means stores a plurality of toner amounts, each as the offset value, of toner which are consumed when toner images corresponding to the plurality of image patterns are formed, and when an image signal is fed to said image forming means from said second controlling means through said second route, said detecting means extracts the offset value corresponding to the image pattern of the image signal from said storage means and determines that the toner amount is the extracted offset value.

15. The image forming apparatus of claim 12, wherein said image forming means includes exposure means which forms an electrostatic latent image on said image carrier and developer means which makes toner adhere to said image carrier, thereby visualizing the electrostatic latent image, a modulating signal corresponding to the image pattern is stored in said second controlling means in advance as a modulating signal which controls an exposure volume of said exposure means, and said second controlling means sends the modulating signal to said exposure means as the image signal through said second route.

16. The image forming apparatus of claim 12, further comprising counting means which is electrically connected with said first controlling means, wherein said image forming means includes exposure means which forms an electrostatic latent image on said image carrier and developer means which makes toner adhere to said image carrier, thereby visualizing the electrostatic latent image, said first controlling means generates print dot data based on the image data, sends the print dot data to said counting means, generates a modulating signal which controls an exposure volume of said exposure means based on the print dot data, and sends the modulating signal as the image signal to said exposure means through said first route, said counting means counts the number of print dots which constitute the toner image corresponding to the image data, based on the print dot data, and when an image signal is fed to said image forming means from said first controlling means through said first route, said detecting means detects the toner amount based on the number of the print dots counted by said counting means in the first toner amount detecting process.

17. The image forming apparatus of claim 11, further comprising a judging means which judges the toner end when the toner consumption amount thus calculated exceeds a predetermined value.

18. A method of calculating a toner consumption amount for use in an image forming apparatus which comprises image forming means which forms a toner image on an image carrier based on an image signal which is fed, and in which a first route and a second route which is different from said first route are provided as routes for feeding the image signal to said image forming means, said method comprising:

a first detection step of detecting a toner amount of toner which is consumed as said image forming means forms a toner image based on an image signal which is fed to said image forming means through said first route;

a second detection step of detecting a toner amount of toner which is consumed as said image forming means forms a toner image based on an image signal which is fed to said image forming means through said second route; and a step of calculating a toner consumption amount based on an integrating value which is obtained by integrating the toner amounts detected at said first detection step and at said second detection step, wherein the toner amounts are detected through different processes between said first detection step and said second detection step.

19. An image forming apparatus, comprising:

image forming means which forms a toner image on an image carrier in a predetermined unit based on an operation signal inputted from a controller;

consumption amount calculating means which adds a toner amount of toner which is used in an ordinary toner image formed by said image forming means and a toner amount, as an offset value, of toner which is consumed separately from the toner which is used in the ordinary toner image, to thereby calculate a toner consumption amount of toner consumed through a toner image forming operation which is performed by said image forming means; and offset value setting means which changes the offset value in accordance with an operation signal inputted from said controller.

20. The image forming apparatus of claim 19, wherein said image forming means forms the toner image in accordance with information regarding image forming style which is contained in the operation signal from said controller, and said offset value setting means changes the offset value in accordance with the information regarding image forming style.

21. The image forming apparatus of claim 20, further comprising a transfer medium which rotates and on which N pages (where N≧2) of toner image transfer areas are arranged next to each other across one round along the direction of rotation, wherein said transfer medium is structured to be transferred, while rotating, the toner image on said image carrier onto each one of the toner image transfer areas, said image forming means forms toner images on said image carrier in such a manner that toner images of one through N pages will be transferred onto the toner image transfer areas in accordance with a page count which is contained in the operation signal from said controller as the information regarding image forming style, and said offset value setting means changes the offset value in accordance with the page count.

22. The image forming apparatus of claim 20, further comprising transfer means which transfers the toner images formed on said image carrier onto a predetermined recording medium, wherein when an operation signal from said controller contains, as the information regarding image forming style, information indicative of that said recording medium is of a type set in advance, said image forming means forms a predetermined special toner image of a color which is hard for human eyes to recognize on said image carrier in such a manner that the special toner image is superimposed on the ordinary toner image, and said offset value setting means changes the offset value in accordance with whether said image forming means is supposed to form the special toner image on said image carrier or not.

23. The image forming apparatus of claim 20, further comprising storage means which stores the offset value which is set for each one of a plurality pieces of the information regarding image forming style contained in the operation signal inputted from said controller, wherein said offset value setting means extracts the offset value to be changed from said storage means in accordance with the information regarding image forming style.

24. A method of calculating a toner consumption amount, comprising:

an image forming step of forming a toner image on an image carrier in a predetermined unit based on an operation signal inputted from a controller;

a toner consumption amount calculating step of adding a toner amount of toner which is used in an ordinary toner image formed in said image forming step and a toner amount, as an offset value, of toner which is consumed separately from the toner used in the ordinary toner image; and an offset value setting step of changing the offset value in accordance with the operation signal inputted from said controller.

25. An image forming apparatus which forms a toner image in a predetermined unit, comprising:

consumption amount calculating means which adds a total amount of image constituting toner which constitutes the toner image and a toner amount, as an offset value, of toner which is consumed in forming the toner image separately from the image constituting toner, thereby calculating, in the predetermined unit, a toner consumption amount of toner which is consumed as the toner image is formed; and offset value setting means which changes the offset value in accordance with an operating state of said apparatus.

26. The image forming apparatus of claim 25, wherein said offset value setting means changes the offset value in accordance with a cumulative value of print counts.

27. The image forming apparatus of claim 25, further comprising:

an image carrier structured to carry an electrostatic latent image corresponding to the toner image while rotating;

a toner carrier structured to carry toner while rotating; and developer means which makes toner carried on said toner carrier adhere to the electrostatic latent image carried on said image carrier, visualizes the electrostatic latent image and accordingly forms the toner image, wherein said offset value setting means changes the offset value in accordance with a cumulative number of revolutions of at least one of said image carrier and said toner carrier.

28. The image forming apparatus of claim 25, further comprising:

an image carrier structured to carry an electrostatic latent image corresponding to the toner image;

developer means which makes toner adhere to the electrostatic latent image carried on said image carrier, visualizes the electrostatic latent image and accordingly forms the toner image;

an intermediate transfer medium structured to carry a toner image while rotating; and transfer means which transfers the toner image onto said intermediate transfer medium which is rotating from said image carrier, and then transfers thus transferred toner image onto a recording medium from said intermediate transfer medium, wherein said offset value setting means changes the offset value in accordance with a cumulative number of revolutions of said intermediate transfer medium.

29. The image forming apparatus of claim 25, further comprising:

developer unit which houses toner; and toner remaining amount calculating means which calculates a toner remaining amount of toner which remains within said developer unit based on an integrating value which is obtained by integrating the toner consumption amount which is calculated in the predetermined unit, wherein said offset value setting means changes the offset value in accordance with at least one of the integrating value and the toner remaining amount.

30. An image forming apparatus which forms a toner image in a predetermined unit, comprising:

consumption amount calculating means which adds a total amount of image constituting toner which constitutes the toner image and a toner amount, as an offset value, of toner which is consumed in forming the toner image separately from the image constituting toner, thereby calculating, in the predetermined unit, a toner consumption amount of toner which is consumed as the toner image is formed; and offset value setting means which changes the offset value in accordance with a history of use of toner.

31. The image forming apparatus of claim 30, wherein said offset value setting means changes the offset value in accordance with a cumulative value of print counts.

32. The image forming apparatus of claim 30, further comprising:

an image carrier structured to carry an electrostatic latent image corresponding to the toner image while rotating;

a toner carrier structured to carry toner while rotating; and developer means which makes toner carried on said toner carrier adhere to the electrostatic latent image carried on said image carrier, visualizes the electrostatic latent image and accordingly forms the toner image, wherein said offset value setting means changes the offset value in accordance with a cumulative number of revolutions of at least one of said image carrier and said toner carrier.

33. The image forming apparatus of claim 30, further comprising:

an image carrier structured to carry an electrostatic latent image corresponding to the toner image;

developer means which makes toner adhere to the electrostatic latent image carried on said image carrier, visualizes the electrostatic latent image and accordingly forms the toner image;

an intermediate transfer medium structured to carry a toner image while rotating; and transfer means which transfers the toner image onto said intermediate transfer medium which is rotating from said image carrier, and then transfers thus transferred toner image onto a recording medium from said intermediate transfer medium, wherein said offset value setting means changes the offset value in accordance with a cumulative number of revolutions of said intermediate transfer medium.

34. The image forming apparatus of claim 30, further comprising:

developer unit which houses toner; and toner remaining amount calculating means which calculates a toner remaining amount of toner which remains within said developer unit based on an integrating value which is obtained by integrating the toner consumption amount which is calculated in the predetermined unit, wherein said offset value setting means changes the offset value in accordance with at least one of the integrating value and the toner remaining amount.

35. An image forming apparatus which forms a toner image in a predetermined unit, comprising:

consumption amount calculating means which adds a total amount of image constituting toner which constitutes the toner image and a toner amount, as an offset value, of toner which is consumed in forming the toner image separately from the image constituting toner, thereby calculating, in the predetermined unit, a toner consumption amount of toner which is consumed as the toner image is formed; and offset value setting means which changes the offset value in accordance with an image forming condition which is used in forming the toner image.

36. A method of calculating a toner consumption amount for use in an image forming apparatus which forms a toner image in a predetermined unit, comprising the steps of:

calculating a total amount of image constituting toner which constitutes the toner image;

calculating a toner amount, as an offset value, of toner which is consumed in forming the toner image separately from the image constituting toner;

adding the total amount of image constituting toner and the offset value, thereby calculating a toner consumption amount of toner which is consumed as the toner image is formed; and changing the offset value in accordance with an operating state of said image forming apparatus.

37. A method of calculating a toner consumption amount for use in an image forming apparatus which forms a toner image in a predetermined unit, comprising the steps of:

calculating a total amount of image constituting toner which constitutes the toner image;

calculating a toner amount, as an offset value, of toner which is consumed in forming the toner image separately from the image constituting toner;

adding the total amount of image constituting toner and the offset value, thereby calculating a toner consumption amount of toner which is consumed as the toner image is formed; and changing the offset value in accordance with a history of use of toner.

38. A method of calculating a toner consumption amount for use in an image forming apparatus which forms a toner image in a predetermined unit comprising the steps of:

calculating a total amount of image constituting toner which constitutes the toner image;

calculating a toner amount, as an offset value, of toner which is consumed in forming the toner image separately from the image constituting toner;

adding the total amount of image constituting toner and the offset value, thereby calculating a toner consumption amount of toner which is consumed as the toner image is formed; and changing the offset value in accordance with an image forming condition which is used in forming the toner image.

39. An image forming apparatus in which at the time of color printing of an original image using toner in a plurality of color components, a predetermined special image formed using toner in a color component which is hard for human eyes to recognize is superimposed on the original image, said apparatus comprising:

consumption amount calculating means which adds a total amount of image constituting toner which constitutes a toner image and a toner amount, as an offset value, of toner which is consumed during the color printing separately from the image constituting toner, thereby calculating a toner consumption amount in a predetermined unit, for each color component; and storage means which stores a plurality of offset values corresponding to the plurality of color components respectively, wherein the offset value corresponding to the color component used in forming the special image is set to be larger than the offset values corresponding to the other color components.

40. The image forming apparatus of claim 39, wherein the offset value corresponding to the color component used in forming the special image is set to be the largest.

41. The image forming apparatus of claim 39, wherein the offset value corresponding to the toner color used in forming the special image includes a total amount of toner which constitutes a toner image of the special image.

42. The image forming apparatus of claim 39, further comprising:

pattern adding means which adds a signal corresponding to an image pattern of the special image to an image signal corresponding to the original image, thereby generating a composite signal;

exposure means which forms an electrostatic latent image on an image carrier based on the composite signal; and developer means which makes toner adhere to the electrostatic latent image, thereby visualizing the electrostatic latent image, wherein the offset value corresponding to the color component used in forming the special image includes the total amount of toner which constitutes a toner image of the image pattern.

43. A method of calculating a toner consumption amount for use in an image forming apparatus in which at the time of color printing of an original image using toner in a plurality of color components, a predetermined special image formed using toner in a color component which is hard for human eyes to recognize is superimposed on the original image, said method comprising the steps of:

calculating a total amount of image constituting toner which constitutes a toner image of the original image in a predetermined unit for each color component;

setting a plurality of toner a mounts of toner which is consumed during the color printing separately from the image constituting toner, as a plurality of offset values for the respective color components; and adding the total amount of image constituting toner to the offset value for each color component, thereby calculating a toner consumption amount, wherein among the plurality of offset values, the offset value corresponding to the color component used in the special image is set to be larger than the offset values corresponding to the other color components.

* * * * *